US007462445B2

(12) United States Patent
Goto

(10) Patent No.: US 7,462,445 B2
(45) Date of Patent: Dec. 9, 2008

(54) IMAGE FORMING METHOD

(75) Inventor: Narito Goto, Sagamihara (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 0 days.

(21) Appl. No.: 11/845,166

(22) Filed: Aug. 27, 2007

(65) Prior Publication Data

US 2008/0057447 A1 Mar. 6, 2008

(30) Foreign Application Priority Data

Sep. 4, 2006 (JP) ..... 2006-238826

(51) Int. Cl.
*G03C 1/496* (2006.01)
*G03C 5/26* (2006.01)

(52) U.S. Cl. ..... 430/353; 430/403; 430/523; 430/619; 430/631; 430/633; 430/961

(58) Field of Classification Search ..... 430/353, 430/523, 619, 631, 633, 961, 403
See application file for complete search history.

(56) References Cited

U.S. PATENT DOCUMENTS

| | | | | |
|---|---|---|---|---|
| 5,660,384 | A * | 8/1997 | Kovach et al. | 271/145 |
| 7,132,226 | B2 * | 11/2006 | Yamane | 430/348 |
| 7,132,227 | B2 * | 11/2006 | Morita et al. | 430/617 |
| 2004/0185389 | A1 * | 9/2004 | Yoshioka et al. | 430/348 |
| 2005/0170298 | A1 * | 8/2005 | Goto | 430/502 |

* cited by examiner

*Primary Examiner*—Richard Schilling
(74) *Attorney, Agent, or Firm*—Lucas & Mercanti, LLP

(57) ABSTRACT

A method of processing a photothermographic material by a thermal processor is disclosed, wherein the photothermographic material comprises on one side of a support a light-sensitive layer containing an organic silver salt, silver halide grains, a binder and a reducing agent and a light-insensitive layer and on the other side of the support a back coating layer; the thermal processor uses a transport system in which a feed roller is disposed with being in contact with a bundle of plural stacked film sheets of the photothermographic material so as to feed the uppermost film sheet of the bundle of film sheets through rotation of the feed roller to expose and develop the fed film sheet; the light-insensitive layer or the back coating layer contains a lubricant having a mass average molecular weight of 550 or more.

17 Claims, 3 Drawing Sheets

IMAGE FORMING METHOD

This application claims priority from Japanese Patent Application No. JP2006-238826 filed on Sep. 4, 2006, which is incorporated hereinto by reference.

FIELD OF THE INVENTION

The present invention relates to an image forming method of a silver salt photothermographic dry imaging material (hereinafter, also denoted simply as photothermographic material or photosensitive material) through thermal development in a thermal development apparatus employing a photothermographic material transportation system in which plural film sheets of a photothermographic material are stacked and fed by a feed roller.

BACKGROUND OF THE INVENTION

Thermal development apparatuses performing the thermal development process of forming a latent image in a sheet film of a photothermographic material and heating the film to develop the latent image to visualize the image are commonly known, in which the sheet film stored in a container is picked-up to convey and supply the sheet film downstream. Conventionally, a vacuum pad system has been adopted, in which sheet film is lifted up, while performing vacuum adsorption of the sheet film by a pad. However, such a vacuum pad system in which the time required for pickup becomes longer, cannot be chosen from the point of view of requirement for rapid access of the thermal development process.

To minimize the time required for pickup for the reason described above is preferred a feed roller system, in which sheet film is fed by bringing a roller into contact with the uppermost sheet film, as described, for example, in U.S. Pat. No. 5,660,384.

However, when plural sheets of film stacked in a container are each fed by a feed roller, the sheet film to be fed is moved in the direction parallel to the film, while being in contact with the lower film and being rubbed, producing problems that abrasion easily occurs.

On the other hand, in photothermographic materials is known adjustment of friction factor by the use of lubricants for improvement of transportability, as described in, for example, JP-A Nos. 2004-219794 and 2004-334077 (hereinafter, the term, JP-A refers to Japanese Patent Application Publication).

However, performing rapid thermal processing by using a thermal processor using a roller pickup for sheet film instead of conventional pickup of a vacuum pad resulted in internal staining of the thermal processor or abrasion of the sheet film, deteriorated transportability and increased variation of density due to change of humidity. There is also desired improvement of density variation accompanied with change in transportability under low humidity or with humidity change.

SUMMARY OF THE INVENTION

The present invention has come into being in view of the foregoing situation. Thus, it is an object of the invention to provide an image forming method not causing internal staining in a thermal processor or abrasion of a film sheet and achieving superior transportability even under low humidity and improvement in density variation with humidity change, even when performing rapid thermal processing of photothermographic materials in a compact low-price laser imager provided with a thermal processor using a roller pickup.

Studies of phenomena causing internal staining of a thermal processor, abrasion of a film sheet, transportability under low humidity and density variation with humidity change when performing rapid processing by a thermal processor employing a roller pickup proved that occurrence of internal staining, transportability under low humidity and density variation with humidity change were greatly affected by the kind of lubricants or surfactants used in a photothermographic material and surface roughness of the photothermographic material, leading to the present invention. Further, it was also proved to be affected by physical characteristics of coating of a photothermographic material (e.g., Young's modulus, surface hardness, stiffness).

Studies based on these findings found that the object of the invention was accomplished at a relatively high level by the use of plural binders for a light-sensitive layer, differing in glass transition temperature (Tg), a total thickness of a light-sensitive layer and a light-insensitive layer provided on one side of the support being in the range of 10 to 20 μm and the use of a high-active reducing agent, such as one as represented by formula (RD1).

One aspect of the invention is directed to an image forming method of a photothermographic material comprising on one side of a support a light-sensitive layer containing an organic silver salt, silver halide grains, a binder and a reducing agent and a light-insensitive layer and on the other side of the support a back coating layer by using a thermal processor, the method comprising the steps of:

subjecting the photothermographic material to imagewise exposure and subjecting the exposed photothermographic material to thermal development to form an image, wherein the thermal processor includes a transport system in which a feed roller is disposed with being in contact with a bundle of stacked film sheets of the photothermographic material so as to feed an uppermost film sheet of the bundle of film sheets by rotation of the feed roller to subject the fed film sheet to the exposure and the thermal development; the light-insensitive layer or the back coating layer contains a lubricant having a mass average molecular weight of 550 or more.

DETAILED DESCRIPTION OF THE INVENTION

Arrangement of Apparatus

Figure 1:
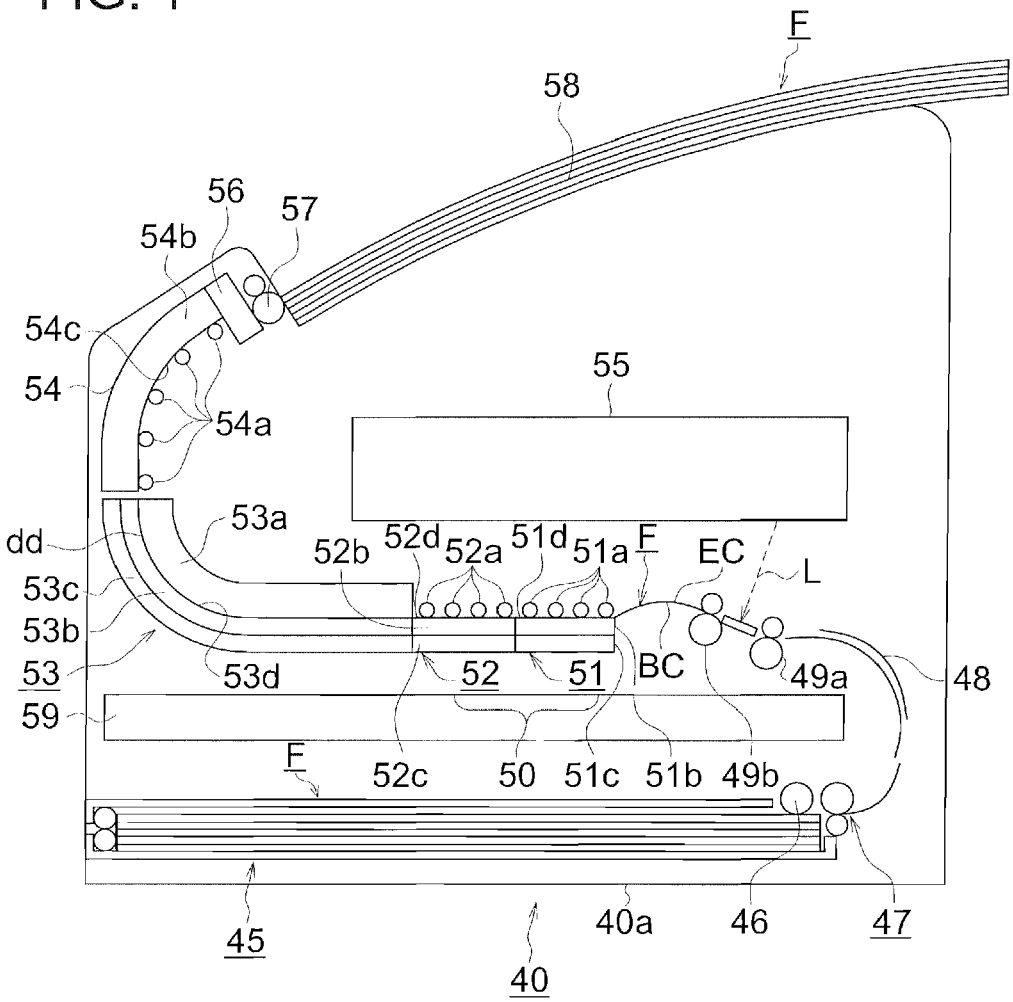
FIG. 1 is a side-view illustrating the main part of an image forming apparatus of a thermal development system including a sheet film transport system.

There will be described preferred embodiments of the invention with reference to drawings. FIG. 1 is a side-view illustrating the main part of an image forming apparatus of a thermal development system including a sheet film transport system, according to one preferred embodiment of the invention.

In image forming apparatus 40 of a thermal development system, as shown in FIG. 1, film F comprising a EC-face having a photothermographic material coating on one side of a sheet support comprised of PET or the like and a BC-face on the side opposite the EC-face is exposed to laser light from light scanning exposure section 55 to form a latent image, while conveyed in the sub-scanning direction. Subsequently, the film F is heated from the BC-face side to develop the latent image to form a visible image, then, conveyed through a transport route having a curvature to the upper portion of the apparatus and discharged. The apparatus is provided with a relatively small-sized apparatus frame 40*a* and is a desktop type constitution which is usable with being set on the desk.

As shown in FIG. 1, the image forming apparatus 40 is provided with film enclosure section 45 enclosing unexposed film (F) stock, installed near the bottom of apparatus frame 40*a,* pickup roller 46 to pick up the uppermost sheet of film F in the film enclosure tray section 45, paired transport rollers 47 to convey the film F from the pickup roller 46, to curved guide 48 which is arranged in a curved form so as to guide the film F conveyed by the transport roller 47 and to convey the film F in a nearly reversed direction, paired transport rollers 49*a* and 49*b* to convey the film F from the curved guide 48, light scanning exposure section 55 to expose laser light L by light-scanning onto the film F, based on image data, between paired transport rollers 49*a* and 49*b* to form a latent image on the EC face and A light-reflection type or light-transmission type detection sensor disposed upstream from the transport roller 49*a* to detect the film F conveyed from the curved guide 48.

The image forming apparatus 40 is further provided with temperature-raising section 50 to raise the temperature of the exposed film F having formed a latent image to a prescribed development temperature by heating the film from the BC-face size, temperature-retaining section 53 to heat the heated film F to maintain the film F at a prescribed temperature, cooling section 54 to cool the heated film F from the BC-face side, densitometer 56 arranged in the exit side of the cooling section 54 to measure the density of the film, paired transport rollers 57 to discharge the film from the densitometer, and film storage section 58 to stack the film F discharged by the paired transport rollers 57 and installed on upper surface of the apparatus frame with being inclined upward.

In the image forming apparatus 40, as shown in FIG. 1, the film enclosure section 45, base plate section 59, the paired transport rollers 49*a* and 49*b,* the temperature-raising section 50 and the temperature-retaining section 53, are arranged in the order from the bottom of the apparatus frame 40*a* to the above, and the film enclosure section 45 is not subject to heating influence heating since it is located lowermost and has the base plate section 59 intervened under the temperature-raising section 50 and temperature-retaining section 53, is not subject to heating influence heating.

The transport route from the paired transport rollers 49*a* and 49*b* to the temperature-raising section 50 is arranged to be relatively short so that the top portion of a sheet of the film F is already thermally developed in the temperature-raising section 50 and the temperature-retaining section 53, while the end portion of the sheet of the film F is exposed by the light-scanning exposure section 55.

The temperature-raising section 50 and the temperature-retaining section 53 constitute a heating section, where the film F is heated to a thermal development temperature and maintained at the thermal development temperature. The temperature-raising section 50 is comprised of upstream first heating zone 51 to heat the film F and downstream second heating zone 52 to heat the film F.

The first heating zone 51 is composed of fixed planar heating guide 51*b* of metallic material such aluminum, planar heater 51*c* of silicone rubber heater or the like, tightly attached to the back face of the heating guide 51*b,* and plural opposed rollers 51*a* which are arranged so that a narrower clearance than the film thickness is kept to compress the film onto fixed guide surface 51*d* and the surface of which is formed of silicone rubber exhibiting a high heat-insulating capability as compared to metals or the like.

The first heating zone 52 is structured of fixed planar heating guide 52*b* and composed of metallic material such aluminum, while planar heater 52*c* composed of silicone rubber heater or the like, tightly attached to the back face of the heating guide 52*b,* and plural opposed rollers 52*a* which are arranged so that a clearance narrower than the film thickness is maintained to press the film onto fixed guide surface 52*d* and the surface of which is formed of silicone rubber exhibiting a higher heat-insulating capability as compared to metals or the like.

The temperature-retaining section 53 is structured of fixed planar heating guide 53*b* and composed of metallic material such aluminum, planar heater 53*c* composed of silicone rubber heater or the like, tightly attached to the back face of the heating guide 52*b,* and guide section 53*a* which is arranged facing fixed guide surface 53*d* constituted on the surface of the heating guide 53*b* with holding a prescribed clearance (slit) d and which is formed of a heat-insulating material. The heat-retaining section 53, in which a portion of the side of the temperature-raising section 50 is planarily arranged after the second heating zone 52, upward curves in the middle thereof at a prescribed curvature.

In the first heating zone 51 of the temperature-raising section 50, the film F which is conveyed by paired transport rollers 49*a* and 49*b* from upstream of the temperature-raising section 50, is conveyed, while heated on the BC-face (denoted as BC) being pressed onto the guide face 51*d* by driven opposed rollers 51*a* so as to be in close contact with the fixed guide surface 51*d.*

Similarly, in the second heating zone 52, the film F conveyed from the first heating zone 51 is conveyed, while heated on the BC-face being compressed onto the fixed guide face 51*d* by opposed rollers 52 a so as to be in close contact with the fixed guide surface 51*d.*

A recess, opening upward in a V-form may be provided between the second heating zone 52 of the temperature-raising section 50 and the temperature-retaining section 53. Foreign matter carried out of the temperature-raising section 50 can fall down into the interior of the recess, and thereby prevent the foreign matter from being carried in the temperature-retaining section 53.

In the temperature-retaining section 53, the film F conveyed from the second heating zone passes through clearance dd between the fixed guide surface 53*d* and the guide section 53*a* by the conveying force of the opposed roller 52*a* on the side of the second heating zone 52, while heated (or temperature-maintained) in the clearance d by heat from the heating guide 53*b.* The film F is conveyed toward the cooling section 54, while gradually turned from the horizontal direction to the vertical direction.

In the cooling section 54, the film F vertically conveyed from the temperature-retaining section 53 is conveyed toward the film accumulation section 58, while cooled by bringing the film F into contact with the cooling guide surface 54*c* of the cooling plate 54*b* formed of a metallic material by the opposed roller 54*a* and turning the direction of the film from the vertical direction to an oblique. Cooling effects can be promoted by modifying the cooling plate 54*b* by a finned heat sink structure. A part of the cooling plate 54*b* may be modified by a finned heat sink structure.

The cooled film F conveyed from the cooling section is then subjected to densitometry by densitometer 56, conveyed by the paired transport rollers 57 and discharged onto the film storage section 58. The film storage section 58 can temporarily stack plural sheets of the film F.

In the thermal development apparatus 40 shown in FIG. 1, the film F is conveyed through the temperature-raising section 50 and the temperature-retaining section 53, while the BC-face faces the fixed guide surfaces 51*d*, 52*d* and 53*d* and the EC-face coated with photothermographic material is opened.

The film F is conveyed by opposed rollers 51*a* and 52*a* so as to pass through the temperature-raising section 50 and the temperature-retaining section 53 within 10 sec. Accordingly, the heating duration over the temperature-raising section and the temperature-retaining section is to be 10 sec. or less.

Figure 2:
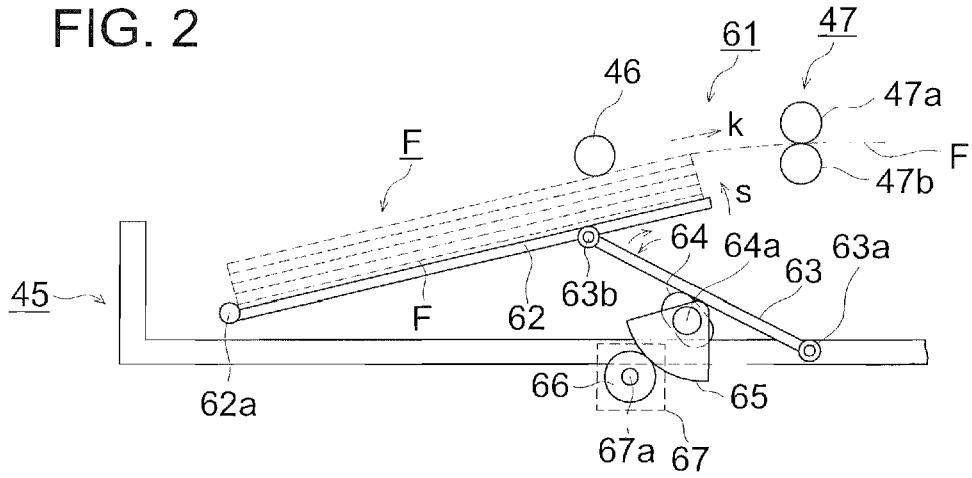
FIG. 2 illustrates a side-view of a film transport apparatus to feed film and to convey it downstream from the film enclosure tray section shown in FIG. 1.

Next, a film transport apparatus applicable to the image forming apparatus 40 shown in FIG. 1 will be described with reference to FIG. 2. FIG. 2 illustrates a side-view of a film transport apparatus to feed film and to convey it downstream from the film enclosure tray section shown in FIG. 1.

Film transport apparatus 61 shown in FIG. 2 is provided with film enclosure tray section 45, the pickup roller 46 and the paired transport rollers 47, as shown in FIG. 1, and is further provided with a lift mechanism to lift upwardly many sheets of film F charged in the film enclosure tray section 45.

As shown in FIG. 2, the lift mechanism of film transport device 61, of which one end 62*a* of the film enclosure tray section 45 is axially supported and is rotatable, is provided with lifting plate 62 to lift a number of sheets of film F indicated by broken lines upwardly along with rotation in direction S and lifting plate 63 of which one end 63*a* of the side of the film enclosure tray section 45 and the other end 63*b* of the side of the lifting plate 62 is supported by a shaft and is pivotable thereon and which moves the lifting plate 62 to move up and down by the other end 63*b* with rotation.

The lift mechanism is further provided with driving motor 67, elliptical contact cam section which is in contact with the lower surface of the lifting plate 64, gear 65 to rotate the contact cam 64 around rotation shaft 64*a* and gear 66 which is rotated by rotating shaft 67*a* of the driving motor 67 and is engaged with the gear 65.

The driving motor 67 changes its inclination by rotating the contact cam 64 via the gears 66 and 65 so that the uppermost film sheet is always in contact with the transport roller 46 even when the film F is conveyed sheet by sheet and decreases. Thus, the contact cam 64 is controlled so that the longitudinal direction of the contact cam 64 inclines close to the horizontal direction when a number of film F is present and the longitudinal direction of the contact cam 64 inclines close to the vertical direction as the number of sheets of film F decreases.

The transport roller 46 is composed of a rotating roller driven by a motor and rotated while being in contact with the uppermost sheet of film F housed within the film enclosure tray section 45, thereby feeding film F in the direction indicated by broken lines in FIG. 2 and conveying it downstream.

Paired transport roller 47 is comprised of driving roller 47*a* to give driving force in the transport direction to film F fed from the transport roller 46 and handling roller 47*b* to handle film F sheet by sheet in cooperation with the driving roller 47*a*. When the transport roller 46 feeds plural sheets of film F, the driving roller 47*a* gives a driving force in the transport direction to the uppermost sheet of film F, while the handling roller 47*b* rotates in the reverse direction to the driving roller 47*a* to feed a film sheet below the uppermost film sheet F to the reverse direction and return it to the interior of the film enclosure tray section 45.

Figure 3:
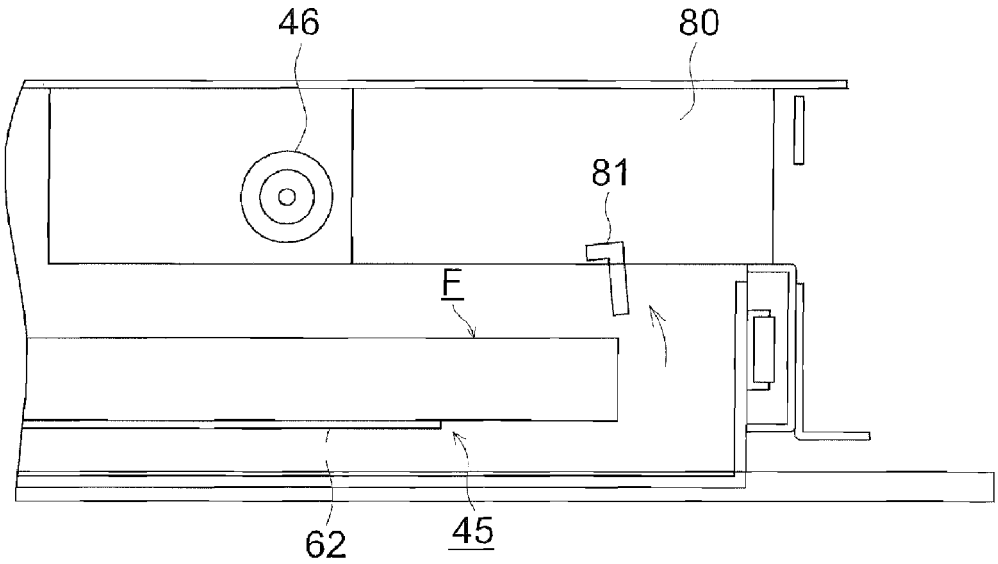
FIGS. 3(*a*) and 3(*b*) are front views illustrating relative positions between the film and a separation claw within the film enclosure tray.
Figure 3:
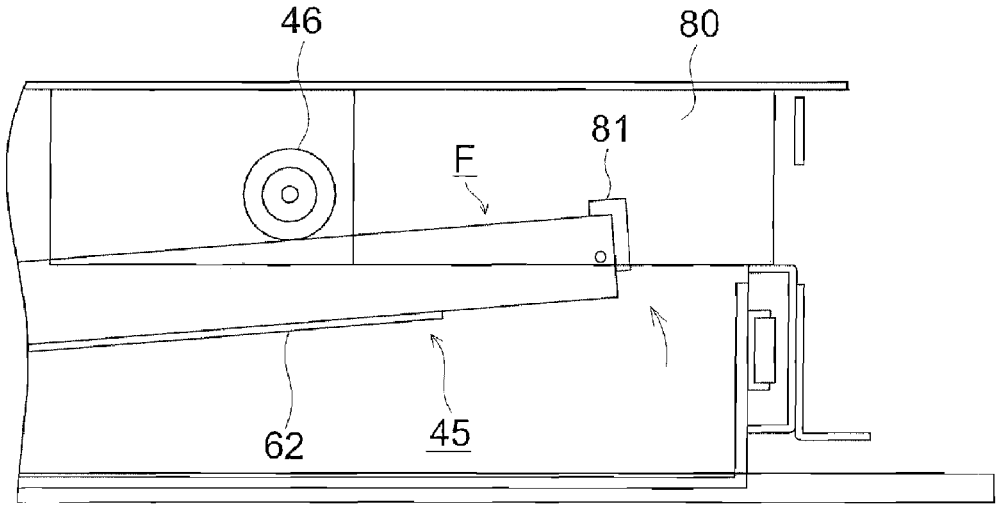

With reference to FIG. 3, there will be described a separation claw to separate the uppermost film sheet when conveying sheets of the film from the film enclosure tray section. FIGS. 3(*a*) and 3(*b*) are front views illustrating relative positions between the film and a separation claw within the film enclosure tray.

As shown in FIGS. 3(*a*) and 3(*b*), separation claw 81 is mounted on supporting plate 80 inside the apparatus frame 41*a* shown in FIG. 1. The separation claw 81 is provided so as to be in contact, by its deadweight, with both ends of the top of the uppermost film within the film enclosure tray section 45.

When lifting up sheets of film F by the lifting plate 62 in the direction indicated by the arrow from the initial position of FIG. 3(*a*), as shown in FIG. 3(*b*), transport roller 46 is brought into contact with the uppermost sheet of film F and concurrently, the separation claw is brought into contact, by its deadweight, with both top corners of the film sheet. When the transport roller 46 is rotated in such a state, a protrudent, elastically deformed portion is formed on the uppermost film sheet in the area in contact with the separation claw. Energy accumulated in the elastically deformed portion leads to separation of the uppermost film sheet from the subsequent film sheets. Constitution of such a separation claw is commonly known, for example, in Japanese Patent No. 3666885.

The lifting plate 62 of the film transport apparatus of FIG. 2 stops its rotational movement when arrival of the loaded uppermost sheet of the film F to the prescribed position is detected by a position-detecting sensor. At that moment, the transport roller 46 is brought into contact, by its deadweight, with the uppermost sheet of the film F with centering on supporting shaft 46*b* (shown in FIG. 4). Following change of the position of the uppermost sheet of film F with conveyance of the film, the transport roller 46 is brought into contact with the uppermost film. When the position of the uppermost sheet of film F is varied (or lowered) more than a prescribed amount, separation conveyance of the film is stopped and the lifting plate 62 again starts rotational movement until sensed by the position-detecting sensor.

According to the foregoing constitution, the line pressure onto the film F (film nip pressure) can be controlled to a prescribed range of 0.49 N/cm or less and a film conveying track falling within the prescribed range becomes feasible, enabling stable film separation/conveyance without noticeable abrasion.

Figure 4:
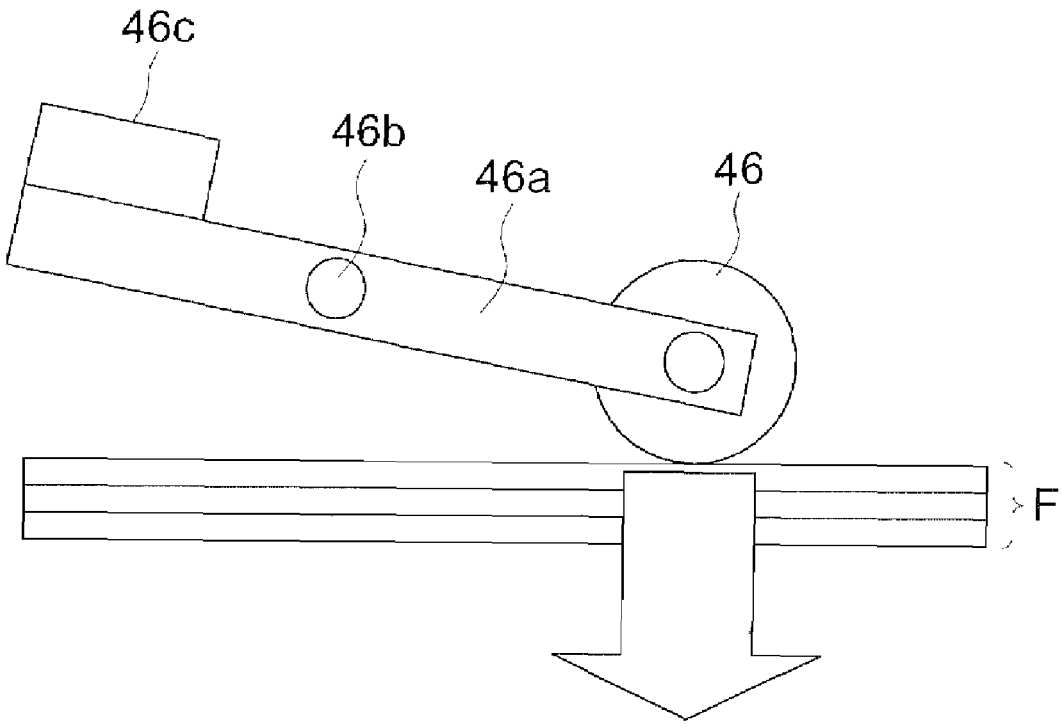
FIG. 4 illustrates an aligning linkage mechanism.

As described above, the transport roller 46 is brought into contact with the film F at a line pressure of 0.49 N/cm or less. As shown in FIG. 4, the transport roller 46 has an aligning linkage mechanism to achieve uniform contact pressure over all of the lateral direction (or vertical direction to the space). Thus, linkage member 46*a* makes supporting shaft 46*b* as a supporting point, axially supports the transport roller 46 at one end thereof and provides balancing weight 46*c* on the other end, thereby resulting in uniform contact pressure of the transport roller 46 onto sheets of the film F. In FIG. 4, variation of the mass of the balancer 46*c* can further control the contact pressure onto sheets of the film F.

In the image forming apparatus 40 shown in FIGS. 1, 2, 3(*a*) and 3(*b*), when image data is inputted from an outside, the film transport device is operated, the film is lifted by the lifting plate 62 and the transport roller rotates with being in contact with the uppermost film F within the film enclosure tray section 45, whereby a sheet of the film F is transported in the direction indicated by designation "k" in FIG. 2. Then, the film F is fed by the transport roller 47 via guide 48 to paired transport rollers 49*a* and 49*b* and conveyed in the sub-scanning direction. The sheet of film F is exposed based on image data between the paired transport rollers 49*a* and 49*b* by scanning laser light L from the light-scanning exposure section 55 to form a latent image on the EC (emulsion) side of the film F. Subsequently, the film forming the latent image is heated within the temperature-raising section 50 and the temperature-retaining section 53 to achieve visualization of the latent image through thermal development. The film sheet is cooled in cooling section 54 and discharged onto the film storage section 58.

The contact pressure of the transport roller 46 is made uniform in the lateral direction across a sheet of the film F by the aligning linkage mechanism of FIG. 4, so that the transport roller 46 is not unevenly brought into contact with the film sheet in the lateral direction, rendering it difficult to cause abrasion.

As described above, occurrence of abrasion on the EC side of the sheet of film F becomes rare, whereby high image quality is achieved in visible images formed on the sheet of film F.

In a laser imager as a processor usable in the invention, the distance between the exposure section and the development section is preferably from 0 to 50 cm, more preferably from 3 to 40 cm, and still more preferably from 5 to 30 cm. A distance falling within this range can shorten the processing time of exposure and development. The exposure section refers to the position at which a photothermographic material is exposed to light from a light source and the development section refers to the position at which the exposed photothermographic material is heated to perform thermal development.

In the laser imager relating to the invention, the ratio of the path length of the cooling section to the path length of the thermal developing section is 1.5 or less, preferably from 0.1 to 1.2, more preferably from 0.2 to 1.0. The path length of the thermal developing section refers to the distance of conveying a photothermographic material with heating at a developing temperature. The path length of the cooling section refers to the distance of conveying the thermally developed photothermographic material from the end of the thermal developing section (being after completion of heating) to the exit of the laser imager (or until discharging the photothermographic material under the ambient light of a room where the laser imager is installed, from the light-tight region of the laser imager).

The laser imager preferably has a function of making the cooling rate of the opposite side of the photothermographic material to the light-sensitive layer (hereinafter, also denoted as the light-insensitive side) greater than that of the light-sensitive layer side (hereinafter, also denoted as the light-sensitive side).

In the invention, the cooling rate ratio of the light-insensitive side to that of the light-sensitive side is preferably at least 1.1, more preferably from 1.1 to 5.0, and still more preferably from 1.5 to 3.0. The means for increasing the cooling rate on the light-insensitive side are not specifically limited but it is a preferred embodiment to bring the light-insensitive side into direct contact with a metal plate, a metal roller, unwoven fabric or a flocked roller. It is also preferable to use a heat sink or a heat pipe in combination with the foregoing members.

A laser imager having a short cooling section, which exhibits the ratio of a path length of a cooling section to that of a thermal-developing section of 1.5 or less, can provide a compact, higher-speed laser imager.

The cooling time of from leaving the thermal-developing section until being discharged from the exit of the laser imager is preferably 0 to 25 sec., more preferably 0 to 15 sec., and still more preferably 5 to 15 sec.

The path length over which a photothermographic material passes after leaving the thermal developing section and before being discharged, is optional, preferably 1 to 60 cm, more preferably 5 to 50 cm, and still more preferably 5 to 40 cm.

Photothermographic material relating to the invention may be thermally developed in any method, but usually, an image-wise exposed photothermographic material is developed, while being heated at a relatively high temperature. The developing temperature is preferably 80 to 250° C., more preferably 100 to 140° C., and still more preferably 110 to 130° C. The developing time is preferably 1 to 10 sec., more preferably 2 to 10 sec., and still more preferably 3 to 10 sec. A developing temperature of less than 80° C. cannot obtain sufficiently high image density over a short period of time, while a developing temperature of more than 200° C. causes melting of the binders, adversely affecting not only the image but also transportability or the processor, such as transfer onto rollers. Heating causes oxidation-reduction reaction between an organic silver salt (which functions as an oxidant) and a reducing agent to form a silver image. This reaction proceeds without supplying any processing solution such as water. The thermal processing time (the time from pickup of photothermographic material in the tray section and to discharge thereof) is preferably not more than 60 sec. and more preferably 10 to 50 sec., whereby diagnosis in case of emergence can be corresponded.

The thermal development system of the invention can employ a drum type heater or a plate type heater but a plate heater system is preferred. The preferred thermal development system of a plate heater system is the method described in JP-A No. 11-133572, that is, a laser imager in which a photothermographic material which has been exposed to light to form latent images on silver halide grains, is brought into contact with a heating means in the thermal-developing section to obtain a visible image. The heating means is composed of a plate heater and a plurality of pressure rollers are arranged facing and along the surface of the plate heater. The photothermographic material is allowed to pass between the plate heater and the pressure rollers to perform thermal development.

The transport speed (or linear velocity) in each of the exposure section, the thermal-developing section and the cooling section is optional but a higher speed is preferred for rapid processing or enhancement of through-put. The transport speed is preferably 30 to 200 mm/sec, more preferably 30 to 150 mm/sec, and still more preferably 30 to 60 mm/sec. A transport speed falling within this range can improve density unevenness due to thermal development and can decrease the processing time, which is suitable for urgent medical diagnosis.

Heating instruments, devices or means can employ typical heating means such as a hot plate, an iron, a hot roller and a heat generator using carbon or white titanium. Heating a photothermographic material having a protective layer on the light-sensitive layer with contacting the protective layer side with heating means to achieve uniform heating is preferred in terms of heat efficiency and workability.

A photothermographic material in a sheet form is developed preferably by using a laser imager that needs setting area of 0.25 to 0.40 $m^2$. A setting area falling within this range can achieve space-saving.

When the photothermographic material according to the invention is developed for 12 sec. at a heating temperature of 123° C., the photothermographic material preferably exhibits an average gradation of 1.8 to 6.0, more preferably 2.0 to 5.0 and still more preferably 2.0 to 4.5 over the diffuse density range from 0.25 to 2.5 in a characteristic curve on a rectangular coordinate system comprised of a diffuse density (Y-axis) and a common logarithmic exposure (X-axis). In such a gradation can be obtained an image exhibiting enhanced diagnostic recognizing ability at a relatively low silver coverage.

To adapt to a laser imager relating to the invention, the total dry layer thickness of light-sensitive and light-insensitive layers of the photothermographic material is preferably from 10 to 20 μm, more preferably from 12 to 19 μm and still more preferably from 14 to 18 μm. The light-sensitive layer thickness is preferably from 4 to 16 μm, more preferably from 6 to 14 μm, and still more preferably from 8 to 12 μm. A light-sensitive layer of not less than 4 μm can obtain a sufficient image density and a light-sensitive layer of not more than 16 μm can attain sufficient level in terms of image storage stability and density variation with humidity change.

Lubricant

Lubricants usable in the invention preferably have a mass average molecular weight of 550 or more. Any structure having a mass average molecular weight of 550 or more is usable but paraffin, liquid paraffin and fatty acid ester are preferred. Of these, a fatty acid ester is more preferred and a fatty acid ester of a polyhydric alcohol is specifically preferred. The mass average molecular weight is preferably not less than 700, and more preferably not less than 800. The upper limit of a mass average molecular weight is not specifically limited, but preferably not more than 10,000, more preferably not more than 7,000, and still more preferably not more than 5,000. A mass average molecular weight of 550 or more can achieve marked improvement of internal staining of a thermal processor.

A fatty acid ester of a polyhydric alcohol may be one which is completely or one in which a part of alcoholic groups is remained. A fatty acid ester having two or more ester groups is preferred and one having three or more ester groups is more preferred.

Examples of a lubricant usable in the invention include triolein (or glycerin trioleate), glycerin laurate, glycerin tripalmitate, glycerin tristearate, glycerin tribehenate, lauric acid-i-tridecyl, myristic acid-i-tridecyl, palmitic acid-i-tridecyl, stearic acid-i-tridecyl, arachidic acid-i-tridecyl, erucic acid-i-tridecyl, behenic acid-i-tridecyl, tri-i-lauric acid trimethylolpropane, tri-i-myristic acid trimethylolpropane, tri-i-palmitic acid trimethylolpropane, tri-i-stearic acid trimethylolpropane, tri-i-erucic acid trimethylolpropane, tri-i-arachidic acid trimethylolpropane tri-i-oleic acid trimethylolpropane, tri-i-behenic acid trimethylolpropane, hexa-i-stearic acid dipentaerythrityl, hexa-i-palmitic acid dipentaerythrityl, hexa-i-myristic acid dipentaerythrityl, hexa-i-behenic acid dipentaerythrityl and compounds set forth in Tables 1, 2 and 3 of JP-A No. 2004-334077, but are not limited to the foregoing compounds.

The mount of a lubricant contained in the light-insensitive layer or the back coating layer is preferably from 1 to 200 $mg/m^2$ and more preferably from 10 to 100 $mg/m^2$.

Fluorine-Containing Surfactant

In the photothermographic material of the invention is preferably used a fluorine-containing compound (fluorine-containing surfactant) containing at least one substituent having 2 to 16 carbon atoms and 13 or less fluorine atoms, and at least one of an anionic hydrophilic group and a cationic hydrophilic group. The use of such a specific fluorine-containing compound can improve internal staining in a thermal processor, transportability under low humidity and density variation with humidity change, specifically density variation with humidity change.

In the invention is preferably used a fluorine-containing compound represented by the following formula (SF):

$$[R_f\text{-}(L^1)_{m1}\text{-}]_p\text{-}(L^2)_{n1}\text{-}(A)_q \qquad \text{formula (SF)}$$

wherein $R_f$ represents a fluorine-containing substituent having 2 to 16 carbon atoms and 13 or less fluorine atoms, $L^1$ represents a bivalent linkage group containing no fluorine, $L^2$ represents a (p+q)-valent linkage group containing no fluorine, A represents an anion or its salt, m1 and n1 are each an integer of 0 or 1, p is an integer of 1 to 3, q is an integer of 1 to 3, provided that when q is 1, m1 and n1 are not zero at the same time.

In the formula (SF), examples of $R_f$ of a fluorine-containing substituent include a fluoroalkyl group having 2 to 16 carbon atoms (e.g., trifluoromethyl, trifluoroethyl, perfluoroethyl, perfluorobutyl, perfluorooctyl, perfluorododecyl), and a fluoroalkenyl group (e.g., perfluoropropenyl, perfluorobutenyl, perfluorononenyl, perfluorododecenyl). $R_f$ preferably has 2 to 8 carbon atoms, and more preferably 2 to 6 carbon atoms. $R_f$ preferably contains 2 to 12 fluorine atoms, and more preferably 3 to 12 fluorine atoms.

In the foregoing formula, $L^1$ represents a bivalent, fluorine-free linkage group. Examples of divalent linking groups containing no fluorine atom include an alkylene group (e.g., a methylene group, an ethylene group, and a butylene group), an alkyleneoxy group (such as a methyleneoxy group, an ethyleneoxy group, or a butyleneoxy group), an oxyalkylene group (e.g., an oxymethylene group, an oxyethylene group, and an oxybutylene group), an oxyalkyleneoxy group (e.g., an oxymethyleneoxy group, an oxyethyleneoxy group, and an oxyethyleneoxyethyleneoxy group), a phenylene group, and an oxyphenylene group, a phenyloxy group, and an oxyphenyloxy group, or a group formed by combining these groups.

In the foregoing formula, A represents an anion group or a salt group thereof. Examples include a carboxylic acid group or salt groups thereof (sodium salts, potassium salts and lithium salts), a sulfonic acid group or salt groups thereof (sodium salts, potassium salts and lithium salts), a sulfuric acid half ester group or salt group thereof (sodium salts, potassium salts and lithium salts) and a phosphoric acid group and salt groups thereof (sodium salts, potassium salts and lithium salts).

In the foregoing formula, $L^2$ represents a fluorine-free linkage group having a valence of (p+q). Examples thereof include trivalent or tetravalent linking groups having no fluorine atom, which are groups of atoms comprised of a nitrogen atom as the center; n is an integer of 0 or 1, and preferably 1.

The fluorinated surfactants represented by the foregoing formula (SF) are prepared as follows. Alkyl compounds having 2 to 12 carbon atoms into which fluorine atoms are introduced (e.g., compounds having a trifluoromethyl group, a pentafluoroethyl group, a perfluorobutyl group, a perfluorooctyl group) and alkenyl compounds (e.g., a perfluorohexenyl group, a perfluorononenyl group) undergo addition reaction or condensation reaction with each of the tri- to hexavalent alkanol compounds into which fluorine atom(s) are not introduced, aromatic compounds having 3 or 4 hydroxyl groups or hetero compounds. Anion group (A) is further introduced into the resulting compounds (including alkanol compounds which have been partially subjected to introduction of Rf) employing, for example, sulfuric acid esterification.

Examples of the aforesaid tri- to hexa-valent alkanol compounds include glycerin, pentaerythritol, 2-methyl-2-hydroxymethyl-1,3-propanediol, 2,4-dihydroxy-3-hydroxymethylpentane, 1,2,6-hexanrtriol. 1,1,1-tris(hydroxymethyl) propane, 2,2-bis(butanol), aliphatic triol, tetramethylolmethane, D-sorbitol, xylitol, and D-mannitol. The aforesaid aromatic compounds, having 3-4 hydroxyl groups and hetero compounds, include, for example, 1,3,5-trihydroxybenzene and 2,4,6-trihydroxypyridine.

The fluorine-containing substituent is preferably a fluoroalkyl group. Such a fluoroalkyl group contains preferably not more than 13 fluorine atoms, more preferably 3 to 12 fluorine atoms, and still more preferably 5 to 9 fluorine atoms. The fluoroalkyl group has preferably 2 or more carbon atoms, more preferably 4 to 16 carbon atoms, and still more preferably 6 to 10 carbon atoms.

A fluorine-containing compound usable in the invention preferably contains at least two fluoroalkyl groups having 2 or more carbon atoms and not more than 13 fluorine atoms. The two fluoroalkyl groups are preferably an identical group in terms of ease of synthesis.

The fluoroalkyl group is preferably one represented by the following formula (1):

-Lb-Raf-W formula (1)

wherein Lb represents a substituted or unsubstituted alkylene or alkyleneoxy group or a group formed by the combination of these groups. A substituent may be any one, but is preferably an alkenyl group, an aryl group, an alkoxy group, a halogen atom (preferably, chlorine), a carboxylic acid ester group, a carbonamido group, a carbamoyl group or a phosphoric acid ester group. Lb preferably has not more than 8 carbon atom, and more preferably not more than 4 carbon atoms. Lb is also preferably an unsubstituted alkylene group. Raf represents a perfluoroalkylene group having 1 to 6 carbon atoms, and a perfluoroalkylene group having 2 to 4 carbon atoms is preferred. The perfluoroalkylene group is referred to an alkylene group in which all of hydrogen atoms is replaced by fluorine atoms. The perfluoroalkylene group may be straight-chained, branched or cyclic. W is a hydrogen atom, a fluorine atom or an alkyl group, and preferably a hydrogen atom or a fluorine atom.

Specific examples of a fluoroalkyl group include: $—C_2F_5$, $—C_3F_7$, $—C_4F_9$, $—C_5F_{11}$, $—CH_2C_4F_9$, $—C_4F_8H$, $—(CH_2)_2C_4F_9$, $—(CH_2)_4C_4F_9$, $—(CH_2)_6C_4F_9$, $—(CH_2)_8C_4F_9$, $—(CH_2)_2C_4F_8H$, $—(CH_2)_4C_4F_8H$, $—(CH_2)_6C_4F_8H$, $—(CH_2)_6C_2F_4H$, $—(CH_2)_8C_2F_4H$, $—(CH_2)_6C_4F_8CH_3$, $—(CH_2)_2C_3F_7$, $—(CH_2)_2C_5F_{11}$, $—(CH_2)_4CF(CF_3)_2$, $—CH_2CF_3$, $—(CH_2)_4CH(C_2F_5)_2$, $—(CH_2)_4CH(CF_3)_2$, $—(CH_2)_4C(CF_3)_3$, $—CH_2C_4F_8H$, $—CH_2C_6F_{12}H$, and $—(CH_2)_2C_6F_{13}$.

An anionic hydrophilic group contained in the fluorine-containing compound refers to an acidic group exhibiting a pKa of 7 or less, or its alkali metal or ammonium salt. Specific examples thereof include a sulfo group, a carboxyl group, a phosphonic acid group, a carbamoylsulfamoyl group, a sulfamoylsulfamoyl group, an acylsulfamoyl group and their salts. Of these groups, a sulfo group, a carboxyl group, a phosphonic acid group and their salts are preferred, and a sulfo group and its salt are more preferred. Cationic species capable of forming a salt include lithium, sodium, potassium, cesium, ammonium, tetramethylammonium, tetrabutylammonium, and methylpyridinium, and of these, lithium, sodium, potassium and ammonium are preferred.

Example of a nonionic hydrophilic group contained in the fluorine-containing compound include a hydroxyl group and a polyalkyleneoxy group, and a polyalkyleneoxy group is preferred. A polyalkyleneoxy group and an anionic hydrophilic group described above may be contained in the same molecule, which is a preferred structure in the invention. Combined use of an anionic compound and a nonionic compound is effective and preferred.

In the invention, a fluorine-containing compound represented by the following formula (F) is more preferred:

formula (F)

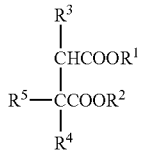

In formula (F), $R^1$ and $R^2$ are each a substituted or unsubstituted alkyl group, provided that at least one of them is a fluoroalkyl group having 2 to 16 carbon atoms and not more than 13 fluorine atoms. When one of $R^1$ and $R^2$ is not a fluoroalkyl group but an alkyl group, such an alkyl group is preferably one having 2 to 16 carbon atoms, and more preferably one having 4 to 12 carbon atoms. $R^3$ and $R^4$ are each a hydrogen atom or a substituted or unsubstituted alkyl group; $R_5$ represents $-L-SO_3M^1$, in which $M^1$ is a hydrogen atom or a cation, and L is a single bond or a substituted or unsubstituted alkylene group.

Examples of a fluoroalkyl group of $R^1$ and $R^2$ include those afore-described, and a preferred structure is the same as set forth in the foregoing fluoroalkyl group $R^1$ and $R^2$ preferably are each a fluoroalkyl group.

The substituted or unsubstituted alkyl group represented by $R^3$ and $R^4$ may be straight-chained, branched or cyclic. A substituent may be any one but preferred examples thereof include an alkenyl group, an aryl group, a halogen group (preferably a chlorine atom), carboxylic acid ester group, a carbonamido group, a carbamoyl group, an oxycarbonyl group and a phosphoric acid ester group.

$R_5$ represents $-L-SO_3M^1$, in which $M^1$ is a hydrogen atom or a cation. Preferred examples of a cation of M include an alkali metal ion (e.g., lithium, sodium, potassium ions), an alkaline earth metal ion (e.g., barium, calcium ions) and an ammonium group. Of these cations, lithium, sodium, potassium ions and an ammonium group are preferred, and lithium, sodium and potassium ions are more preferred, which may be chosen according to the total carbon number of the compound, a substituent, and an branching extent of the formula (F). When the total carbon number of $R^1$, $R^2$, $R^3$ and $R^4$ is 16 or more, lithium ion is preferred in terms of compatibility pf solubility (specifically, in water) and antistatic capability or uniform coatability.

L is a single bond or a substituted or unsubstituted alkylene group. Preferred examples of a substituent are those as cited in $R^3$ described above. A substituted or unsubstituted alkylene group of L is preferably one having carbon atoms of not more than 2. L is preferably a single bond or a methylene group, and more preferably a methylene group.

The formula (F) is more preferably a combination of preferred embodiments described above. Specific examples of the compound of formula (F) include those set forth in JP-A No. 2004-12587, paragraph [0024] through [0027].

Further, examples of fluorinated surfactants include [FS-1] to [FS-66] set forth in JP-A No. 2003-149766, paragraph [0029] to [0040]; compounds1-1 to 1-4 set forth in paragraph [0014] and compounds 2-1 to 2-10 set forth in [0019] of JP-A No. 2004-021084; and compounds set forth in paragraph [0025] and [0030] of JP-A No. 077792.

Specific preferred examples of fluorinated surfactants usable in the invention are shown below.

SF-1

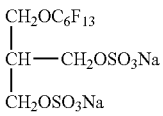

SF-2

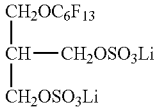

SF-3

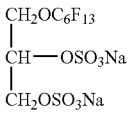

SF-4

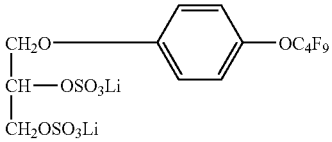

SF-5

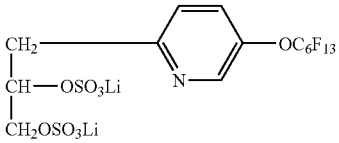

SF-6

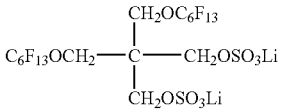

SF-7

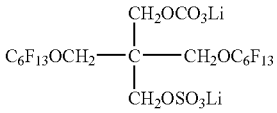

SF-8

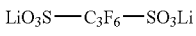

SF-9

SF-10

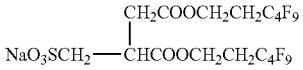

SF-11

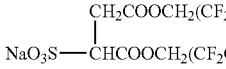

SF-12

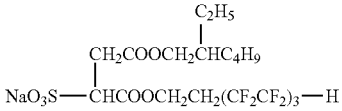

SF-13

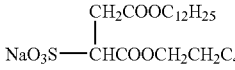

SF-14

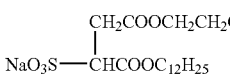

-continued (F-1)

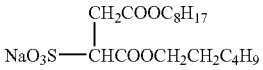

(F-2)

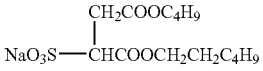

(F-3)

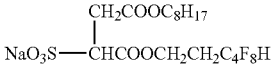

(F-4)

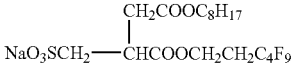

(F-5)

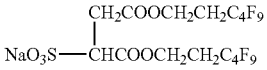

(F-6)

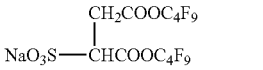

(F-7)

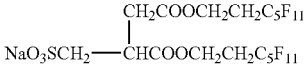

(F-8)

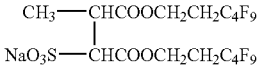

(F-9)

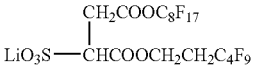

(F-10)

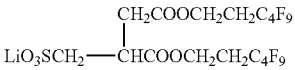

(F-11)

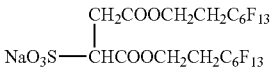

Fluorinated surfactants usable in the invention, other than the foregoing ones include compounds described in JP-A No. 2004-117505, paragraph [0035] and compounds described in JP-A Nos. 2000-214554, 2003-156819, 2003-177494, 2003-114504, 2003-270754 and 2003-270760.

The combined use of the foregoing anionic surfactants of formula (SF) and conventionally known nonionic fluorinated surfactants in the photothermographic material is preferred in terms of enhanced static property and coatability.

It is possible to add fluorinated surfactants to liquid coating compositions, employing any conventional addition methods known in the art. Thus, they are dissolved in solvents such as alcohols including methanol or ethanol, ketones such as methyl ethyl ketone or acetone, and polar solvents such as dimethylformamide, and then added. Further, they may be dispersed into water or organic solvents in the form of minute particles at a maximum size of 1 μm, employing a sand mill, a jet mill, or an ultrasonic homogenizer and then added. Many techniques are disclosed for minute particle dispersion, and it is possible to perform dispersion based on any of these. It is preferable that the aforesaid fluorinated surfactants are added to the protective layer which is the outermost layer.

The added amount of the aforesaid fluorinated surfactants is preferably $1\times10^{-8}$ to $1\times10^{-1}$ mol per $m^2$, more preferably $1\times10^{-5}$ to $1\times10^{-2}$ mol per $m^2$. When the added amount is less than the lower limit, it is not possible to achieve desired charging characteristics, while it exceeds the upper limit, storage stability degrades due to an increase in humidity dependence.

Surface Roughness

In the photothermographic material, the ten-point mean roughness (Rz), the maximum roughness (Rt) and the center-line mean roughness (Ra) are defined in JIS Surface Roughness (BO601). The JIS B 0601 also corresponds to ISO 468-1982, ISO 3274-1975, ISO 4287/1-1984, ISO 4287/2-1984 and ISO 4288-1985. The ten-point mean roughness is the value of difference, being expressed in micrometer (μm), between the mean value of altitudes of peaks from the highest to the 5th, measured in the direction of vertical magnification from a straight line that is parallel to the mean line and that does not intersect the profile, and the mean value of altitudes of valleys from the deepest to the 5th, within a sample portion, the length of which corresponds to the reference length, from the profile. The maximum roughness (Rt) of the surface is determined as follows. Thus, when a length corresponding to the reference length (L) in the direction of a mean line is sampled from a roughness profile, the maximum roughness (Pt) is a value, expressed in micrometer (μm) measuring the space between a peak line and a valley line in the direction of vertical magnification of the profile. The center-line mean roughness (Ra), when the roughness curve is expressed by y=f(x), is a value, expressed in micrometer (μm), that is obtained from the following formula, extracting a part of reference length L in the direction of its center-line from the roughness curve, and taking the center-line of this extracted part as the X-axis and the direction vertical magnification as the Y-axis:

$$Ra = \frac{1}{L}\int_0^L |f(x)|dx$$

The measurement of Rz, Rt and Ra were made under an environment of 25° C. and 65% RH after allowed to stand under the same environment so that samples are not overlapped. The expression, samples are not overlapped means a method of winding with raising the film edge portion, overlapping with inserting paper between films or a method in which a frame is prepared with thick paper and its four corners are fixed. Measurement apparatuses usable in the invention include, for example, RST PLUS non-contact three-dimensional micro-surface-form measurement system (WYKO Co.).

The Rz, Rt and Ra values can be adjusted so as to fall within the intended range by combination of the following technical means:

(1) the kind, average particle size, amount and a surface treatment method of a matting agent (inorganic or organic powder) contained in the layer of the light-sensitive layer side and in the layer of the opposite side, (2) dispersing conditions of the matting agent (e.g., the kind of a dispersing machine, dispersing time, the kind or the average particle size of beads used in the dispersion, the kind and amount of a dispersing agent, the kind of a polar group of a binder and its content), (3) drying conditions in the coating stage (e.g., coating speed, distance from the coating side to the hot air nozzle, drying air volume) and residual solvent quantity, (4) the kind of a filter used for filtration of coating solutions and filtration time, and (5) when subjected to a calendering treatment after coating, its conditions (e.g., a calendering temperature of 40 to 80° C., a pressure of 50 to 300 kg/cm, a line-speed of 20 to 100 m and the nip number of 2 to 6).

In the invention, the center line mean roughness (Ra(B)) of the uppermost surface of the back coating layer side is preferably 50 to 120 nm, more preferably 60 to 115 nm and still more preferably 70 to 110 nm; the center line mean roughness (Ra(E)) of the uppermost surface of the light-sensitive layer side is preferably 70 to 140 nm, more preferably 80 to 135 nm and still more preferably 90 to 130 nm. The ten point mean roughness (Rz(B)) of the uppermost surface of the light-sensitive layer side is preferably 1.5 to 4.0 μm, and more preferably 2.0 to 3.5 μm. The ten point mean roughness (Rz (B)) of the uppermost surface of the back coating layer side is preferably 4.0 to 7.0 μm, and more preferably 4.0 to 6.0 μm. In the invention, the ratio of Rz(E)/Rz(B) is preferably 0.1 to 0.7 and more preferably 0.2 to 0.6.

In the foregoing, "(E)" represents the uppermost layer of the light-sensitive layer, and "(B)" represents the uppermost surface layer of the back coating layer side opposite the light-sensitive layer. A Rz(B) of 4.0 to 7.0 μm and a Rz(E) of 1.5 to 4.0 μm reduce internal staining in a thermal processor, occurrence of abrasion of film and density variation with humidity change and achieve enhanced transportability under low humidity.

The value of Ra(E)/Ra(B) is preferably 0.6 to 1.5, more preferably 0.6 to 1.3, and still more preferably 0.7 to 1.1, thereby resulting in minimized fogging during aging, enhanced film tacking characteristics and minimized unevenness in density, caused in thermal development.

Rt(E) is preferably from 2.0 to 8.0 μm, and more preferably 3.0 to 6.0 μm. Rt(B) is preferably from 4.0 to 12.0 μm, and more preferably from 5.0 to 10.0 μm. Rt(E) and Rt(B) falling with the foregoing range can reduce internal staining in a thermal processor.

The photothermographic material of the invention preferably contains a matting agent A exhibiting an average particle size of 0.3 to 2.0 μm (more preferably 0.5 to 1.5 μm) and a matting agent B exhibiting an average particle size of 2.5 to 7.0 μm (more preferably 3.0 to 6.0 μm) in the outermost layer of the light-sensitive layer side; the mass ratio of matting agent A to matting agent B is preferably from 99:1 to 60:40, and more preferably 95:5 to 70:30. The matting agent content of the outermost layer of the light-sensitive layer side is usually 1.0% to 20%, preferably 2.0% to 15%, and more preferably 3.0% to 10% by mass of the binder content of the outermost layer (in which cross-linking agents are included in the binder content).

A mating agent (preferably, a matting agent comprised of an organic resin) contained in the outermost layer of the opposite side of the light-sensitive layer preferably exhibits an average particle size of 5.0 to 15.0 μm, and more preferably 7.0 to 12.0 μm. The content thereof is usually 0.2% to 10%, preferably 0.4% to 7%, and more preferably 0.6% to 5% by mass of the binder content of the outermost layer (in which cross-linking agents are included in the binder content).

In the photothermographic material of the invention, when matting agent(s) are contained in the outermost layer of the light-sensitive layer side and the average particle size of a matting agent exhibiting the maximum average particle size is designated as Le (μm), and matting agents are also contained in the outermost surface layer of the opposite side to the light-sensitive layer and the average particle size of a matting agent exhibiting the maximum average particle size is designated as Lb (μm), the ratio of Lb/Le is 2.0 to 10, and more preferably 3.0 to 4.5, thereby resulting in an improvement in unevenness of density. Further, the value of Rz(E)/Ra(E) of the light-sensitive layer side is preferably 12 to 60, and more preferably 14 to 50, thereby resulting in improvements in unevenness of density and storage stability. The value of Rz(B)/Ra(B) is preferably 25 to 65, and more preferably 30 to 60, thereby resulting in improvements in unevenness of density and storage stability.

The foregoing surface roughness was evaluated in the following manner.

Using a noncontact three-dimensional surface analyzer (ST/PLUS, produced by WYKO Co.), a raw material sample which has not been subjected to thermal development, was measured as follows:

1) objective lens:×10, intermediate lens:×10
2) measurement range: 463.4 μm×623.9 μm
3) pixel size: 368×238
4) filter: cylinder correction and inclination correction
5) smoothing: medium smoothing
6) scanning speed: Low.

The foregoing Ra, Rz and Rt are defined in JIS Surface Roughness (BO601). A sample of 10 cm×10 cm was divided to 100 squares at intervals of 1 cm, the center of the respective square regions was measured and an average value was calculated from 100 measurements.

In one preferred embodiment of the invention, the surface layer contains a matting agent. In the surface layer of the light-sensitive layer side or of the opposite side of the support to the light-sensitive layer of the photothermographic material, it is preferred to use organic or inorganic powdery material (more preferably organic powdery material) as a matting agent to control the surface roughness. Powdery material can suitably be chosen from organic or inorganic powdery materials. Example of organic powdery material include polymethyl methacrylate (preferably, three-dimensionally cured polymethyl methacrylate), polystyrene, and Teflon (trade name). Examples of inorganic powdery material include titanium oxide, boron nitride, $SnO_2$, $SiO_2$, $Cr_2O_3$, α—$Al_2O_3$, α—$Fe_2O_3$, α—FeOOH, SiC, cerium oxide, corundum, artificial diamond, garnet, mica, silicate, silicon nitride and silicon carbide. Of these, three-dimensionally cured polymethyl methacrylate and polystyrene are preferred, and three-dimensionally cured polymethyl methacrylate is more preferred.

Of the foregoing powdery materials, those which have been subjected to a surface treatment, are preferred. The surface treatment layer is formed in the following manner. An inorganic raw material is subjected to dry-system pulverization, then water and a dispersing agent are added thereto and further subjected wet-system pulverization, and after subjected to centrifugal separation, coarse classification is conducted. Thereafter, the thus prepared particulate slurry is transferred to the surface treatment bath where surface coating of a metal hydroxide is performed. Thus, a prescribed amount of an aqueous solution of a salt of Al, Si, Ti, Zr, Sb, Sn, Zn or the like is added thereto and an acid or alkali is further added for neutralization to coat the inorganic powdery particulate surface with a hydrous oxide. Water-soluble salts as by-products are removed by decantation, filtration or washing. The slurry is adjusted to a specific pH value, filtered and washed with pure water. The thus washed cake is dried by a spray drier or a hand drier. Finally, the dried material is pulverized to obtain a product. Besides of the foregoing aqueous system, vapor of $AlCl_3$ or $SiCl_4$ may be introduced to non-magnetic inorganic powder, followed by introduction of water vapor to perform Al— or Si— surface treatment. Other surface treatment methods are referred to "Characterization of Powder Surfaces", Academic Press.

In the invention, it is preferred to perform a surface treatment using a silicon (Si) compound or Aluminum (Al) compound. The use of the thus surface-treated powder results in superior dispersion when preparing the dispersion of a matting agent. In that case, the Si content is preferably 0.1% to 10% by mass, more preferably 0.1% to 5% by mass and still more preferably 0.1% to 2% by mass; the Al content is preferably 0.1% to 10% by mass, more preferably 0.1% to 5% by mass and still more preferably 0.1% to 2% by mass. The weight ratio of Si to Al is preferably to be Si<Al. The surface treatment can also be performed by the method described in JP-A No. 2-83219. with respect to the average particle size of a powdery material, that of spherical particle powder is its average diameter, that of a needle-form particle powder is the average major axis length and that of tabular particle powder is the average value of maximum diagonal lines on the tabular plane, which can readily be determined by electron microscopic observation.

The coefficient of variation of powdery particle size distribution is preferably 505 or less, more preferably 405 or less, and still more preferably 30% or less. The coefficient of variation of particle size distribution is the value defined in the following equation:

[(standard deviation of particle size)/(average particle size)]×100.

Organic or inorganic powdery material may be dispersed in a coating solution and then coated. Alternatively, after coating a coating solution, organic or inorganic powdery material may be sprayed thereon. Plural powdery materials may employ the foregoing methods in combination.

An organic silver salt usable in the invention is a light-insensitive organic silver salt capable of functioning as a source for supplying silver ions necessary to form an image in the light-sensitive layer of a photothermographic material.

Organic silver salts usable in the invention which are relatively stable to light, function as a silver ion supplying source and contribute to formation of silver images when heated at a temperature of 80° C. or more in the presence of silver halide grains (photocatalyst) having latent images formed upon exposure a photocatalyst on the grain surface and a reducing agent. There have been known silver salts of organic compounds having various chemical structure. Such light-insensitive organic silver salts are described in JP-A No. 10-62899, paragraph [0048]-[0049]; European Patent Application Publication (hereinafter, denoted simply as EP-A) No. 803,764A1, page 18, line 24 to page 24, line 37; EP-A No. 962,812A1; JP-A Nos. 11-349591, 2000-7683, 2000-72711, 2002-23301, 2002-23303, 2002-49119, 2002-196446; EP-A Nos. 1246001A1 and 1258775A1; JP-A Nos. 2003-140290, 2003-195445, 2003-295378, 2003-295379, 2003-295380 and 2003-295381.

Silver salts of aliphatic carboxylic acids, specifically long chain aliphatic carboxylic acids having 10 to 30 carbon atoms, preferably 15 to 28 carbon atoms are preferable used alone or in combination with the foregoing organic silver salts. The molecular weight of such an aliphatic carboxylic acid is preferably from 200 to 400, and more preferably 250 to 400. Preferred aliphatic carboxylic acid (or fatty acid) silver salts include, for example, silver behenate, silver arachidate, silver stearate, silver oleate, silver laurate, silver caprate, silver myristate, silver palmitate and their mixtures. Of the foregoing aliphatic carboxylic acid silver salts, a fatty acid silver salt having a silver behenate content of 50 mol% or more (preferably 80 to 99.9 mol %, and more preferably 90 to 99.9 mol %) is preferably used. The use of aliphatic carboxylic acid silver salts having a relatively high content of silver behenate results in markedly enhanced image storage stability.

Prior to preparation of an aliphatic carboxylic acid silver salt, it needs to prepare an alkali metal salt of an aliphatic carboxylic acid. Alkali metal salts usable in the invention include, for example, sodium hydroxide, potassium hydroxide and lithium hydroxide. Of these, the use of potassium hydroxide is preferred. The combined use of sodium hydroxide and potassium hydroxide is also preferred. The molar ratio of the combined use is preferably within the range of 10:90 to 75:25. The use within the foregoing range can suitably control the viscosity of a reaction mixture when forming an alkali metal salt of an aliphatic carboxylic acid through the reaction with an aliphatic carboxylic acid.

When preparing an aliphatic carboxylic acid silver salt in the presence of silver halide grains having an average grain size of 0.050 μm or less, a higher content of potassium of alkali metal salts is preferred in terms of prevention of dissolution of silver halide grains and Ostwald ripening. A high potassium content results in reduced sizes of aliphatic acid silver salt particles. The proportion of a potassium salt of total alkali metal salts is preferably 50 to 100 mol % of the whole alkali metal salts. The alkali metal salt concentration is preferably from 0.1 to 0.3 mol/1000 ml.

To obtain a sufficient image density after thermal development, the average sphere-equivalent diameter of aliphatic carboxylic acid silver salts used in the invention is preferably from 0.05 to 0.50 μm, more preferably 0.10 to 0.45 μm, and still more preferably 0.15 to 0.40 μm. The sphere-equivalent diameter refers to a diameter of a sphere having a volume equivalent to the volume of a particle of the aliphatic carboxylic acid silver salts. A coated sample is observed by a transmission electron microscope and a particle volume is determined from the projection area and thickness of an observed particle. When the particle volume is converted to a sphere having the same volume as the particle, the particle size is represented by a diameter of the sphere. The average sphere-equivalent diameter of aliphatic carboxylic acid silver salts can readily be controlled, for example, by increasing the proportion of a potassium salt in preparation of aliphatic carboxylic acid silver salts or by adjusting a zirconia bead size, a circumferential speed of a mill or a dispersing time in the process of dispersing a light-sensitive emulsion.

Other than the foregoing organic silver salts are also usable core/shell organic silver salts described in JP-A No. 2002-23303; silver salts of polyvalent carboxylic acids, as described in EP 1246001 and JP-A No. 2004-061948; and polymeric silver salts, as described in JP-A Nos. 2000-292881 and 2003-295378 to 2003-295381.

The shape of aliphatic carboxylic acid silver salts usable in the invention is not specifically limited and organic silver salts in any form, such as needle form, bar form, tabular form or scale form, are usable. Aliphatic carboxylic acid silver salts in a scale-form are preferred in the invention. There are also preferably used organic silver salts in the form of a short needle exhibiting a ratio of major axis to minor axis of 5 or less, a rectangular parallelepiped or a cube, or potato-form irregular grains. These aliphatic carboxylic acid silver salt particles result in reduced fogging during thermal development, as compared to grains in the form of a long-needle exhibiting a ratio of major axis to minor axis of 5 or more. In the invention, an aliphatic carboxylic acid silver salt in a scale form is defined as follows. The aliphatic carboxylic acid silver salt is electron-microscopically observed and the form of organic silver salt grains is approximated by a rectangular parallelepiped. When edges of the rectangular parallelepiped are designated as "a", "b" and "c" in the order from the shortest edge (in which c may be equal to b), values of shorter edges a and b are calculated to determine "x" defined as below:

$$x=b/a$$

Values of x are determined for approximately 200 grains and the average value thereof (denoted as x(av.)) is calculated. Thus, grains satisfying the requirement of $x(av.)\geqq 1.5$ are defined to be a scale form. Preferably, $30\geqq x(av.)\geqq 1.5$, and more preferably, $20\geqq x(av.)\geqq 2.0$. In this connection, the needle form satisfies $1\leqq x(av.)<1.5$.

In the foregoing grain in a scale form, "a" is regarded as a thickness of a tabular grain having a major face comprised of edges of "b" and "c". The average value of "a" is preferably from 0.01 to 0.23 μm, more preferably 0.1 to 0.20 μm. The average value of c/b is preferably from 1 to 6, more preferably 1.05 to 4, still more preferably 1.1 to 3, and further still more preferably 1.1 to 2.

The grain size distribution of an aliphatic carboxylic acid silver salt is preferably monodisperse. The expression, being monodisperse means that the percentage of a standard deviation of minor or major axis lengths, divided by an average value of the minor or major axis, is preferably less than 100%, more preferably not more than 80%, and still more preferably not more than 50%. The shape of aliphatic carboxylic acid silver salts can be determined through transmission electron-microscopic images of an aliphatic carboxylic acid silver salt dispersion. Alternatively, the standard deviation of volume-weighted grain size, divided by the average volume-weighted grain size (that is a coefficient of variation) is preferably less than 100%, more preferably not more than 80%, and still more preferably not more than 50%. The measurement thereof is carried out, for example, as follows. To an aliphatic carboxylic acid silver salt dispersed in a liquid, laser light is irradiated and an auto-correction function vs. time change of fluctuation of scattered light to determine the grain size (volume-weighted average grain size).

Conventionally known methods are applicable to manufacturing or dispersing organic silver salts of the invention, for example, as described in JP-A No. 10-62899, EP 803,763A1, EP 962,812A1, JP-A Nos. 2001-167022, 2000-7683, 2000-72711, 2001-163889, 2001-163890, 2001-163827, 2001-33907, 2001-188313, 2001-83652, 2002-64422002-31870 and 2003-280135.

Dispersing aliphatic carboxylic acid silver salts concurrently in the presence of a light-sensitive silver salt, such as silver halide grains results in increased fogging and decreased sensitivity, and it is therefore preferred that the dispersion contains substantially no light-sensitive silver salt. Thus, the content of an aqueous dispersion of light-sensitive silver salt is preferably not more than 1 mol %, based on organic silver salt of the dispersion, more preferably not more than 0.1 mol %, and no addition of light-sensitive silver salt is more preferred.

The photothermographic material of the invention can be prepared by mixing an aqueous dispersion of aliphatic carboxylic acid silver salts with an aqueous dispersion of light-sensitive silver salt. The ratio of light-sensitive silver salt to aliphatic carboxylic acid silver salt can be optionally chosen but preferably from 1 to 30 mol %, more preferably 2 to 20 mol %, and still more preferably 3 to 15 mol %. To control photographic characteristics, it is preferred to mix an aqueous dispersion of at least two kinds of organic silver salts with an aqueous dispersion of at least two kinds of light-sensitive silver salts.

Organic silver salts or aliphatic carboxylic acid silver salts are usable in an intended amount but preferably 0.1 to 5 g/m$^2$, based on silver amount, more preferably 0.3 to 3 g/m$^2$, and still more preferably 0.5 to 2 g/m$^2$.

Light-sensitive silver halide grains (hereinafter, also denoted simply as silver halide grains) used in the invention are those which are capable of absorbing light as an inherent property of silver halide crystal or capable of absorbing visible or infrared light by artificial physico-chemical methods, and which are treated or prepared so as to cause a physico-chemical change in the interior and/or on the surface of the silver halide crystal upon absorbing light within the region of ultraviolet to infrared.

The silver halide grains used in the invention can be prepared according to conventionally known methods. Any one of acidic precipitation, neutral precipitation and ammoniacal precipitation is applicable and the reaction mode of aqueous soluble silver salt and halide salt includes single jet addition, double jet addition and a combination thereof. Specifically, preparation of silver halide grains with controlling the grain formation condition, so-called controlled double-jet precipitation is preferred.

The grain forming process is usually classified into two stages of formation of silver halide seed crystal grains (nucleation) and grain growth. These stages may continuously be conducted, or the nucleation (seed grain formation) and grain growth may be separately performed. The controlled double-jet precipitation, in which grain formation is undergone with controlling grain forming conditions such as pAg and pH, is preferred to control the grain form or grain size. In cases when nucleation and grain growth are separately conducted, for example, a soluble silver salt and a soluble halide salt are homogeneously and promptly mixed in an aqueous gelatin solution to form nucleus grains (seed grains), thereafter, grain growth is performed by supplying soluble silver and halide salts, while being controlled at a pAg and pH to prepare silver halide grains. After completion of grain formation, soluble salts are removed in the desalting stage, using commonly known desalting methods such as the noodle method, flocculation method, ultrafiltration method and electrodialysis method.

Silver halide grains are preferably monodisperse grains with respect to grain size. The monodisperse grains as described herein refer to grains having a coefficient of variation of grain size obtained by the formula described below of not more than 30%; more preferably not more than 20%, and still more preferably not more than 15%:

Coefficient of variation of grain size (%)=standard deviation of grain diameter/average grain diameter×100

The grain form can be of almost any one, including cubic, octahedral or tetradecahedral grains, tabular grains, spherical grains, bar-like grains, and potato-shaped grains. Of these, cubic grains, octahedral grains, tetradecahedral grains and tabular grains are specifically preferred.

The aspect ratio of tabular grains is preferably 1.5 to 100, and more preferably 2 to 50. These grains are described in U.S. Pat. Nos. 5,264,337, 5,314,798 and 5,320,958 and desired tabular grains can be readily obtained. Silver halide grains having rounded corners are also preferably employed.

Crystal habit of the outer surface of the silver halide grains is not specifically limited, but in cases when using a spectral sensitizing dye exhibiting crystal habit (face) selectivity in the adsorption reaction of the sensitizing dye onto the silver halide grain surface, it is preferred to use silver halide grains having a relatively high proportion of the crystal habit meeting the selectivity. In cases when using a sensitizing dye selectively adsorbing onto the crystal face of a Miller index of [100], for example, a high ratio accounted for by a Miller index [100] face is preferred This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized.

It is preferred to use low molecular gelatin having an average molecular weight of not more than 50,000 in the preparation of silver halide grains used in the invention, specifically, in the stage of nucleation. Thus, the low molecular gelatin has an average molecular eight of not more than 50,000, preferably 2,000 to 40,000, and more preferably 5,000 to 25,000. The average molecular weight can be determined by means of gel permeation chromatography. The low molecular weight gelatin can be obtained by adding an enzyme to conventionally used gelatin having a molecular weight of ca. 100,000 to perform enzymatic degradation, by adding acid or alkali with heating to perform hydrolysis, by heating under atmospheric pressure or under high pressure to perform thermal degradation, or by exposure to ultrasonic.

The concentration of dispersion medium used in the nucleation stage is preferably not more than 5% by mass, and more preferably 0.05 to 3.0% by mass.

In the preparation of silver halide grains, it is preferred to use a compound represented by the following formula, specifically in the nucleation stage:

$$YO(CH_2CH_2O)_a(CH(CH_3)CH_2O)_c(CH_2CH_2O)_bY$$

where Y is a hydrogen atom, —$SO_3M$ or —CO—B—COOM, in which X is a hydrogen atom, alkali metal atom, ammonium group or ammonium group substituted by an alkyl group having carbon atoms of not more than 5, and B is a chained or cyclic group forming an organic dibasic acid; a and b each are 0 to 50; and c is 1 to 100. Polyethylene oxide compounds represented by foregoing formula have been employed as a defoaming agent to inhibit marked foaming occurred when stirring or moving emulsion raw materials, specifically in the stage of preparing an aqueous gelatin solution, adding a water-soluble silver and halide salts to the aqueous gelatin solution or coating an emulsion on a support during the process of preparing silver halide photographic light sensitive materials. A technique of using these compounds as a defoaming agent is described in JP-A No. 44-9497. The polyethylene oxide compound represented by the foregoing formula also functions as a defoaming agent during nucleation. The compound represented by the foregoing formula is used preferably in an amount of not more than 1%, and more preferably 0.01 to 0.1% by mass, based on silver.

The compound is to be present at the stage of nucleation, and may be added to a dispersing medium prior to or during nucleation. Alternatively, the compound may be added to an aqueous silver salt solution or halide solution used for nucleation. It is preferred to add it to a halide solution or both silver salt and halide solutions in an amount of 0.01 to 2.0% by mass. It is also preferred to make the compound represented by formula [5] present over a period of at least 50% (more preferably, at least 70%) of the nucleation stage.

The temperature during the stage of nucleation is preferably 5 to 60° C., and more preferably 15 to 50° C. Even when nucleation is conducted at a constant temperature, in a temperature-increasing pattern (e.g., in such a manner that nucleation starts at 25° C. and the temperature is gradually increased to reach 40° C. at the time of completion of nucleation) or its reverse pattern, it is preferred to control the temperature within the range described above.

Silver salt and halide salt solutions used for nucleation are preferably in a concentration of not more than 3.5 mol/l, and more preferably 0.01 to 2.5 mol/l. The flow rate of aqueous silver salt solution is preferably $1.5\times10^{-3}$ to $3.0\times10^{-1}$ mol/min per liter of the solution, and more preferably $3.0\times10^{-3}$ to $8.0\times10^{-2}$ mol/min. per liter of the solution. The pH during nucleation is within a range of 1.7 to 10, and since the pH at the alkaline side broadens the grain size distribution, the pH is preferably 2 to 6. The pBr during nucleation is 0.05 to 3.0, preferably 1.0 to 2.5, and more preferably 1.5 to 2.0. The average grain size of silver halide of the invention is preferably 10 to 50 nm, more preferably 10 to 40 nm, and still more preferably 10 to 35 nm. An average grain size of less than 10 nm often lowers the image density or deteriorated storage stability under light exposure (aging stability when images obtained in thermal development is used for diagnosis under room light or aged under ambient light). An average grain size of more than 50 nm results in lowered image density.

In the invention, the grain size refers to an edge length of the grain in the case of regular grains such as cubic or octahedral grains. In the case of tabular grains, the grain size refers to a diameter of a circle equivalent to the projected area of the major face. In the case of irregular grains, such as spherical grains or bar-like grains, the diameter of a sphere having the same volume as the grain is defined as the grain size. Measurement is made using an electron microscope and grain size values of at least 300 grains are average and defined as an average grain size.

The combined use of silver halide grains having an average grain size of 55 to 100 nm and silver halide grains having an average grain size of 10 to 50 nm not only can control the gradation of image density but also can enhance the image density or improve (or reduce) lowering in image density during storage. The ratio (by weight) of silver halide grains having an average grain size of 10 to 50 nm to silver halide grains having an average grain size of 55 to 100 nm is preferably from 95:5 to 50:50, and more preferably -form from 90:10 to 60:40.

When two silver halide emulsions differing in average grain size are used in combination, these emulsions may be blended and incorporated to the light-sensitive layer. To make adjustment of gradation, the light-sensitive layer divided to at least two layers and two silver halide emulsions differing in average grain size are contained in the respective layers.

Iodide containing silver halide grains are preferably used as silver halide grains used in the invention. With respect to halide composition, silver halide grains of the invention preferably have an iodide content of 5 to 10 mol % (more preferably 40 to 100 mol %, still more preferably 70 to 100 mol %). In the foregoing iodide content range, the halide composition within the grain may be homogeneous, or stepwise or continuously varied. Silver halide grains of a core/shell structure, exhibiting a higher iodide content in the interior and/or on the surface are preferably used. The structure is preferably 2-fold to 5-fold structure and core/shell grains having the 2-fold to 4-fold structure are more preferred.

Introduction of silver iodide into silver halide can be achieved by addition of an aqueous alkali iodide solution in the course of grain formation, addition of fine grains such as particulate silver iodide, particulate silver iodobromide, particulate silver iodochloride or silver iodochlorobromide, or addition of an iodide ion-releasing agent as described in JP-A Nos. 5-323487 and 6-11780. The silver halide usable in the invention preferably exhibits a direct transition absorption attributed to the silver iodide crystal structure within the wavelength region of 350 to 440 nm. The direct transition absorption of silver halide can be readily distinguished by observation of an exciton absorption in the range of 400 to 430 nm, due to the direct transition.

Light-sensitive silver halide grains usable in the invention are preferably those which are capable of being converted from a surface image forming type to an internal image forming type upon thermal development, resulting in reduced surface sensitivity (that is, thermally convertible internal latent image forming silver halide grains). Thus, the silver halide grains form latent images capable of acting as a catalyst in development (or reduction reaction of silver ions by a reducing agent) upon exposure to light prior to thermal development on the silver halide grain surface, and upon exposure after completion of thermal development, images are formed preferentially in the interior of the grains (i.e., internal latent image formation), thereby suppressing latent image formation on the grain surface. There has been known the use of silver halide grains capable of varying the latent image forming function before and after thermal development in photothermographic materials.

In general, when exposed to light, light-sensitive silver halide grains or spectral sensitizing dyes adsorbed onto the surfaces of the silver halide grains are photo-excited to form free electrons. The thus formed electrons are trapped competitively by electron traps on the grain surface (sensitivity center) and internal electron traps existing in the interior of the grains. In cases when chemical sensitization centers (chemical sensitization nuclei) or dopants useful as a electron trap exist more on the surface than the interior of the grain, latent images are more predominantly on the surface than in the interior of the grain, rendering the grains developable. On the contrary, the chemical sensitization centers or dopants useful as electron traps, which exist more in the interior than the surface of the grains form latent images preferentially in the interior rather than the surface of the grains, rendering the grain undevelopable. Alternatively, it can be said that, in the former case, the grain surface has higher sensitivity than the interior; in the latter case, the surface has lower sensitivity than the interior. The foregoing is detailed, for example, in T. H. James, The Theory of the Photographic Process, 4th Ed. (Macmillan Publishing Co., Ltd., 1977 and Nippon Shashin Gakai Ed., "Shashin Kogaku no Kiso (Gin-ene Shashin)" (Corona Co., Ltd., 1998).

In one preferred embodiment of the invention, light-sensitive silver halide grains each contain a dopant capable of functioning as an electron-trapping dopant when exposed to light after thermal development inside the grains, resulting in enhanced sensitivity and improved image storage stability. The dopant is more preferably one which is capable of functioning as a hole trap when exposed prior to thermal development and which is also capable of functioning as an electron trap after subjected to thermal development.

The electron trapping dopant is an element or compound, except for silver and halogen forming silver halide, referring to one having a property of trapping free electrons or one whose occlusion within the grain causes a site such as an electron-trapping lattice imperfection. Examples thereof include metal ions except for silver and their salts or complexes; chalcogen (elements of the oxygen group) such as sulfur, selenium and tellurium; chalcogen or nitrogen containing organic or inorganic compounds; and rare earth ions or their complexes.

Examples of the metal ions and their salts or complexes include a lead ion, bismuth ion and gold ion; lead bromide, lead carbonate, lead sulfate, bismuth nitrate, bismuth chloride, bismuth trichloride, bismuth carbonate, sodium bismuthate, chloroauric acid, lead acetate, lead stearate and bismuth and acetate.

Compounds containing chalcogen such as sulfur, selenium or tellurium include various chalcogen-releasing compounds, which are known, in the photographic art, as a chalcogen sensitizer. The chalcogen or nitrogen-containing organic compounds are preferably heterocyclic compounds. Examples thereof include imidazole, pyrazole, pyridine, pyrimidine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, benzthiazole, indolenine, and tetrazaindene; preferred of these are imidazole, pyridine, pyrazine, pyridazine, triazole, triazine, thiadiazole, oxadiazole, quinoline, phthalazine, naphthyridine, quinoxaline, quinazoline, cinnoline, tetrazole, thiazole, oxazole, benzimidazole, benzoxazole, benzthiazole, and tetrazaindene. The foregoing heterocyclic compounds may be substituted with substituents. Examples of substituents include an alkyl group, alkenyl group, aryl group, alkoxy group, aryloxy group, acyloxy group, acyl group, alkoxycarbonyl group, aryloxycarbonyl group, acyloxy group, acylamino group, alkoxycarbonylamino group, aryloxycarbonylamino group, sulfonylamino group, sulfamoyl group, carbamoyl group, sulfonyl group, ureido group, phosphoric acid amido group, halogen atoms, cyano group, sulfo group, carboxyl group, nitro group, and heterocyclic group; of these, an alkyl group, aryl group, alkoxy group, aryloxy group, acyl group, acylamino group, alkoxycarbonylamino group, sulfonylamino group, sulfamoyl group, carbamoyl group, sulfonyl group, ureido group, phosphoric acid amide group, halogen atoms, cyano group, nitro group and heterocyclic group are preferred; and an alkyl group, aryl group, alkoxy group, aryloxy group, acyl group, acylamino group, sulfonylamino group, sulfamoyl group, carbamoyl group, halogen atoms, cyano group, nitro group, and heterocyclic group are more preferred.

In one embodiment of the invention, silver halide grains used in the invention occlude transition metal ions selected from groups 6 to 11 inclusive of the periodic table of elements whose oxidation state is chemically prepared in combination with ligands so as to function as an electron-trapping dopant and/or a hole-trapping dopant. Preferred transition metals include W, Fe, Co, Ni, Cu, Ru, Rh, Pd, Re, Os, Ir and Pt. The foregoing transition metal is doped within the interior of the grains, preferably within the interior region of 0% to 99% of the grain volume (more preferably 0% to 50% of the grain volume). The interior region of 0% to 99% of the grain volume refers to the central portion of the grains in an interior region surrounding 99% of the total silver forming the grains.

The foregoing dopants may be used alone or in combination thereof, provided that at least one of the dopants needs to act as an electron-trapping dopant when exposed after being subjected to thermal development. The dopants can be introduced, in any chemical form, into silver halide grains. The dopant content is preferably $1\times10^{-9}$ to $1\times10$ mol, more preferably $1\times10^{-8}$ to $1\times10^{-1}$ mol, and still more preferably $1\times10^{-6}$ to $1\times10^{-2}$ mol per mol of silver. The optimum content, depending on the kind of the dopant, grain size or form of silver halide grains and other environmental conditions, can be optimized in accordance with the foregoing conditions.

In the invention, transition metal complexes or their ions, represented by the general formula described below are preferred:

$(ML_6)^m$: Formula:

wherein M represents a transition metal selected from elements in Groups 6 to 11 of the Periodic Table; L represents a coordinating ligand; and m represents 0, 1-, 2-, 3- or 4-. M is selected preferably from W, Fe, Co, Ni, Cu, Ru, Rh, Pd, Re, Os, Ir and Pt. Exemplary examples of the ligand represented by L include halides (fluoride, chloride, bromide, and iodide), cyanide, cyanato, thiocyanato, selenocyanato, tellurocyanato, azido and aquo, nitrosyl, thionitrosyl, etc., of which aquo, nitrosyl and thionitrosyl are preferred. When the aquo ligand is present, one or two ligands are preferably coordinated. L may be the same or different.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation. These compounds may be added several times by dividing the added amount. Uniform content in the interior of a silver halide grain can be carried out. As disclosed in JP-A No. 63-29603, 2-306236, 3-167545, 4-76534, 6-110146, 5-273683, the metal can be non-uniformly occluded in the interior of the grain.

These metal compounds can be dissolved in water or a suitable organic solvent (e.g., alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening. Non-metallic dopants can also be introduced in a manner similar to the foregoing metallic dopants.

Whether a dopant has an electron-trapping property in the photothermographic material relating to the invention can be evaluated according to the following manner known in the photographic art. A silver halide emulsion comprising silver halide grains doped with a dopant is subjected to microwave photoconductometry to measure photoconductivity. Thus, the doped emulsion can be evaluated with respect to a decreasing rate of photoconductivity on the basis of a silver halide emulsion containing no dopant. Evaluation can also be made based on comparison of internal sensitivity and surface sensitivity.

A photothermographic dry imaging material relating to the invention can be evaluated with respect to effect of an electron trapping dopant, for example, in the following manner. The photothermographic material, prior to exposure, is heated under the same condition as usual thermal developing conditions and then exposed through an optical wedge to white light or light in the specific spectral sensitization region (for example, in the case when spectrally sensitized for a laser, light falling within such a wavelength region, in the case when infrared-sensitized, an infrared light and in the case when sensitized to light in the region of intrinsic sensitivity of silver halide grains, for example, a blue region, a blue light) for a period of a given time and then thermally developed under the same condition as above. The thus processed photothermographic material is further subjected to densitometry with respect to developed silver image to prepare a characteristic curve comprising an abscissa of exposure and an ordinate of silver density and based thereon, sensitivity is determined. The obtained sensitivity is compared for evaluation with that of a photothermographic material using silver halide emulsion grains not containing an electron trapping dopant. Thus, it is necessary to confirm that the sensitivity of the photothermographic material containing the dopant is lower than that of the photothermographic material not containing the dopant.

A photothermographic material is exposed through an optical wedge to white light or a light within the specific spectral sensitization region for a given time and thermally developed under usual practical thermal development conditions (e.g., 123° C., 10 seconds) and the sensitivity obtained based on the characteristic curve is designated as $S_1$. Separately, the photothermographic material, prior to exposure, is heated under the practical thermal development conditions (e.g., 123° C., 10 seconds) and further exposed to light and thermally developed similarly to the foregoing and the sensitivity obtained based on the characteristic curve is designated as $S_2$. The ratio of $S_2/S_1$ of the photothermographic material related to the invention is preferably not less than 0 and not more than 1/10 (more preferably not more than 1/20, and still more preferably not more than 1/50). In cases when not subjected to chemical sensitization or even when subjected to chemical sensitization, it is specifically preferred that the surface sensitivity after subjected to thermal development is substantially zero.

To be more specific, the foregoing characteristics can be evaluated in the following manner. For instance, the photothermographic material is subjected to a heat treatment at a temperature of 123° C. for a period of 10 sec., followed by being exposed to white light (e.g., light at 4874K) or infrared light through an optical wedge for a prescribed period of time (within the range of 0.01 sec. to 30 min., e.g., 30 sec. using a tungsten light source) and being thermally developed at a temperature of 123° C. for a period of 10 sec. The thus processed photothermographic material is further subjected to densitometry with respect to developed silver image to prepare a characteristic curve comprising an abscissa of exposure and an ordinate of silver density and based thereon, sensitivity is determined, which is designated as $S_2$. Separately, the photothermographic material is exposed and thermally developed in the same manner as above, without being subjected to the heat treatment to determine sensitivity, which is designated $S_1$. The sensitivity is defined as the reciprocal of an exposure amount giving a density of a minimum density (or a density of the unexposed area) plus 1.0.

Silver halide may be incorporated into a light-sensitive layer by any means. It is general that silver halide grains (e.g., thermally convertible internal latent image type silver halide grains), which have been prepared in advance, added to a solution used for preparing an organic silver salt. In this case, preparation of silver halide and that of an organic silver salt are separately performed, making it easier to control the preparation thereof. Alternatively, silver halide grains and aliphatic carboxylic acid silver salt grains are separately prepared and immediately before coating, each of them may be added to a solution for the light-sensitive layer.

Silver halide grain emulsions used in the invention may be desalted after the grain formation, using the methods known in the art, such as the noodle washing method and flocculation process.

The silver halide is used preferably in an amount of 0.001 to 0.7 mol, and more preferably 0.03 to 0.5 mol per mol of organic silver salt.

Silver halide grains used in the invention can be subjected to chemical sensitization. In accordance with methods described in JP-A Nos. 2001-249428 and 2001-249426, for example, a chemical sensitization center (chemical sensitization speck) can be formed using compounds capable of releasing chalcogen such as sulfur or noble metal compounds capable of releasing a noble metal ion such as a gold ion. In the invention, it is preferred to conduct chemical sensitization with an organic sensitizer containing a chalcogen atom, as described below. Such a chalcogen atom-containing organic sensitizer is preferably a compound containing a group capable of being adsorbed onto silver halide and a labile chalcogen atom site. These organic sensitizers include, for example, those having various structures, as described in JP-A Nos. 60-150046, 4-109240 and 11-218874. Specifically preferred of these is at least a compound having a structure in which a chalcogen atom is attacked to a carbon or phosphorus atom through a double-bond. Specifically, heterocycle-containing thiourea derivatives and triphenylphosphine sulfide derivatives are preferred. A variety of techniques for chemical sensitization employed in silver halide photographic material for use in wet processing are applicable to conduct chemical sensitization, as described, for example, in T. H. James, The Theory of the Photographic Process, 4th Ed. (Macmillan Publishing Co., Ltd., 1977 and Nippon Shashin Gakai Ed., "Shashin Kogaku no Kiso (Gin-ene Shashin)" (Corona Co., Ltd., 1998). The amount of a chalcogen compound added as an organic sensitizer is variable, depending on the chalcogen compound to be used, silver halide grains and a reaction environment when subjected to chemical sensitization and is preferably $10^{-8}$ to $10^{-2}$ mol, and more preferably $10^{-7}$ to $10^{-3}$ mol per mol of silver halide. In the invention, the chemical sensitization environment is not specifically limited but it is preferred to conduct chemical sensitization in the presence of a compound capable of eliminating a silver chalcogenide or silver specks formed on the silver halide grain or reducing the size thereof, or specifically in the presence of an oxidizing agent capable of oxidizing the silver specks, using a chalcogen atom-containing organic sensitizer. To conduct chemical sensitization under preferred conditions, the pAg is preferably 6 to 11, and more preferably 7 to 10, the pH is preferably 4 to 10 and more preferably 5 to 8, and the temperature is preferably not more than 3° C.

Chemical sensitization using the foregoing organic sensitizer is also preferably conducted in the presence of a spectral sensitizing dye or a heteroatom-containing compound capable of being adsorbed onto silver halide grains. Thus, chemical sensitization in the present of such a silver halide-adsorptive compound results in prevention of dispersion of chemical sensitization center specks, thereby achieving enhanced sensitivity and minimized fogging. Although there will be described spectral sensitizing dyes used in the invention, preferred examples of the silver halide-adsorptive, heteroatom-containing compound include nitrogen containing heterocyclic compounds described in JP-A No. 3-24537. In the heteroatom-containing compound, examples of the heterocyclic ring include a pyrazolo ring, pyrimidine ring, 1,2, 4-triazole ring, 1,2,3-triazole ring, 1,3,4-thiazole ring, 1,2,3-thiadiazole ring, 1,2,4-thiadiazole ring, 1,2,5-thiadiazole ring, 1,2,3,4-tetrazole ring, pyridazine ring, 1,2,3-triazine ring, and a condensed ring of two or three of these rings, such as triazolotriazole ring, diazaindene ring, triazaindene ring and pentazaindene ring. Condensed heterocyclic ring comprised of a monocyclic hetero-ring and an aromatic ring include, for example, a phthalazine ring, benzimidazole ring indazole ring, and benzthiazole ring. Of these, an azaindene ring is preferred and hydroxy-substituted azaindene compounds, such as hydroxytriazaindene, tetrahydroxyazaindene and hydroxypentazaundene compound are more preferred. The heterocyclic ring may be substituted by substituent groups other than hydroxy group. Examples of the substituent group include an alkyl group, substituted alkyl group, alkylthio group, amino group, hydroxyamino group, alkylamino group, dialkylamino group, arylamino group, carboxy group, alkoxycarbonyl group, halogen atom and cyano group. The amount of the heterocyclic ring containing compound to be added, which is broadly variable with the size or composition of silver halide grains, is within the range of $10^{-6}$ to 1 mol, and preferably $10^{-4}$ to $10^{-1}$ mol per mol silver halide.

As described earlier, silver halide grains can be subjected to noble metal sensitization using compounds capable of releasing noble metal ions such as a gold ion. Examples of usable gold sensitizers include chloroaurates and organic gold compounds. In addition to the foregoing sensitization, reduction sensitization can also be employed and exemplary compounds for reduction sensitization include ascorbic acid, thiourea dioxide, stannous chloride, hydrazine derivatives, borane compounds, silane compounds and polyamine compounds. Reduction sensitization can also conducted by ripening the emulsion while maintaining the pH at not less than 7 or the pAg at not more than 8.3. Silver halide to be subjected to chemical sensitization may be one which has been prepared in the presence of an organic silver salt, one which has been formed under the condition in the absence of the organic silver salt, or a mixture thereof.

When the surface of silver halide grains is subjected to chemical sensitization, it is preferred that an effect of the chemical sensitization substantially disappears after subjected to thermal development. An effect of chemical sensitization substantially disappearing means that the sensitivity of the photothermographic material, obtained by the foregoing chemical sensitization is reduced, after thermal development, to not more than 1.1 times that of the case not having been subjected to chemical sensitization. To allow the effect of chemical sensitization to disappear, it is preferred to allow an oxidizing agent such as a halogen radical-releasing compound which is capable of decomposing a chemical sensitization center (or chemical sensitization nucleus) through an oxidation reaction to be contained in an optimum amount in the light-sensitive layer and/or the light-insensitive layer. The content of an oxidizing agent is adjusted in light of oxidizing strength of an oxidizing agent and chemical sensitization effects.

Spectral Sensitization

The light-sensitive silver halide usable in the invention is preferably spectrally sensitized by adsorption of spectral sensitizing dyes. Examples of the spectral sensitizing dye include cyanine, merocyanine, complex cyanine, complex merocyanine, holo-polar cyanine, styryl, hemicyanine, oxonol and hemioxonol dyes, as described in JP-A Nos. 63-159841, 60-140335, 63-231437, 63-259651, 63-304242, 63-15245; U.S. Pat. Nos. 4,639,414, 4,740,455, 4,741,966, 4,751,175 and 4,835,096. Usable sensitizing dyes are also described in Research Disclosure (hereinafter, also denoted as RD) 17643, page 23, sect. IV-A (December, 1978), and ibid 18431, page 437, sect. X (August, 1978). It is preferred to use sensitizing dyes exhibiting spectral sensitivity suitable for spectral characteristics of light sources of various laser imagers or scanners. Examples thereof include compounds described in JP-A Nos. 9-34078, 9-54409 and 9-80679.

Useful cyanine dyes include, for example, cyanine dyes containing a basic nucleus, such as thiazoline, oxazoline, pyrroline, pyridine, oxazole, thiazole, selenazole and imidazole nuclei. Useful merocyanine dyes preferably contain, in addition to the foregoing nucleus, an acidic nucleus such as thiohydantoin, rhodanine, oxazolidine-dione, thiazoline-dione, barbituric acid, thiazolinone, malononitrile and pyrazolone nuclei. In the invention, there are also preferably used sensitizing dyes having spectral sensitivity within the infrared region. Examples of the preferred infrared sensitizing dye include those described in U.S. Pat. Nos. 4,536,478, 4,515,888 and 4,959,294.

A photothermographic material used in the invention preferably contains at least one of sensitizing dyes represented by formula (1) and sensitizing dyes represented by formula (2), as disclosed in U.S. Patent Application publication No. 20040224266, and more preferably at least one of sensitizing dyes represented by formula (5) and sensitizing dyes represented by formula (6). The combined use of sensitizing dyes represented by formula (5) and sensitizing dyes represented by formula (6) results in improved dependency on the wavelength of exposing light at the time of exposure.

The infrared sensitizing dyes and spectral sensitizing dyes described above can be readily synthesized according to the methods described in F. M. Hammer, The Chemistry of Heterocyclic Compounds vol. 18, "The Cyanine Dyes and Related Compounds" (A. Weissberger ed. Interscience Corp., New York, 1964).

The infrared sensitizing dyes can be added at any time after preparation of silver halide. For example, the dye can be added to a light sensitive emulsion containing silver halide grains/organic silver salt grains in the form of by dissolution in a solvent or in the form of a fine particle dispersion, so-called solid particle dispersion. Similarly to the heteroatom containing compound having adsorptivity to silver halide, after adding the dye prior to chemical sensitization and allowing it to be adsorbed onto silver halide grains, chemical sensitization is conducted, thereby preventing dispersion of chemical sensitization center specks and achieving enhanced sensitivity and minimized fogging.

These sensitizing dyes may be used alone or in combination thereof. The combined use of sensitizing dyes is often employed for the purpose of supersensitization, expansion or adjustment of the light-sensitive wavelength region. A supersensitizing compound, such as a dye which does not exhibit spectral sensitization or substance which does not substantially absorb visible light may be incorporated, in combination with a sensitizing dye, into the emulsion containing silver halide grains and organic silver salt grains used in photothermographic imaging materials of the invention.

Useful sensitizing dyes, dye combinations exhibiting super-sensitization and materials exhibiting supersensitization are described in RD17643 (published in December, 1978), IV-J at page 23, JP-B 9-25500 and 43-4933 (herein, the term, JP-B means published Japanese Patent) and JP-A 59-19032, 59-192242 and 5-341432. In the invention, an aromatic heterocyclic mercapto compound represented by the following formula (6) is preferred as a supersensitizer:

Ar—SM wherein M is a hydrogen atom or an alkali metal atom; Ar is an aromatic ring or condensed aromatic ring containing a nitrogen atom, oxygen atom, sulfur atom, selenium atom or tellurium atom. Such aromatic heterocyclic rings are preferably benzimidazole, naphthoimidazole, benzthiazole, naphthothiazole, benzoxazole, naphthooxazole, benzoselenazole, benzotellurazole, imidazole, oxazole, pyrazole, triazole, triazines, pyrimidine, pyridazine, pyrazine, pyridine, purine, and quinoline. Other aromatic heterocyclic rings may also be included.

A disulfide compound which is capable of forming a mercapto compound when incorporated into a dispersion of an organic silver salt and/or a silver halide grain emulsion is also included in the invention. In particular, a preferred example thereof is a disulfide compound represented by the following formula:

Ar—S—S—Ar wherein Ar is the same as defined in the mercapto compound represented by the formula described earlier.

The aromatic heterocyclic rings described above may be substituted with a halogen atom (e.g., Cl, Br, I), a hydroxy group, an amino group, a carboxy group, an alkyl group (having one or more carbon atoms, and preferably 1 1 to 4 carbon atoms) or an alkoxy group (having one or more carbon atoms, and preferably 1 1 to 4 carbon atoms). In addition to the foregoing supersensitizers, there are usable heteroatom-containing macrocyclic compounds described in JP-A No. 2001-330918, as a supersensitizer. The supersensitizer is incorporated into a light-sensitive layer containing organic silver salt and silver halide grains, preferably in an amount of 0.001 to 1.0 mol, and more preferably 0.01 to 0.5 mol per mol of silver.

It is preferred that a sensitizing dye is allowed to adsorb onto the surface of light-sensitive silver halide grains to achieve spectral sensitization and the spectral sensitization effect substantially disappears after being subjected to thermal development. The effect of spectral sensitization substantially disappearing means that the sensitivity of the photothermographic material which has been spectrally sensitized with a sensitizing dye and optionally a supersensitizer, is reduced, after thermal development, to not more than 1.1 times that of the photothermographic material which has not been spectrally sensitized. To allow the effect of spectral sensitization to disappear, it is preferred to use a spectral sensitizing dye easily releasable from silver halide grains and/or to allow an oxidizing agent such as a halogen radical-releasing compound which is capable of decomposing a spectral sensitizing dye through an oxidation reaction to be contained in an optimum amount in the light-sensitive layer and/or the light-insensitive layer. The content of an oxidizing agent is adjusted in light of oxidizing strength of the oxidizing agent and its spectral sensitization effects.

Reducing Agent

Reducing agents used in the invention are those which can reduce silver ions in the light-sensitive layer, are also called a developer or a developing agent. A reducing agent usable in the invention is preferably a compound represented by the following formula (RD1) or its combined use with other reducing agents of different chemical formulas:

formula (RD1)

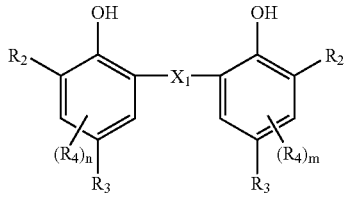

wherein $X_1$ is a chalcogen atom or $CHR_1$ in which $R_1$ is a hydrogen atom, a halogen atom, an alkyl group, an alkenyl group, an aryl group or a heterocyclic group; $R_2$ is an alkyl group, provided that both $R_2$s may be the same or different and at least one of them is a secondary or tertiary alkyl group; $R_3$ is a hydrogen atom or a group capable of being substituted on a benzene ring; $R_4$ is a group capable of being substituted on a benzene ring; m and n are each an integer of 0 to 2.

In the invention, to control thermal development characteristics, the compound of formula (RD1) can also be used in combination with a compound represented by the following formula (RD2):

formula (RD2)

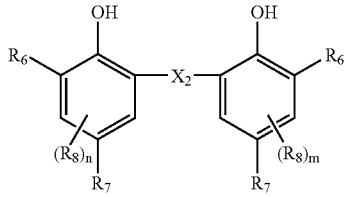

wherein $X_2$ represents a chalcogen atom or $CHR_5$ in which $R_5$ is a hydrogen atom, a halogen atom, an alkyl group, an alkenyl group, an aryl group or a heterocyclic group; both $R_6$s are alkyl groups, which may be the same or different, provided that $R_6$ is not a secondary or tertiary alkyl group; $R_7$ is a hydrogen atom or a group capable of being substituted on a benzene ring; $R_8$ is a group capable of being substituted on a benzene ring; m and n are each an integer of 0 to 2.

The mass ratio of [compound of formula (RD1)]: [compound of formula (RD2)] is preferably from 5:95 to 45:55, and more preferably from 10:90 to 40:60.

In the foregoing formula (RD1), $X_1$ represents a chalcogen atom or $CHR_1$. Specifically, the chalcogen atom is a sulfur atom, a selenium atom, or a tellurium atom. Of these, a sulfur atom is preferred; $R_1$ in $CHR_1$ represents a hydrogen atom, a halogen atom, an alkyl group, an alkenyl group, an alkynyl group, an aryl group or a heterocyclic group. Halogen atoms include, for example, a fluorine atom, a chlorine atom, and a bromine atom. Alkyl groups are an alkyl groups having 1-20 carbon atoms and specific examples thereof include a methyl group, an ethyl group, a propyl group, a butyl group, a hexyl group, a heptyl group and a cycloalkyl group. Examples of alkenyl groups are, a vinyl group, an allyl group, a butenyl group, a hexenyl group, a hexadienyl group, an ethenyl-2-propenyl group, a 3-butenyl group, a 1-methyl-3-propenyl group, a 3-pentenyl group, a 1-methyl-3-butenyl group and a cyclohexenyl group. Examples of aryl groups are, a phenyl group and a naphthyl group. Examples of heterocyclic groups are, a thienyl group, a furyl group, an imidazolyl group, a pyrazolyl group and a pyrrolyl group.

These groups may have a substituent. Listed as the substituents are a halogen atom (for example, a fluorine atom, a chlorine atom, or a bromine atom), a cycloalkyl group (for example, a cyclohexyl group or a cyclobutyl group), a cycloalkenyl group (for example, a 1-cycloalkenyl group or a 2-cycloalkenyl group), an alkoxy group (for example, a methoxy group, an ethoxy group, or a propoxy group), an alkylcarbonyloxy group (for example, an acetyloxy group), an alkylthio group (for example, a methylthio group or a trifluoromethylthio group), a carboxyl group, an alkylcarbonylamino group (for example, an acetylamino group), a ureido group (for example, a methylaminocarbonylamino group), an alkylsulfonylamino group (for example, a methanesulfonylamino group), an alkylsulfonyl group (for example, a methanesulfonyl group and a trifluoromethanesulfonyl group), a carbamoyl group (for example, a carbamoyl group, an N,N-dimethylcarbamoyl group, or an N-morpholinocarbonyl group), a sulfamoyl group (for example, a sulfamoyl group, an N,N-dimethylsulfamoyl group, or a morpholinosulfamoyl group), a trifluoromethyl group, a hydroxyl group, a nitro group, a cyano group, an alkylsulfonamide group (for example, a methanesulfonamide group or a butanesulfonamide group), an alkylamino group (for example, an amino group, an N,N-dimethylamino group, or an N,N-diethylamino group), a sulfo group, a phosphono group, a sulfite group, a sulfino group, an alkylsulfonylaminocarbonyl group (for example, a methanesulfonylaminocarbonyl group or an ethanesulfonylaminocarbonyl group), an alkylcarbonylaminosulfonyl group (for example, an acetamidosulfonyl group or a methoxyacetamidosulfonyl group), an alkynylaminocarbonyl group (for example, an acetamidocarbonyl group or a methoxyacetamidocarbonyl group), and an alkylsulfinylaminocarbonyl group (for example, a methanesulfinylaminocarbonyl group or an ethanesulfinylaminocarbonyl group). Further, when at least two substituents are present, they may be the same or different. Most preferred substituent is an alkyl group.

In the formula (RD1), both $R_2$s are alkyl groups, which may be the same or different and at least one of the alkyl groups is a secondary or tertiary alkyl group. The alkyl groups are preferably those having 1 to 20 carbon atoms, which may be substituted or unsubstituted. Specific examples thereof include methyl, ethyl, i-propyl, butyl, i-butyl, t-butyl, t-pentyl, t-octyl, cyclohexyl, 1-methylcyclohexyl, or 1-methylcyclopropyl.

The alkyl groups each may be substituted. Substituents of the alkyl groups are not particularly limited and include, for example, an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group, and a halogen atom. In addition, $(R_4)_n$ and $(R_4)_m$ may form a saturated ring. Both $R_2$s are preferably a secondary or tertiary alkyl group and preferably has 2-20 carbon atoms, more preferably a tertiary alkyl group, still more preferably a t-butyl group, a t-amyl group, a t-pentyl group, or a 1-methylcyclohexyl group, and further still more preferably a t-butyl group or t-amyl.

$R_3$ represents a hydrogen atom or a group capable of being substituted to a benzene ring. Listed as groups capable of being substituted to a benzene ring are, for example, a halogen atom such as fluorine, chlorine, or bromine, an alkyl group, an aryl group, a cycloalkyl group, an alkenyl group, a cycloalkenyl group, an alkynyl group, an amino group, an acyl group, an acyloxy group, an acylamino group, a sulfonylamino group, a sulfamoyl group, a carbamoyl group, an alkylthio group, a sulfonyl group, an alkylsulfonyl group, a sulfonyl group, a cyano group, and a heterocyclic group. $R_3$ is preferably methyl, ethyl, i-propyl, t-butyl, cyclohexyl, 1-methylcyclohexyl, or 2-hydroxyethyl. Of these, 2-hydroxyethyl is more preferred.

The foregoing groups may be substituted and examples of substituent are those as cited in the foregoing $R_1$.

In the formula (RD1), both $R_3$s are alkyl groups, which may be the same or different, and at least one of the alkyl groups is an alkyl group having 1 to 20 carbon atoms and containing a hydroxyl group as a substituent or an alkyl group having 1 to 20 carbon atoms and containing, as a substituent, a group capable of forming a hydroxyl group upon deprotection, and preferably an alkyl group having 3 to 10 carbon atoms and containing a hydroxyl group or an alkyl group having 3 to 10 carbon atoms and containing a group capable of forming a hydroxyl group upon deprotection. An alkyl group having carbon atoms falling within the foregoing range can obtain an image exhibiting an average gradation of 1.8-6.0, which is suitable for diagnosis. $R_3$ is more preferably an alkyl group having 3 to 5 carbon atoms and containing a hydroxyl group. Specific examples of $R_3$ include 3-hydroxypropyl, 4-hydroxybutyl and 5-hydroxypentyl. These groups may be substituted and examples of a substituent are the same as cited in $R_1$.

The group capable of forming a hydroxyl group upon deprotection is a group which is a so-called protected hydroxyl group and is capable of being easily cleaved (or performing deprotection) by the action of acids and/or heat to form a hydroxyl group. Hereinafter, the group capable of forming a hydroxyl group upon deprotection is also called a precursor group of a hydroxyl group. Specific examples thereof include an ether group (e.g., methoxy, tert-butoxy, allyloxy, benzoyloxy, triphenylmethoxy, trimethylsilyloxy), a hemiacetal group (e.g., tetrahydropyranyloxy), an ester group (e.g., acetyloxy, benzoyloxy, p-nitrobenzoyloxy, formyloxy, trifluoroacetyloxy, pivaloyloxy), a carbonate group (e.g., ethoxycarbonyloxy, phenoxycarbonyloxy, tert-butyloxycarbonyloxy), a sulfonate group (e.g., p-toluenesulfonyloxy, benzenesulfonyloxy), a carbamoyloxy group (e.g., phenylcarbamoyloxy), a thiocarbonyloxy group (e.g., benzylthiocarbonyloxy), a nitric acid ester group, and a sulphenato group (e.g., 2,4-dinitrobenzenesulphenyloxy).

Specifically preferably, $R_3$ is a primary alkyl group of 3 to 5 carbon atoms which contains a hydroxyl group or its precursor group, for example, 3-hydroxypropyl. A specifically preferred combination of $R_2$ and $R_3$ is that $R_2$ is a tertiary alkyl group (for example, t-butyl, t-amyl, t-pentyl, 1-methylcyclohexyl) and $R_3$ is a primary alkyl group of 3 to 10 carbon atoms, containing a hydroxyl group or its precursor group (for example, 3-hydroxypropyl, 4-hydroxtbutyl). Plural $R_2$s or $R_3$s may be the same or different.

$R_4$ represents a group capable of being substituted on a benzene ring. Specific examples include an alkyl group having 1 to 25 carbon atoms (e.g., methyl, ethyl, propyl, i-propyl, t-butyl, pentyl, hexyl, or cyclohexyl), a halogenated alkyl group (e.g., trifluoromethyl or perfluorooctyl), a cycloalkyl group (e.g., cyclohexyl or cyclopentyl); an alkynyl group (e.g., propargyl), a glycidyl group, an acrylate group, a methacrylate group, an aryl group (e.g., phenyl), a heterocyclic group (e.g., pyridyl, thiazolyl, oxazolyl, imidazolyl, furyl, pyrrolyl, pyradinyl, pyrimidyl, pyridadinyl, selenazolyl, piperidinyl, sulforanyl, piperidinyl, pyrazolyl, or tetrazolyl), a halogen atom (e.g., chlorine, bromine, iodine or fluorine), an alkoxy group (e.g., methoxy, ethoxy, propyloxy, pentyloxy, cyclopentyloxy, hexyloxy, or cyclohexyloxy), an aryloxy group (e.g., phenoxy), an alkoxycarbonyl group (e.g., methyloxycarbonyl, ethyloxycarbonyl, or butyloxycarbonyl), an aryloxycarbonyl group (e.g., phenyloxycarbonyl), a sulfonamido group (e.g., methanesulfonamido, ethanesulfonamido, butanesulfonamido, hexanesulfonamido, cyclohexabesulfonamido, benzenesulfonamido), sulfamoyl group (e.g., aminosulfonyl, methyaminosulfonyl, dimethylaminosulfonyl, butylaminosulfonyl, hexylaminosulfonyl, cyclohexylaminosufonyl, phenylaminosulfonyl, or 2-pyridylaminosulfonyl), a urethane group (e.g., methylureido, ethylureido, pentylureido, cyclopentylureido, phenylureido, or 2-pyridylureido), an acyl group (e.g., acetyl, propionyl, butanoyl, hexanoyl, cyclohexanoyl, benzoyl, or pyridinoyl), a carbamoyl group (e.g., aminocarbonyl, methylaminocarbonyl, dimethylaminocarbonyl, propylaminocarbonyl, a pentylaminocarbonyl group, cyclohexylaminocarbonyl, phenylaminocarbonyl, or 2-pyridylaminocarbonyl), an amido group (e.g., acetamide, propionamide, butaneamide, hexaneamide, or benzamide), a sulfonyl group (e.g., methylsulfonyl, ethylsulfonyl, butylsulfonyl, cyclohexylsulfonyl, phenylsulfonyl, or 2-pyridylsulfonyl), an amino group (e.g., amino, ethylamino, dimethylamino, butylamino, cyclopentylamino, anilino, or 2-pyridylamino), a cyano group, a nitro group, a sulfo group, a carboxyl group, a hydroxyl group, and an oxamoyl group. Further, these groups may further be substituted with these groups. Each of n and m represents an integer of from 0 to 2. However, the most preferred case is that both n and m are 0. Further, $R_4$ may form a saturated ring together with $R_2$ and $R_3$. $R_4$ is preferably a hydrogen atom, a halogen atom, or an alkyl group, and is more preferably a hydrogen atom. Plural $R_4$s may be the same or different.

In formula (RD2), $R_5$ is the same group as defined in $R_1$ and $R_8$ is the same group as defined in $R_4$. Both $R_6$s are an alkyl groups, which may be the same or different, and are not a secondary or tertiary alkyl group.

$R_7$ is a hydrogen atom or a group capable of being substituted on a benzene ring. Examples of a group capable of being substituted on a benzene ring include a halogen atom such as fluorine, chlorine, bromine or iodine, an alkyl group, an aryl group, a cycloalkyl group, an alkenyl group, a cycloalkenyl group, an alkynyl group, an amino group, an acyl group, an acyloxy group, an acylamino group, a sulfonylamino group, a sulfamoyl group, a carbamoyl group, an alkylthio group, a sulfonyl group, an alkylsulfonyl group, a sulfinyl group, cyan group and a heterocycle group. $R_7$ is preferably methyl, ethyl, I-propyl, t-butyl, cyclohexyl, 1-methylcyclohexyl, 2-hydroxyethyl, or 3-hydroxypropyl; and more preferably methyl or 3-hydroxypropyl.

The alkyl group is preferably substituted or unsubstituted one of 1-20 carbon atoms, and specific examples thereof include methyl, ethyl, propyl and butyl. Substituents for the alkyl group are not specifically limited and examples thereof include an aryl group, hydroxyl, an alkoxy group, an aryloxy group, an alkylthio group, an arylthio group, an acylamino group, a sulfonamido group, a sulfonyl group, a phosphoryl group, an acyl group, a carbamoyl group, an ester group and a halogen atom.

$R_6$ may combine with $(R_8)_n$ or $(R_8)_m$ to form a saturated ring. $R_6$ is preferably methyl, which is most preferred compound of formula (RD2). The compounds are those which satisfy formula (S) and formula (T) described in European Patent No. 1,278,101, specifically, compounds (1-24), (1-28) to (1-54) and (1-56) to (1-75) are cited.

Specific examples of the compound of formula (RD1) or (RD2) are shown below but are not limited to these.

(RD1-1)

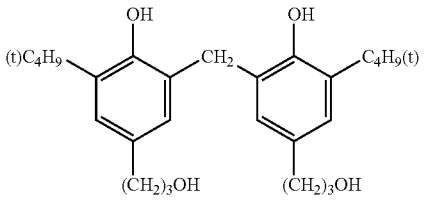

-continued (RD1-2)

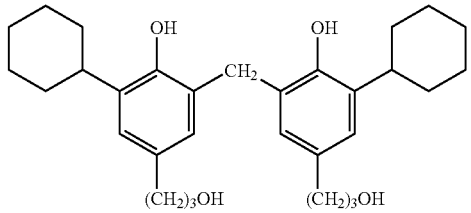

(RD1-3)

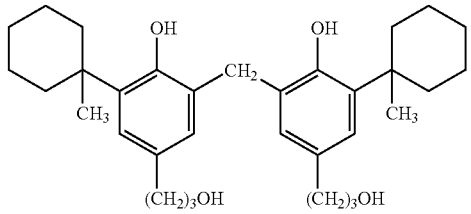

(RD1-4)

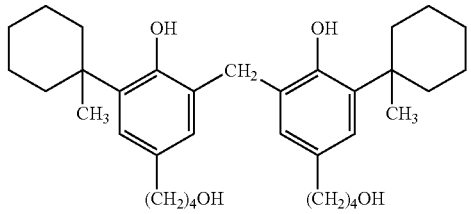

(RD1-5)

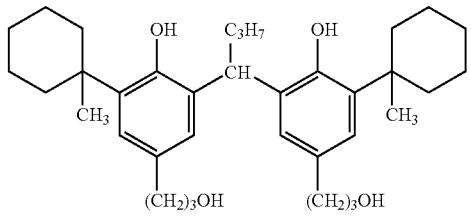

(RD1-6)

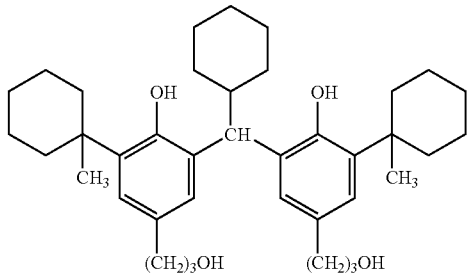

(RD1-7)

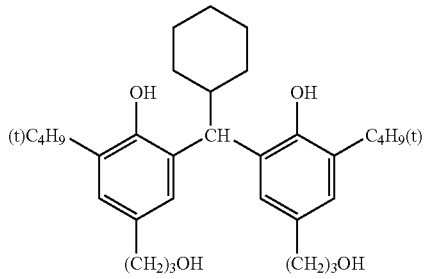

-continued
(RD1-8)
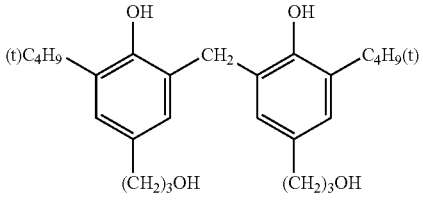
(RD1-9)
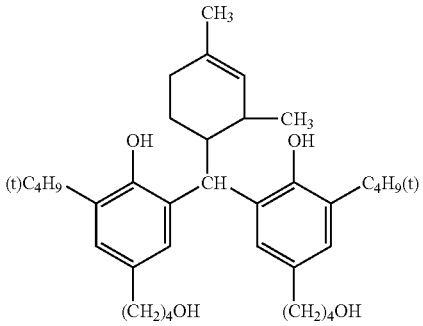
(RD1-10)
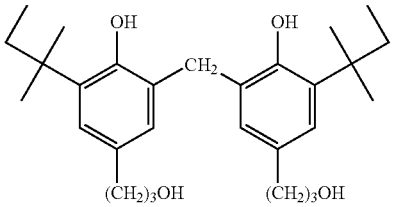
(RD1-11)
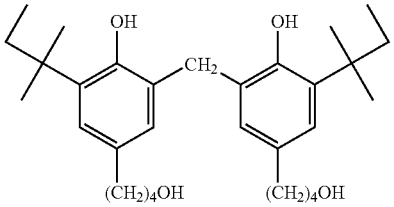
(RD1-12)
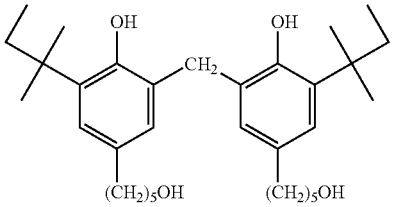
(RD1-13)
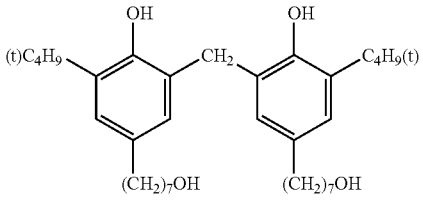
-continued
(RD1-14)
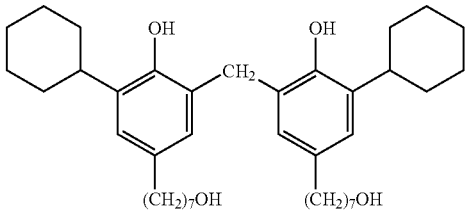
(RD1-15)
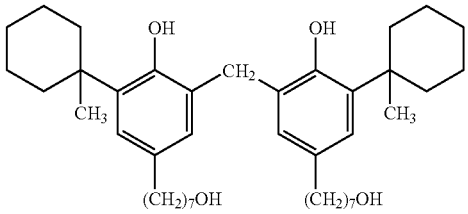
(RD1-16)
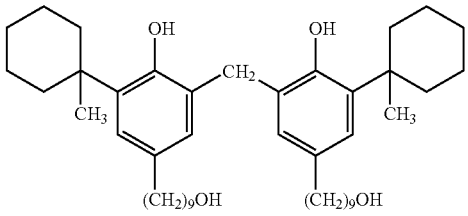
(RD1-17)
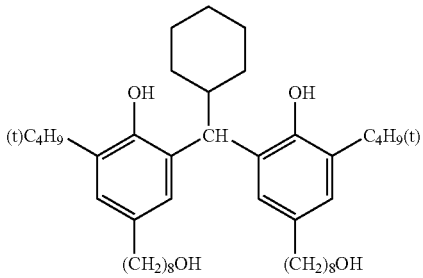
(RD1-18)
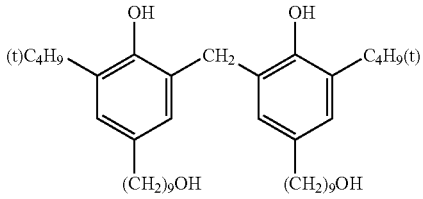
(RD1-19)
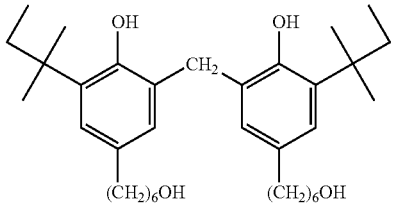

-continued
(RD1-20)
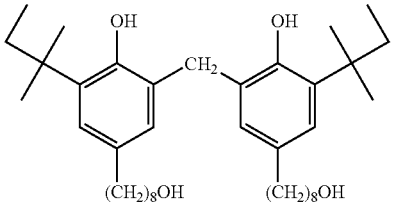
(RD1-21)
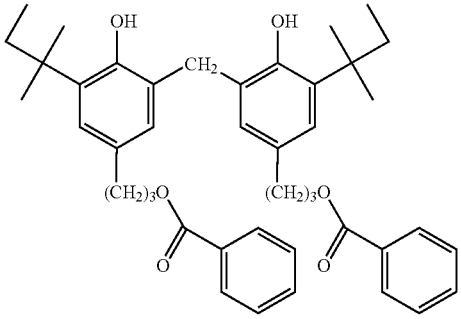
(RD1-22)
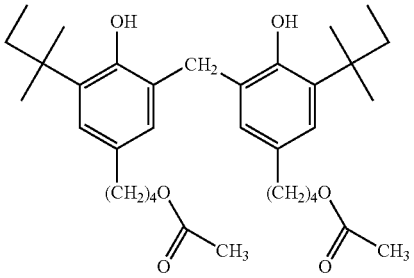
(RD1-23)
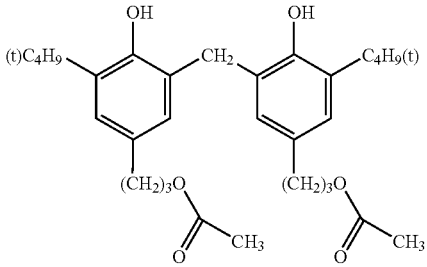
(RD1-24)
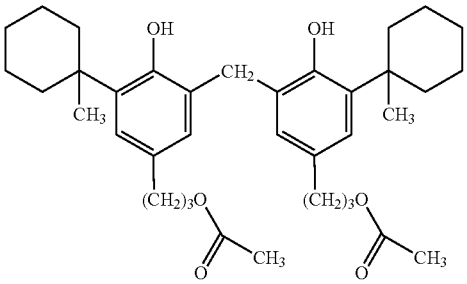
(RD1-25)
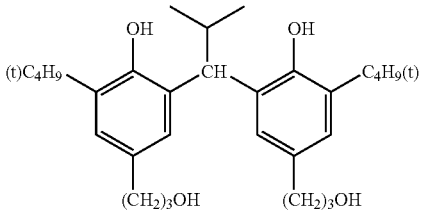
-continued
(RD1-26)
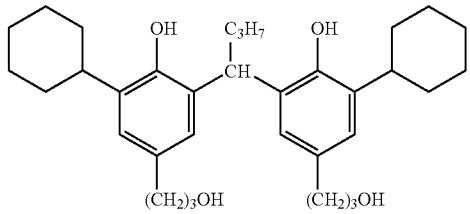
(RD1-27)
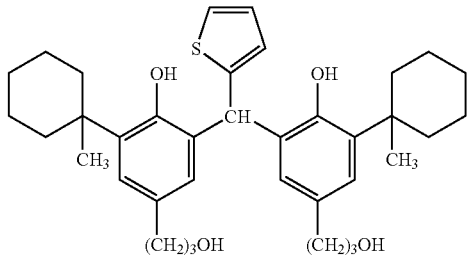
(RD1-28)
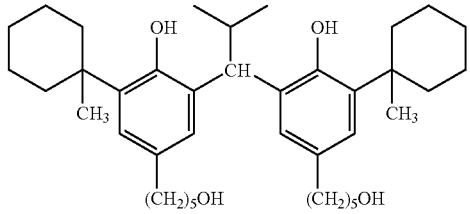
(RD1-29)
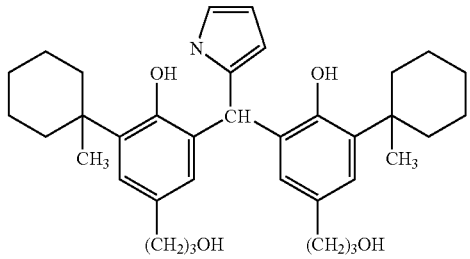
(RD1-30)
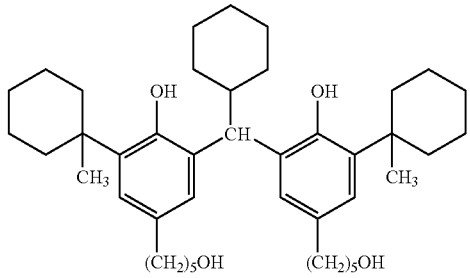
(RD1-31)
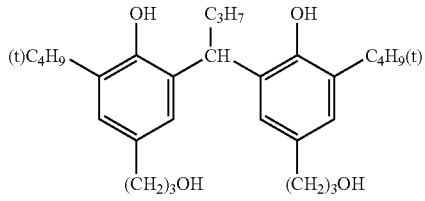

-continued
(RD1-32)
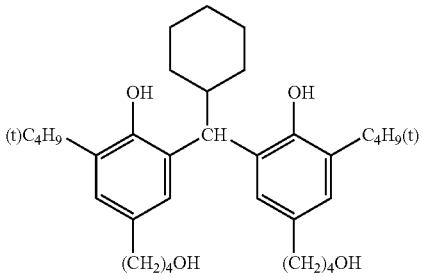
(RD1-33)
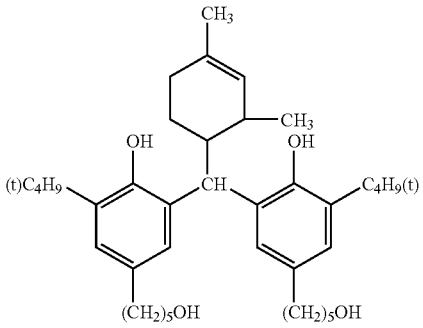
(RD1-34)
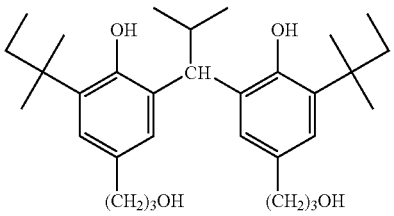
(RD1-35)
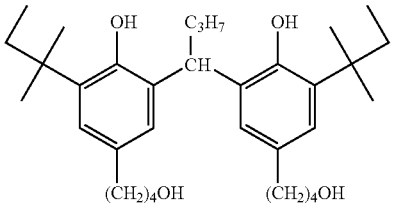
(RD1-36)
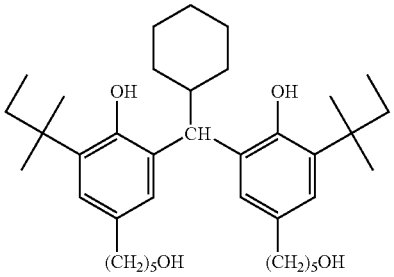
(RD1-37)
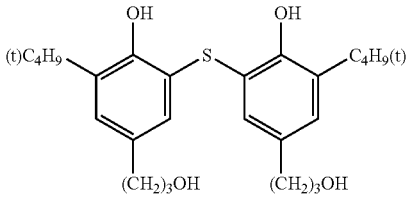
-continued
(RD1-38)
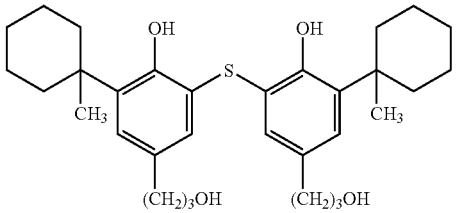
(RD1-39)
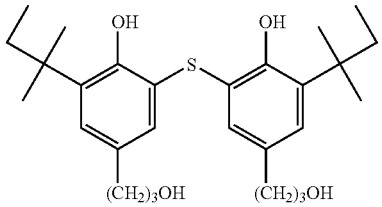
(RD1-40)
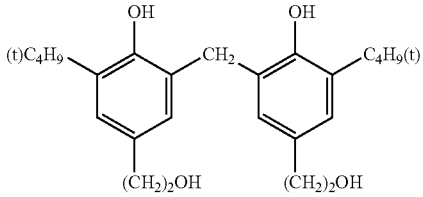
(RD1-41)
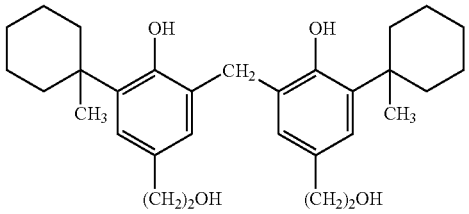
(RD1-42)
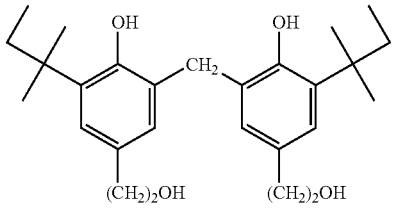
(RD1-43)
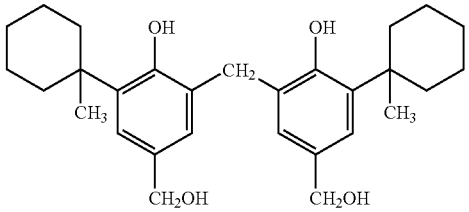
(RD1-44)
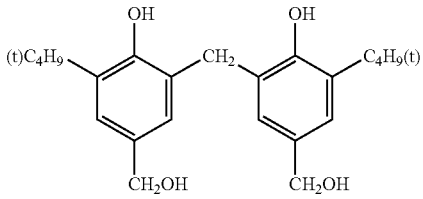

-continued
(RD1-45)
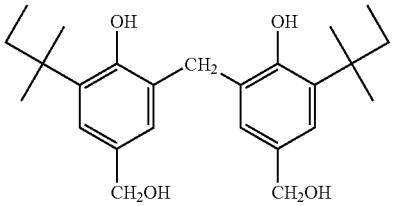
(RD1-46)
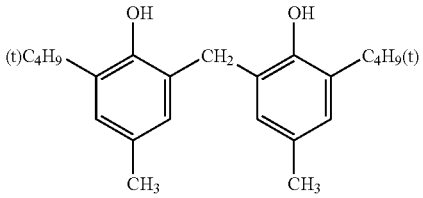
(RD1-47)
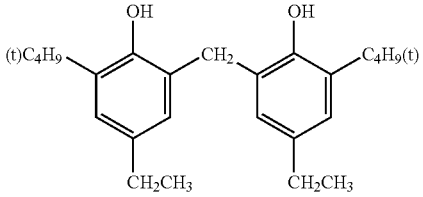
(RD1-48)
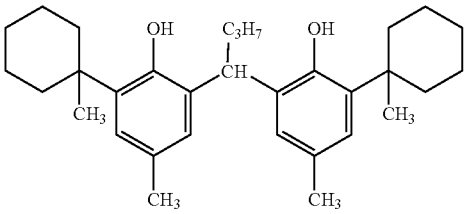
(RD2-1)
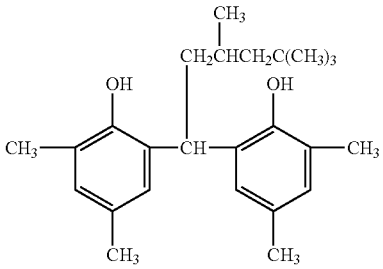
(RD2-2)
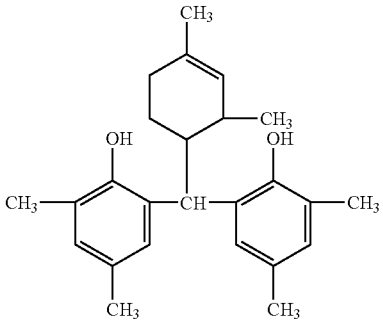
-continued
(RD2-3)
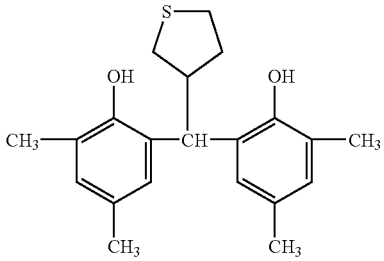
(RD2-4)
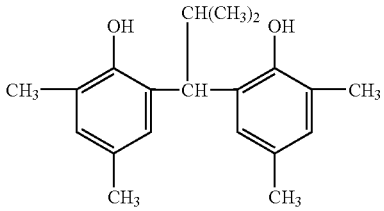
(RD2-5)
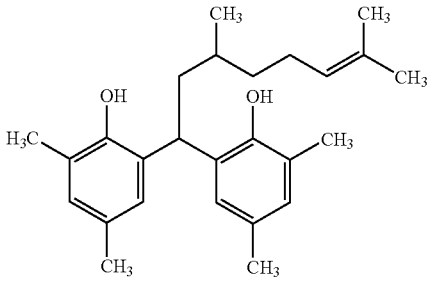
(RD2-6)
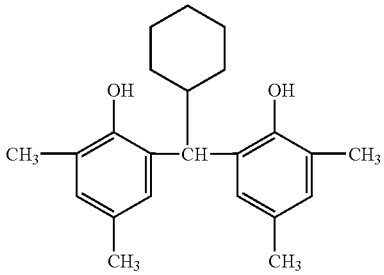
(RD2-7)
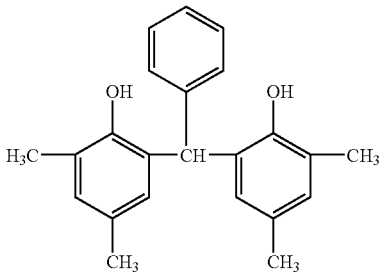
(RD2-8)
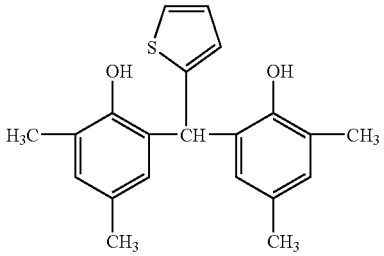

-continued (RD2-9)

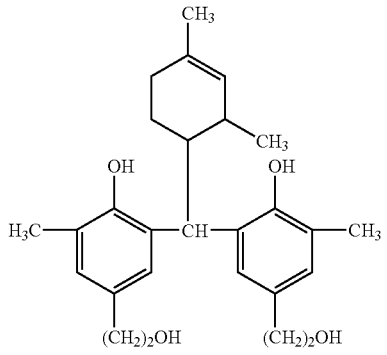

(RD2-10)

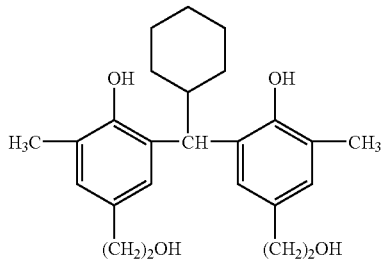

Bisphenol compounds of formula (RD1) or (RD2) can readily be synthesized according to conventionally known methods.

Examples of reducing agents which are usable in combination with the reducing agent described above are described in U.S. Pat. Nos. 3,770,448, 3,773,512, and 3,593,863; RD 17029 and 29963; JP-A Nos. 11-119372 and 2002-62616.

Reducing agents including the compounds of formula (RD1) are incorporated preferably in an amount of $1\times10^{-2}$ to 10 mol per mol of silver, and more preferably $1\times10^{-2}$ to 1.5 mol.

Image Color

The color tone of images obtained by thermal development of the imaging material is described.

It has been pointed out that in regard to the output image tone for medical diagnosis, cold image tone tends to result in more accurate diagnostic observation of radiographs. The cold image tone, as described herein, refers to pure black tone or blue black tone in which black images are tinted to blue. On the other hand, warm image tone refers to warm black tone in which black images are tinted to brown.

The tone is more described below based on an expression defined by a method recommended by the Commission Internationale de l'Eclairage (CIE) in order to define more quantitatively.

"Colder tone" as well as "warmer tone", which is terminology of image tone, is expressed, employing minimum density $D_{min}$ and hue angle $h_{ab}$ at an optical density D of 1.0. The hue angle $h_{ab}$ is obtained by the following formula, utilizing color specifications a* and b* of L*a*b* Color Space which is a color space perceptively having approximately a uniform rate, recommended by Commission Internationale de l'Eclairage (CIE) in 1976.

$$h_{ab}=\tan^{-1}(b^*/a^*)$$

In the invention, $h_{ab}$ is preferably in the range of 180 degrees<$h_{ab}$<270 degrees, is more preferably in the range of 200 degrees<$h_{ab}$<270 degrees, and is most preferably in the range of 220 degrees<$h_{ab}$<260 degrees.

This finding is also disclosed in JP-A 2002-6463.

Incidentally, as described, for example, in JP-A No. 2000-29164, it is conventionally known that diagnostic images with visually preferred color tone are obtained by adjusting, to the specified values, u* and v* or a* and b* in CIE 1976 (L*u*v*) color space or (L*a*b*) color space near an optical density of 1.0.

Extensive investigation was performed for the silver salt photothermographic material according to the present invention. As a result, it was discovered that when a linear regression line was formed on a graph in which in the CIE 1976 (L*u*v*) color space or the (L*a*b*) color space, u* or a* was used as the abscissa and v* or b* was used as the ordinate, the aforesaid material exhibited diagnostic properties which were equal to or better than conventional wet type silver salt photosensitive materials by regulating the resulting linear regression line to the specified range. The condition ranges of the present invention will now be described.

(1) It is preferable that the coefficient of determination value $R^2$ of the linear regression line, which is made by arranging u* and v* in terms of each of the optical densities of 0.5, 1.0, and 1.5 and the minimum optical density, is also from 0.998 to 1.000.

The value v* of the intersection point of the aforesaid linear regression line with the ordinate is from −5 to +5; and gradient (v*/u*) is from 0.7 to 2.5.

(2) The coefficient of determination value $R^2$ of the linear regression line is from 0.998 to 1.000, which is formed in such a manner that each of optical density of 0.5, 1.0, and 1.5 and the minimum optical density of the aforesaid imaging material is measured, and a* and b* in terms of each of the above optical densities are arranged in two-dimensional coordinates in which a* is used as the abscissa of the CIE 1976 (L*a*b*) color space, while b* is used as the ordinate of the same. In addition, value b* of the intersection point of the aforesaid linear regression line with the ordinate is from −5 to +5, while gradient (b*/a*) is from 0.7 to 2.5.

A method for making the above-mentioned linear regression line, namely one example of a method for determining u* and v* as well as a* and b* in the CIE 1976 color space, will now be described.

By employing a thermal development apparatus, a 4-step wedge sample including an unexposed portion and optical densities of 0.5, 1.0, and 1.5 is prepared. Each of the wedge density portions prepared as above is determined employing a spectral chronometer (for example, CM-3600d, manufactured by Minolta Co., Ltd.) and either u* and v* or a* and b* are calculated. Measurement conditions are such that an F7 light source is used as a light source, the visual field angle is 10 degrees, and the transmission measurement mode is used. Subsequently, either measured u* and v* or measured a* and b* are plotted on the graph in which u* or a* is used as the abscissa, while v* or b* is used as the ordinate, and a linear regression line is formed, whereby the coefficient of determination value $R^2$ as well as intersection points and gradients are determined.

The specific method enabling to obtain a linear regression line having the above-described characteristics will be described below. In the invention, by regulating the added amount of the reducing agents (developing agents), silver halide grains, and aliphatic carboxylic acid silver, which are directly or indirectly involved in the development reaction process, it is possible to optimize the shape of developed silver so as to result in the desired tone. For example, when the developed silver is shaped to dendrite, the resulting image tends to be bluish, while when shaped to filament, the resulting imager tends to be yellowish. Namely, it is possible to adjust the image tone taking into account the properties of shape of developed silver.

Usually, image toning agents such as phthalazinone or a combinations of phthalazine with phthalic acids, or phthalic anhydride are employed. Examples of suitable image toning agents are disclosed in Research Disclosure, Item 17029, and U.S. Pat. Nos. 4,123,282, 3,994,732, 3,846,136, and 4,021,249.

In the invention, when rapid processing was performed using a compact laser image having a cooling section of a short length, it was proved that silver image tone was greatly different from preferable color. To overcome such a problem, conventional toning agents were insufficient and there were needed compounds capable of performing imagewise dye formation upon thermal development to form a dye image (e.g., leuco dyes or coupler compounds). As such a compound is preferable one capable of forming a dye image exhibiting an absorption peak at a wavelength of 360 to 450 nm upon thermal development or one capable of forming a dye image exhibiting an absorption peak at a wavelength of 600 to 700 nm upon thermal development. It is specifically preferred to contain both compounds to achieve superior image tone. Thus, it is preferable to control color tone employing couplers disclosed in JP-A No. 11-288057 and EP 1134611A2 as well as leuco dyes detailed below.

Leuco Dye

The photothermographic material relating to the invention can employ leuco dyes to control image tone, as described above. Leuco dyes are employed in the silver salt photothermographic materials relating to the invention. There may be employed, as leuco dyes, any of the colorless or slightly tinted compounds which are oxidized to form a colored state when heated at temperatures of about 80 to about 200° C. for about 0.5 to about 30 seconds. It is possible to use any of the leuco dyes which are oxidized by silver ions to form dyes. Compounds are useful which are sensitive to pH and are oxidizable to a colored state.

Representative leuco dyes suitable for the use in the present invention are not particularly limited. Examples include bisphenol leuco dyes, phenol leuco dyes, indoaniline leuco dyes, acrylated azine leuco dyes, phenoxazine leuco dyes, phenodiazine leuco dyes, and phenothiazine leuco dyes. Further, other useful leuco dyes are those disclosed in U.S. Pat. Nos. 3,445,234, 3,846,136, 3,994,732, 4,021,249, 4,021,250, 4,022,617, 4,123,282, 4,368,247, and 4,461,681, as well as JP-A Nos. 50-36110, 59-206831, 5-204087, 11-231460, 2002-169249, and 2002-236334.

In order to control images to specified color tones, it is preferable that various color leuco dyes are employed individually or in combinations of a plurality of types. In the present invention, for minimizing excessive yellowish color tone due to the use of highly active reducing agents, as well as excessive reddish images especially at a density of at least 2.0 due to the use of minute silver halide grains, it is preferable to employ leuco dyes which change to cyan. Further, in order to achieve precise adjustment of color tone, it is further preferable to simultaneously use yellow leuco dyes and other leuco dyes which change to cyan.

It is preferable to appropriately control the density of the resulting color while taking into account the relationship with the color tone of developed silver itself. In the invention, dye formation is performed so as to have a reflection density of 0.01 to 0.05 or a transmission density of 0.005 to 0.50, and the image tone is adjusted so as to form images exhibiting tone falling within the foregoing tone range. In the present invention, color formation is performed so that the sum of maximum densities at the maximum adsorption wavelengths of dye images formed by leuco dyes is customarily 0.01 to 0.50, is preferably 0.02 to 0.30, and is most preferably 0.03 to 0.10. Further, it is preferable that images be controlled within the preferred color tone range described below.

Yellow Dye Forming Leuco Dye

In the invention, particularly preferably employed as yellow forming leuco dyes are color image forming agents represented by the following formula (YA) which increase absorbance between 360 and 450 nm via oxidation:

formula (YA)

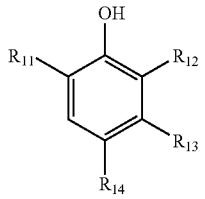

wherein $R_{11}$ is a substituted or unsubstituted alkyl group; $R_{12}$ is a hydrogen atom or a substituted or unsubstituted alkyl or acyl group, provided that $R_{11}$ and $R_{12}$ are not 2-hydroxyphenylmethyl; $R_{13}$ is a hydrogen atom or a substituted or unsubstituted alkyl group; $R_{14}$ is a group capable of being substituted on a benzene ring.

The compounds represented by formula (YA) will now be detailed. In the Formula (YA), $R_{11}$ is a substituted or unsubstituted alkyl group, provided that when $R_{12}$ is a substituent other than a hydrogen atom, $R_{11}$ is an alkyl group. In the foregoing formula (YA), the alkyl groups represented by $R_1$ are preferably those having 1 to 30 carbon atoms, which may have a substituent. Specifically preferred is methyl, ethyl, butyl, octyl, i-propyl, t-butyl, t-octyl, t-pentyl, sec-butyl, cyclohexyl, or 1-methyl-cyclohexyl. Groups (i-propyl, i-nonyl, t-butyl, t-amyl, t-octyl, cyclohexyl, 1-methyl-cyclohexyl or adamantyl) which are three-dimensionally larger than i-propyl are preferred. Of these, preferred are secondary or tertiary alkyl groups and t-butyl, t-octyl, and t-pentyl, which are tertiary alkyl groups, are particularly preferred. Examples of substituents which $R_1$ may have include a halogen atom, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, and a phosphoryl group.

$R_{12}$ represents a hydrogen atom, a substituted or unsubstituted alkyl group, or an acylamino group. The alkyl group represented by $R_2$ is preferably one having 1-30 carbon atoms, while the acylamino group is preferably one having 1-30 carbon atoms. Of these, description for the alkyl group is the same as for aforesaid $R11_1$.

The acylamino group represented by $R_2$ may be unsubstituted or have a substituent. Specific examples thereof include an acetylamino group, an alkoxyacetylamino group, and an aryloxyacetylamino group. $R_{12}$ is preferably a hydrogen atom or an unsubstituted group having 1 to 24 carbon atoms, and specifically listed are methyl, i-propyl, and t-butyl. Further, neither $R_1$ nor $R_2$ is a 2-hydroxyphenylmethyl group.

$R_{13}$ represents a hydrogen atom, and a substituted or unsubstituted alkyl group. Preferred as alkyl groups are those having 1 to 30 carbon atoms. Description for the above alkyl groups is the same as for $R_{11}$. Preferred as $R_{13}$ are a hydrogen atom and an unsubstituted alkyl group having 1 to 24 carbon atoms, and specifically listed are methyl, i-propyl and t-butyl. It is preferable that either $R_{12}$ or $R_{13}$ represents a hydrogen atom.

$R_{14}$ represents a group capable of being substituted to a benzene ring, and represents the same group as described for substituent $R_4$, for example, in aforesaid Formula (RED). $R_4$ is preferably a substituted or unsubstituted alkyl group having 1 to 30 carbon atoms, as well as an oxycarbonyl group having 2 to 30 carbon atoms. The alkyl group having 1 to 24 carbon atoms is more preferred. As substituents of the alkyl group are cited an aryl group, an amino group, an alkoxy group, an oxycarbonyl group, an acylamino group, an acyloxy group, an imido group, and a ureido group. Of these, more preferred are an aryl group, an amino group, an oxycarbonyl group, and an alkoxy group. The substituent of the alkyl group may be substituted with any of the above alkyl groups.

Among the compounds represented by the foregoing formula (YA), preferred compounds are bis-phenol compounds represented by the following formula (YB):

formula (YB)

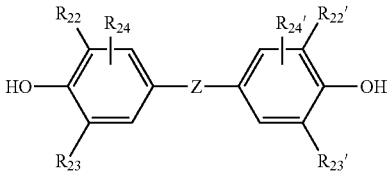

wherein, Z represents a —S— or —C($R_{21}$) ($R_{21'}$)— group. $R_{21}$ and $R_{21}$, each represent a hydrogen atom or a substituent. The substituents represented by $R_{21}$ and $R_{21'}$ are the same substituents listed for $R_{21}$ in the aforementioned Formula (RED). $R_{21}$ and $R_{21'}$ are preferably a hydrogen atom or an alkyl group.

$R_{22}$, $R_{23}$, $R_{22}$' and $R_{23}$' each represent a substituent. The substituents represented by $R_{22}$, $R_{23}$, $R_{22}$' and $R_{23}$' are the same substituents listed for $R_2$ and $R_3$ in the afore-mentioned formula (1). $R_{22}$, $R_{23}$, $R_{22}$' and $R_{23}$' are preferably, an alkyl group, an alkenyl group, an alkynyl group, an aryl group, a heterocyclic group, and more preferably, an alkyl group. Substituents on the alkyl group are the same substituents listed for the substituents in the aforementioned Formula (RD1). $R_{22}$, $R_{23}$, $R_{23}$' and $R_{23}$' are more preferably tertiary alkyl groups such as t-butyl, t-amino, t-octyl and 1-methyl-cyclohexyl.

$R_{24}$ and $R_{24'}$ each represent a hydrogen atom or a substituent, and the substituents are the same substituents listed for $R_4$ in the afore-mentioned formula (RD1).

Examples of the bis-phenol compounds represented by the formulas (YA) and (YB) are, the compounds disclosed in JP-A No. 2002-169249, Compounds (II-1) to (II-40), paragraph Nos. [0032]-[0038]; and EP 1211093, Compounds (ITS-1) to (ITS-12), paragraph No. [0026].

Specific examples of bisphenol compounds represented by formulas (Ya) and (YB) are shown below.

(YA-1)

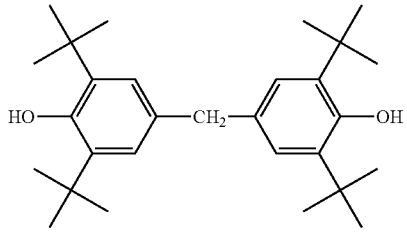

(YA-2)

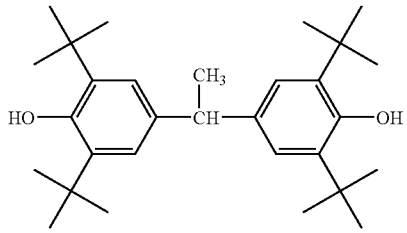

(YA-3)

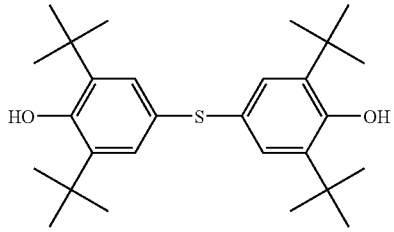

(YA-4)

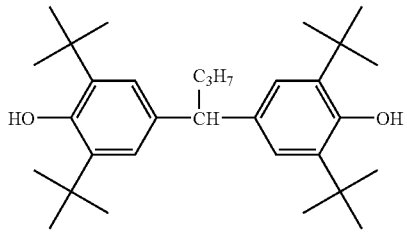

(YA-5)

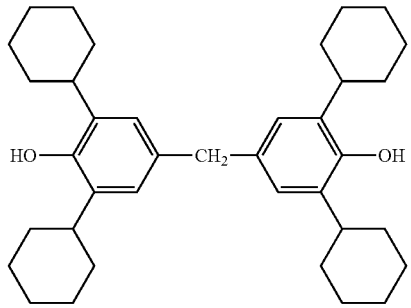

(YA-6)

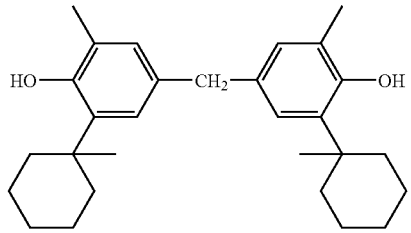

-continued (YA-7)

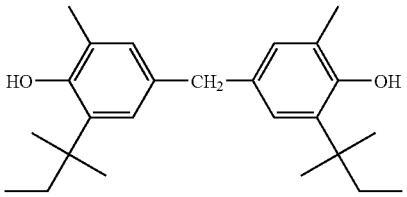

(YA-8)

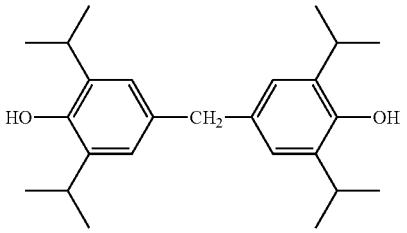

(YA-9)

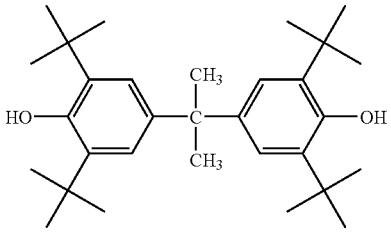

(YA-10)

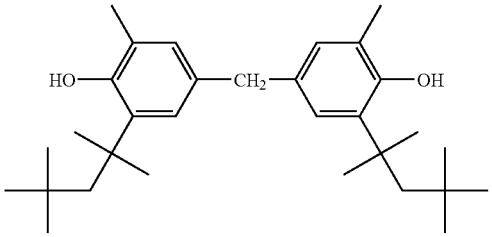

(YA-11)

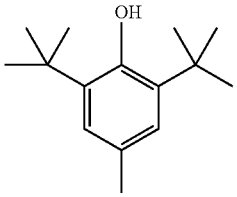

(YA-12)

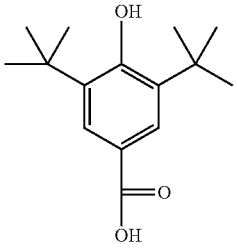

-continued (YA-13)

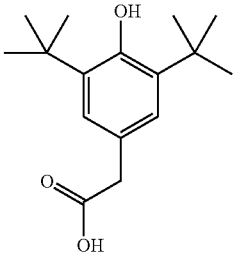

(YA-14)

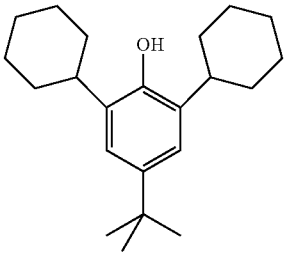

(YA-15)

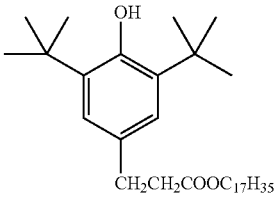

An amount of an incorporated compound represented by formula (YA), which is hindered phenol compound and include compound of formula (YB), is; usually, 0.00001 to 0.01 mol, and preferably, 0.0005 to 0.01 mol, and more preferably, 0.001 to 0.008 mol per mol of Ag.

A yellow dye forming leuco dye is incorporated preferably in a molar ratio of 0.00001 to 0.2, and more preferably 0.005 to 0.1, based on the total amount of reducing agents of formulas (RD1) and (RD2). In the photothermographic material of the invention, the sum of the maximum density at the wavelength of maximum absorption of the dye image formed of a yell dye-forming leuco dye is preferably from 0.01 to 0.50, more preferably from 0.02 to 0.30, and still more preferably from 0.03 to 0.10.

Cyan Dye Forming Leuco Dye

Besides the foregoing yellow dye forming leuco dyes, cyan dye forming leuco dyes are also usable in a photothermographic material to control image tone.

Cyan dye forming leuco dyes will be described hereinafter. A leuco dye is preferably a colorless or slightly colored compound which is capable of forming color upon oxidation when heated at 80 to 200° C. for 5 to 30 sec. There is also usable any leuco dye capable of forming a dye upon oxidation by silver ions. A compound which is sensitive to pH and being oxidized to a colored form.

Cyan dye forming leuco dyes will now be described. In the present invention, particularly preferably employed as cyan forming leuco dyes are color image forming agents which increase absorbance between 600 and 700 nm via oxidation, and include the compounds described in JP-A No. 59-206831 (particularly, compounds of λmax in the range of 600 to 700 nm), compounds represented by formulas (I) through (IV) of JP-A No. 5-204087 (specifically, compounds (1) through (18) described in paragraphs [0032] through [0037]), and compounds represented by formulas 4-7 (specifically, compound Nos. 1 through 79 described in paragraph [0105]) of JP-A No. 11-231460.

Specific examples of a cyan dye forming leuco dye are shown below, but are by no means limited to these.
(CLA-1)
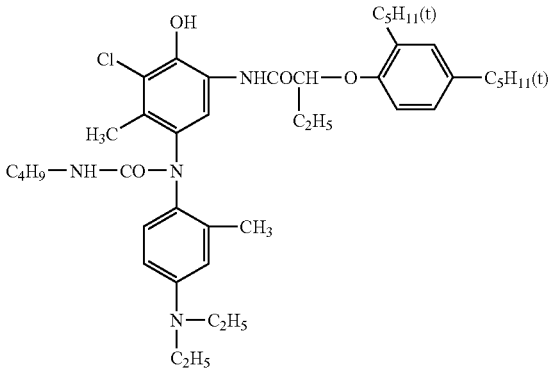
(CLA-2)
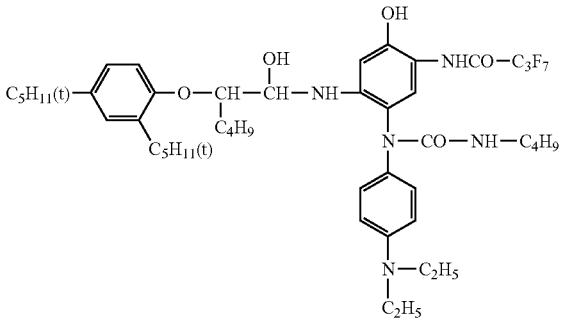
(CLA-3)
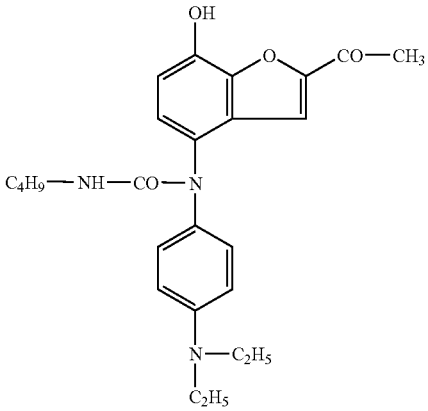
(CLA-4)
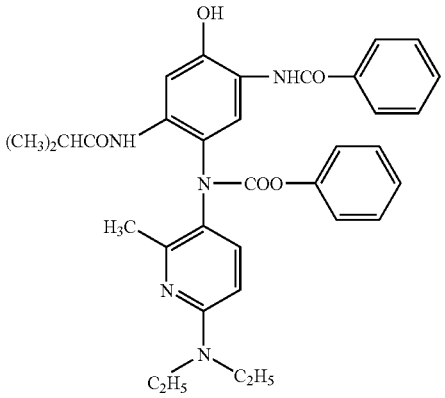
-continued
(CLA-5)
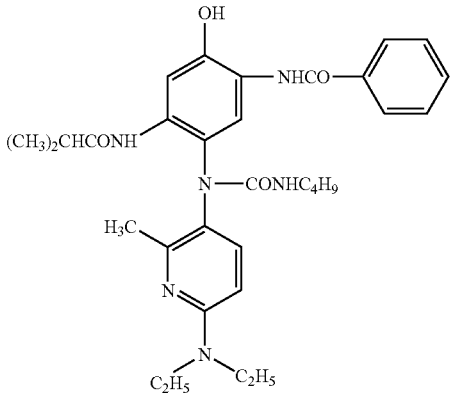
(CLB-1)
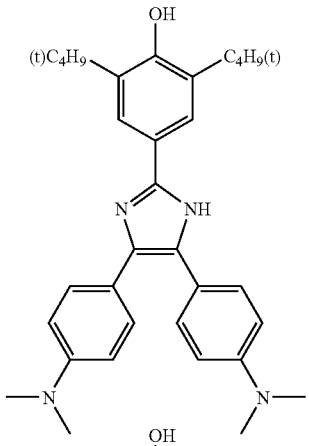
(CLB-2)
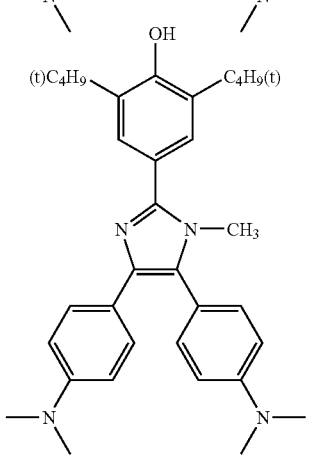
(CLB-3)
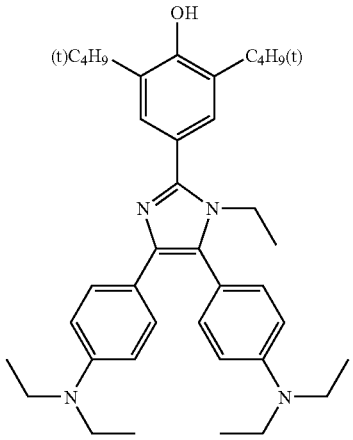

-continued (CLB-4)

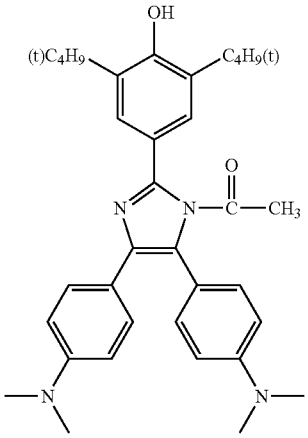

(CBL-5)

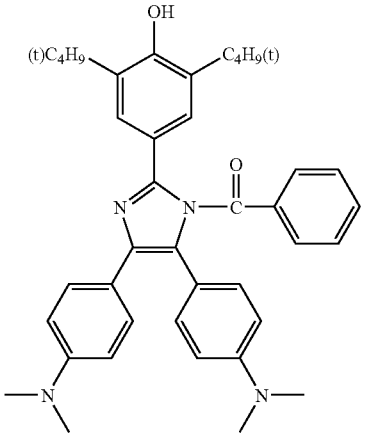

(CLB-6)

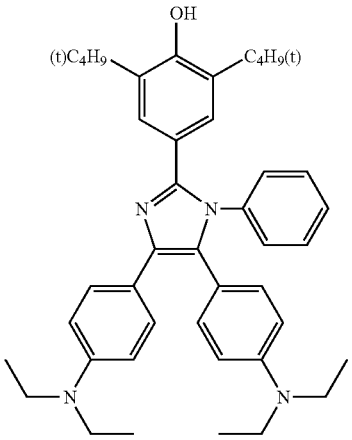

-continued (CLB-7)

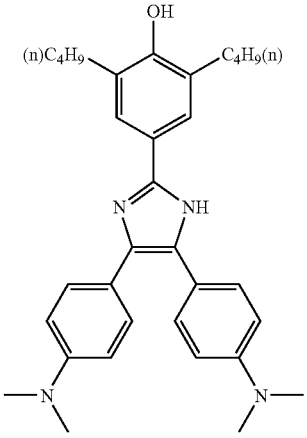

(CLB-8)

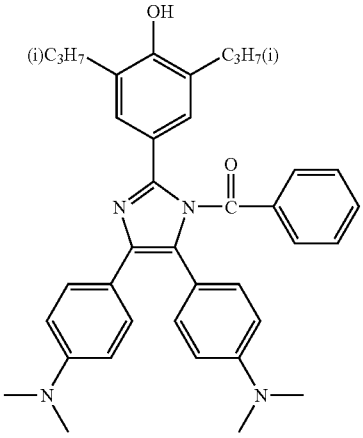

(CLB-9)

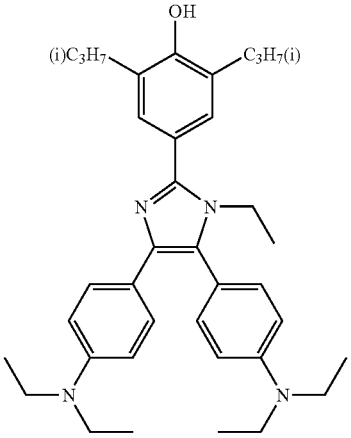

The addition amount of cyan forming leuco dyes is usually 0.00001 to 0.05 mol/mol of Ag, preferably 0.0005 to 0.02 mol/mol, and more preferably 0.001 to 0.01 mol. A cyan forming leuco dye is incorporated preferably in a molar ratio of 0.00001 to 0.2, and more preferably 0.005 to 0.1, based on the total amount of reducing agents of formulas (1) and (2). The cyan dye is preferably formed so that the sum of the maximum density at the absorption maximum of a color image formed by a cyan forming leuco dye is preferably 0.01 to 0.50, more preferably 0.02 to 0.30, and still more preferably 0.03 to 0.10.

In addition to the foregoing cyan forming leuco dye, magenta color forming leuco dyes or yellow color forming leuco dyes may be used to control delicate color tone.

The compounds represented by the foregoing formulas (YA) and (YB) and cyan forming leuco dyes may be added employing the same method as for the reducing agents represented by the foregoing formula (RD1). They may be incorporated in liquid coating compositions employing an optional method to result in a solution form, an emulsified dispersion form, or a minute solid particle dispersion form, and then incorporated in a photosensitive material.

It is preferable to incorporate the compounds represented by formulas (RD1) and (RD2), formulas (YA) and (YB), and cyan forming leuco dyes into an light-sensitive layer containing organic silver salts. On the other hand, the former may be incorporated in the light-sensitive layer, while the latter may be incorporated in a non-light-sensitive layer adjacent to the aforesaid light-sensitive layer. Alternatively, both may be incorporated in the non-light-sensitive layer. Further, when the light-sensitive layer is comprised of a plurality of layers, incorporation may be performed for each of the layers.

The photothermographic material of the invention may contain a binder in the light-sensitive layer or the light-insensitive layer.

Suitable binders for the silver salt photothermographic material are to be transparent or translucent and commonly colorless, and include natural polymers, synthetic resin polymers and copolymers, as well as media to form film, for example, those described in paragraph [0069] of JP-A No. 2001-330918. Preferable binders for the light-sensitive layer of the photothermographic material of the invention are poly (vinyl acetals), and a particularly preferable binder is poly (vinyl butyral), which will be detailed hereunder.

Polymers such as cellulose esters, especially polymers such as triacetyl cellulose, cellulose acetate butyrate, which exhibit higher softening temperature, are preferable for an over-coating layer as well as an undercoating layer, specifically for a light-insensitive layer such as a protective layer and a backing layer. Incidentally, if desired, the binders may be employed in combination of at least two types.

The binder preferably introduces at least a polar group chosen from —COOM, —$SO_3M$, -0$SO_3M$, —P═O$(OM)_2$, —O—P═O$(OM)_2$, —N$(R)_2$, —$N^+(R)_3$, (in which M is a hydrogen atom, an alkali metal base or a hydrocarbon group), epoxy group, —SH, and —CN in the stage of copolymerization or addition reaction. Of these, —$SO_3M$ or -0$SO_3M$ is preferred. The content of a polar group is in the range of $1\times10^{-8}$ to $1\times10^{-1}$, and preferably $1\times10^{-6}$ to $1\times10^{2}$.

Such binders are employed in the range of a proportion in which the binders function effectively. Skilled persons in the art can easily determine the effective range. For example, preferred as the index for maintaining aliphatic carboxylic acid silver salts in a photosensitive layer is the proportion range of binders to aliphatic carboxylic acid silver salts of 15:1 to 1:2 and most preferably of 8:1 to 1:1. Namely, the binder amount in the photosensitive layer is preferably from 1.5 to 6 g/$m^2$, and is more preferably from 1.7 to 5 g/$m^2$. When the binder amount is less than 1.5 g/$m^2$, density of the unexposed portion markedly increases, whereby it occasionally becomes impossible to use the resultant material.

In the invention, it is preferable that thermal transition point temperature (Tg) is preferably from 70 to 105° C. Thermal transition point temperature (Tg) can be measured by a differential scanning calorimeter, in which the crossing point of the base line and a slope of the endothermic peak is defined as Tg.

The glass transition temperature (Tg) is determined employing the method, described in Brandlap et al., "Polymer Handbook", pages III-139 to III-179, 1966 (published by Wiley and Son Co.). The Tg of the binder composed of copolymer resins is obtained based on the following formula:

Tg of the copolymer (in ° C.)=$v_1Tg_1+v_2Tg_2+\ldots+v_nTg_n$ wherein $v_1, v_2, \ldots v_n$ each represents the mass ratio of the monomer in the copolymer, and $Tg_1, Tg_2, \ldots Tg_n$ each represents Tg (in ° C.) of the homopolymer which is prepared employing each monomer in the copolymer. The accuracy of Tg, calculated based on the formula calculation, is ±5° C.

The use of a binder exhibiting a Tg of 70 to 105° C. can achieve sufficient maximum density in the image formation.

Binders usable in the invention exhibit a Tg of 70 to 105° C., a number-average molecular weight of 1,000 to 1,000,000 (preferably 10,000 to 500,000) and a polymerization degree of 50 to 1,000. Polymer containing ethylenically unsaturated monomer as a constitution unit and its copolymer are those described in JP-A No. 2001-330918, paragraph [0069]. Of these, preferred examples thereof include methacrylic acid alkyl esters, methacrylic acid aryl esters, and styrenes. Polymer compounds containing an acetal group are preferred among polymer compounds. Of such polymer compounds containing an acetal group, polyvinyl acetal having an acetal structure is preferred, including, for example, polyvinyl acetal described in U.S. Pat. Nos. 2,358,836, 3,003,879 and 2,828,204; and British Patent No. 771,155. Further, The polymer compound containing an acetal group is also preferably a compound represented by formula (V) described in JP-A no. 2002-287299, paragraph [150].

There are usable in the invention commonly known polyurethane resins, such as a polyester-polyurethane, polyether-polyurethane, polyether-polyester polyurethane, polycarbonate-polyurethane, polyester-polycarbonate polyurethane, or polycaprolactone-polyurethane. Polyurethane preferably contains at least one hydroxyl group at each of both ends of the molecule, i.e., at least two hydroxy group in total. The hydroxyl group cross-links polyisocyanate as a hardener to form a network structure so that it is preferred to contain hydroxyl groups as many as possible. Specifically, a hydroxyl group existing at the end of the molecule exhibits enhanced reactivity with a hardener. Polyurethane contains preferably at least three (more preferably at least four) hydroxyl groups at the end of the molecule. When polyurethane is employed, the polyurethane preferably has a glass transition temperature of 70 to 105° C., a breakage elongation of 100 to 2,000 percent, and a breakage stress of 0.5 to 100 M/$mm^2$.

The foregoing polymeric compounds (or polymers) may be used singly or plural polymers may be blended, but a blend of plural polymers is preferred to achieve effects of the invention. It is preferred to blend polymers differing 5 to 60° C. in Tg, more preferably 10 to 40° C., and still more preferably 10 to 30° C. from one another. Specifically, when at least two polymers (binders) are contained in the light-sensitive layer, the difference in Tg between the polymers is preferably from 5 to 60° C., more preferably from 10 to 40° C., and still more preferably from 10 to 30° C. Blending polymers differing in Tg can control Young modulus, breaking strength and breaking elongation percentage of coated film and achieve enhanced transportability and improvement in internal staining in a processor.

In the invention, polyvinyl acetal resin is preferred as a main binder, and a polyurethane resin is preferred as a sub-binder. The ratio of main binder to sub-binder is preferably from 90:10 to 50:50, and more preferably from 80:20 to 60:40.

The foregoing polymer is preferably used as a main binder in the light-sensitive layer. The main binder means that at least 50% by mass of the whole binder in the light-sensitive layer is accounted for by the foregoing polymer. Accordingly, other polymers may be blended within the range of less than 50% by mass of the whole binder. Such polymers are not specifically limited when using a solvent in which the main polymer is soluble. Preferred examples thereof include polyvinyl acetate, acryl resin and urethane resin.

The light-sensitive layer may contain an organic gelling agent. The organic gelling agent refers to a compound which provides its system a yield point when incorporated to organic liquid and having a function of disappearing or lowering fluidity.

In one preferred embodiment of the invention, a coating solution for the light-sensitive layer contains an aqueous-dispersed polymer latex. The aqueous-dispersed polymer latex accounts for preferably at least 50% by mass of the whole binder of the coating solution. The polymer latex preferably accounts for at least 50% by mass of the whole binder of the light-sensitive layer, and more preferably at least 70% by mass. The polymer latex is a dispersion in which a water-insoluble hydrophobic polymer is in the form of minute particles dispersed in aqueous dispersing medium. The polymer may be dispersed in any form, such as being emulsified in the dispersing medium, being emulsion-polymerized, being dispersed in the form of micelles or a polymer partially having a hydrophilic structure in the molecule and its molecular chain being molecularly dispersed. The average size of dispersed particles is preferably 1 to 50,000 nm, and more preferably 5 to 1,000 nm. The particle size distribution of the dispersed particles is not specifically limited and may be one having a broad distribution or a monodisperse distribution.

Polymer latex usable in the photothermographic material of the invention may be not only conventional polymer latex having a uniform structure but also a so-called core/shell type latex. In this regard, core and shell differing in Tg, are occasionally preferred. The minimum film-forming temperature (MFT) of a polymer latex relating to the invention is preferably from −30 to 90° C., and more preferably 0 to 70° C. There may be added a film-forming aid to control the minimum film-forming temperature. The film-forming aid is also called a plasticizer and an organic compound (usually, organic solvent) which lowers the minimum film-forming temperature, as described in S. Muroi "Gosei Latex no Kagaku" (Chemistry of Synthetic Latex) Kobunshi Kankokai, 1970.

Polymer species used in polymer latex include, for example, acryl resin, vinyl acetate resin, polyester resin, polyurethane resin, rubber type resin, vinyl chloride resin, vinylidene chloride resin, polyolefin resin and their copolymers. The polymer may be a straight chained or branched polymer, or may be cross-linked. The polymer may be a homopolymer comprised of a single monomer or a copolymer comprised of at least two monomers. Copolymer may be a random copolymer or a block copolymer. The polymer molecular weight is usually from 5,000 to 1,000,000, and preferably 10,000 to 100,000 in terms of number-average molecular weight. An excessively small molecular weight results in insufficient mechanical strength and an excessively large one results in deteriorated film-forming capability.

The equilibrium moisture content of a polymer latex is preferably from 0.01% to 2% by mass at 25° C. and 60% RH (relative humidity), and more preferably 0.01% to 1%. The definition and measurement of the equilibrium moisture content is referred to, for example, "Kobunshi-Kogaku Koza 14, Kobunshi-Shikenho" (edited by Kobunshi Gakkai, Chijin Shoin).

Specific examples of polymer latex include those described in JP-A No. 2002-287299, {0173}. These polymers may be used singly or in their combination as a blend. A carboxylic acid component as a polymer specie, such as an acrylate or methacrylate component, is contained preferably in an amount of 0.1 to 10% by mass.

A hydrophilic polymer such as gelatin, polyvinyl alcohol, methyl cellulose, hydroxypropyl cellulose, carboxymethyl cellulose, or hydroxypropyl cellulose may optionally be incorporated within the range of not more than 50% by mass of the whole binder. The hydrophilic polymer content is preferably not more than 30% by mass of the light-sensitive layer.

In the preparation of a coating solution for the light-sensitive layer, an organic silver salt and an aqueous-dispersed polymer latex may be added in any order. Thus, either one may be added at first or both may be added simultaneously, but the polymer latex is added preferably later.

Before adding a polymer latex, an organic silver salt is added and then a reducing agent is preferably mixed. Aging a mixture of an organic silver salt and a polymer latex at an excessively low temperature results in deteriorated coated layer surface, and aging at an excessively high temperature leads to increased fogging. After mixing, the coating solution is aged preferably at a temperature of 30 to 65° C., more preferably 35 to 60° C., and still more preferably 35 to 55° C.

The coating solution for the light-sensitive layer, after mixing an organic silver salt and an aqueous-dispersed polymer latex, is coated preferably after 30 min. to 24 hr., more preferably after 60 min. to 10 hr., and still more preferably after 120 min. to 10 hr. The expression "after mixing" means that an organic silver salt and aqueous-dispersed polymer latex are added and additive materials have been homogeneously dispersed.

Cross-linking Agent

The light-sensitive layer may contains cross-linking agents capable of binding binder molecules through cross linking. It is known that employing cross-linking agents in the aforesaid binders minimizes uneven development, due to the improved adhesion of the layer to the support. In addition, it results in such effects that fogging during storage is minimized and the creation of printout silver after development is also minimized.

There may be employed, as cross-linking agents used in the invention, various conventional cross-linking agents, which have been employed for silver halide photosensitive photographic materials, such as aldehyde type, epoxy type, ethyleneimine type, vinylsulfone type, sulfonic acid ester type, acryloyl type, carbodiimide type, and silane compound type cross-linking agents, which are described in JP-A No. 50-96216. Of these, isocyanate type compounds, silane type compounds, epoxy type compounds and acid anhydride are preferred.

The aforesaid isocyanate based cross-linking agents are isocyanates having at least two isocyanate groups and adducts thereof. Specific examples thereof include aliphatic isocyanates, aliphatic isocyanates having a ring group, benzene diisocyanates, naphthalene diisocyanates, biphenyl isocyanates, diphenylmethane diisocyanates, triphenylmethane diisocyanates, triisocyanates, tetraisocyanates, and adducts of these isocyanates and adducts of these isocyanates with dihydric or trihydric alcohols. Employed as specific examples may be isocyanate compounds described on pages 10 through 12 of JP-A No. 56-5535.

Incidentally, adducts of an isocyanate with a polyalcohol are capable of markedly improving the adhesion between layers and further of markedly minimizing layer peeling, image dislocation, and air bubble formation. Such isocyanates may be incorporated in any portion of the silver salt photothermographic material. They may be incorporated in, for example, a support (particularly, when the support is paper, they may be incorporated in a sizing composition), and optional layers such as a photosensitive layer, a surface protective layer, an interlayer, an antihalation layer, and a subbing layer, all of which are placed on the photosensitive layer side of the support, and may be incorporated in at least two of the layers.

Further, as thioisocyanate based cross-linking agents usable in the present invention, compounds having a thioisocyanate structure corresponding to the isocyanates are also useful as thioisocyanate based cross-linking agents usable in the present invention.

The amount of the cross-linking agents employed in the present invention is in the range of 0.001 to 2.000 mol per mol of silver, and is preferably in the range of 0.005 to 0.500 mol.

Isocyanate compounds as well as thioisocyanate compounds, which may be incorporated in the present invention, are preferably those which function as the cross-linking agent. However, it is possible to obtain the desired results by employing compounds which have "v" of 0, namely compounds having only one functional group.

Examples of silane compounds which can be employed as a cross-linking agent in the invention are compounds represented by General formulas (1) to (3), described in JP-A No. 2001-264930.

Compounds, which can be used as a cross-linking agent, may be those having at least one epoxy group. The number of epoxy groups and corresponding molecular weight are not limited. It is preferable that the epoxy group be incorporated in the molecule as a glycidyl group via an ether bond or an imino bond. Further, the epoxy compound may be a monomer, an oligomer, or a polymer. The number of epoxy groups in the molecule is commonly from about 1 to about 10, and is preferably from 2 to 4. When the epoxy compound is a polymer, it may be either a homopolymer or a copolymer, and its number average molecular weight Mn is most preferably in the range of about 2,000 to about 20,000.

Acid anhydrides usable in the invention are compounds containing at least one acid anhydride group having a structure, as shown below:

—CO—O—CO—.

Any compound containing such at least one acid anhydride group is not limited with respect to the number of acid anhydride groups, molecular weight and others.

The foregoing epoxy compounds or acid anhydrides may be used singly or in combination. The addition amount is preferably $1\times10^{-6}$ to $1\times10^{-2}$ mol/m$^2$, and more preferably $1\times10^{-5}$ to $1\times10^{-3}$ mol/m$^2$. The epoxy compounds or acid anhydrides may be incorporated into any layer of the light-sensitive layer side, such as a light-sensitive layer, surface protective layer, an interlayer, an antihalation layer or a sublayer. The compounds may be incorporated into one or more of these layers.

Silver Saving Agent

A silver saving agent may be incorporated to the light-sensitive or light-insensitive layer. The silver saving agent refers to a compound which is capable of lessen a silver amount necessary to obtain a prescribed silver image density.

Various mechanisms of working have been assumed with respect to function of lessen the silver amount but a compound capable of enhancing covering power of developed silver is preferred. The covering power of developed silver refers to an optical density per unit amount of silver. Silver saving agents may be incorporated to a light-sensitive layer or a light-insensitive layer, or to both layers. Examples of a silver saving agent include a hydrazine derivative compound, a vinyl compound, a phenol compound, a naphthol compound, a quaternary onium compound and a silane compound.

Specific examples of the hydrazine derivative include compounds H-1 through H-29 described in U.S. Pat. No. 5,545,505, col. 1-20; compounds 1 through 12 described in U.S. Pat. No. 5,464,738, col. 9-11; and compounds H 1-1 through H 1-28, H 2-1 through H 2-9, H 3-1 through H-3-12, H 4-1 through H 4-21, and H-5-1 through H-5-5, described in JP-A No. 2001-27790.

Specific examples of the vinyl compound include compounds CN-01 through CN-13, described in U.S. Pat. No. 5,545,515, col. 13-14; compounds HET-01 through HET-02, described in U.S. Pat. No. 5,635,339, col. 10; compounds MA-01 through MA-07, described in U.S. Pat. No. 5,654,130, col. 9-10; compounds IS-01 through IS-04, described in U.S. Pat. No. 5,705,324, col. 9-10; and compounds 1-1 through 218-2, described in JP-A No. 2001-125224.

Specific examples of phenol and naphthol derivatives include compounds A-1 through A-89 described in JP-A No. 2000-267222, paragraph [0075]-[0078]; compounds A-1 through A-258 described in JP-A No. 2003-66558, paragraph [0025]-[0045].

Specific examples of the onium compound include triphenyltetrazolium.

Specific examples of the silane compound include an alkoxysilane compounds having a primary or secondary amino group, e.g., compounds A1 through A33, described in JP-A No. 2003-5324, paragraph [0027]-[0029].

A silver saving agent is contained in an amount of $1\times10^{-5}$ to 1 mol, preferably $1\times10^{-4}$ to $5\times10^{1}$ mol per mol of organic silver salt.

Specific examples of a preferred silver saving agent are shown below, but are not limited to these.

(SE1-1)

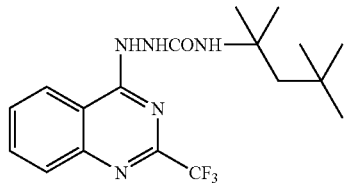

(SE1-2)

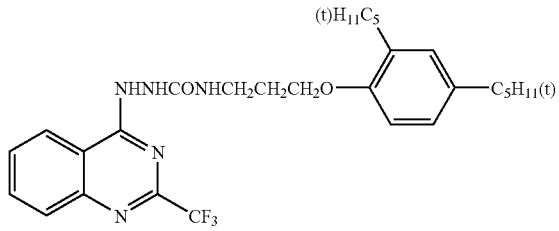

-continued (SE1-3)

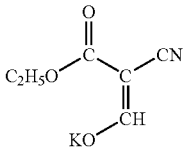

(SE1-4)

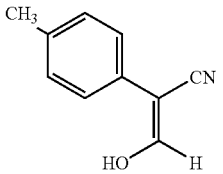

(SE1-5)

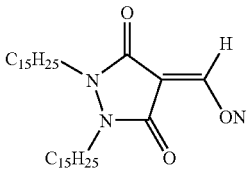

(SE1-6)

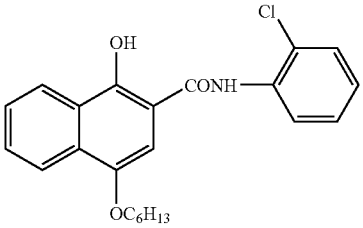

(SE1-7)

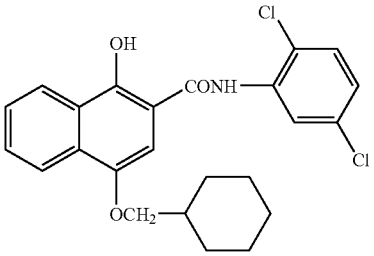

(SE1-8)

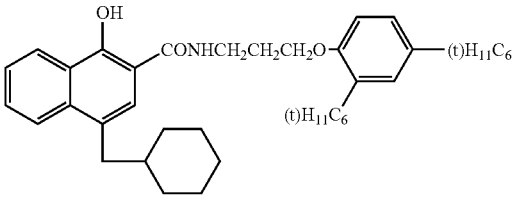

(SE1-9)

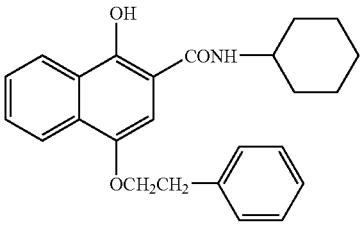

-continued (SE1-10)

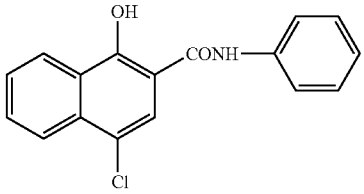

(SE1-11)

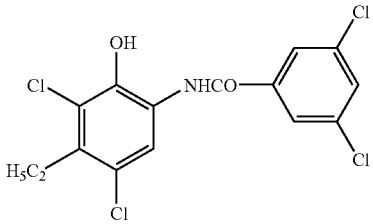

The photothermographic material of the invention preferably contains a thermal solvent. In the invention, the thermal is defined as a material capable of lowering the thermal developing temperature of a thermal solvent-containing photothermographic material by at least 1° C. (preferably at least 2° C., and more preferably at least 3° C.), as compared to a photothermographic material containing no thermal solvent. For example, a density obtained by developing a photothermographic material (B) containing no thermal solvent at 120° C. for 20 sec., can be obtained by developing a photothermographic material (A) in which a thermal solvent is added to the photothermographic material (B), at a temperature of 119° C. or less for the period of the same time as the photothermographic material (B).

A thermal solvent contains a polar group and is preferably a compound represented by the following formula (TS):

$$(Y)_nZ \qquad \text{formula (TS)}$$

wherein Y is a group selected from an alkyl group, an alkenyl group, an alkynyl group, an aryl group or a heterocyclic group; Z is hydroxyl, carboxyl, an amino group, an amide group, a sulfonamido group, a phosphoric acid amide, cyano, imide, ureido, sulfonoxide, sulfone, phosphine, phosphineoxide and nitrogen-containing heterocyclic group; n is an integer of 1 to 3, provided that when Z is a mono-valent, n is 1 and when Z has a valence of two or more, n is the same as a valence number of Z, and when n is 2 or more, Ys may be the same or different.

Y may be substituted and examples of a substituent may be the same as represented by Z described above. In the formula (TS), Y is a straight, branched or cyclic alkyl group (preferably having 1-40 carbon atoms, more preferably 1-30, still more preferably 1-25 carbon atoms, e.g., methyl, ethyl, propyl, isopropyl, sec-butyl, tert-butyl, t-octyl, n-amyl, t-amyl, n-dodecyl, n-tridecyl, octadecyl, icosyl, docosyl, cyclopentyl, cyclohexyl), alkenyl group (preferably having 2-40 carbon atoms, more preferably 2-30, still more preferably 2-25 carbon atoms, e.g., vinyl, allyl, 2-butenyl, 3-pentenyl), aryl group (preferably having 6-40 carbon atoms, more preferably 6-30, still more preferably 6-25 carbon atoms, e.g., phenyl, p-methylphenyl, naphthyl), heterocyclic group preferably having 2-20 carbon atoms, more preferably 2-16, still more preferably 2-12 carbon atoms, e.g., pyridyl, pyrazyl, imidazolyl, pyrrolidyl). These substituents may be substituted and substituents may combine with each other to form a ring.

Y may be substituted and as examples of a substituent are cited those described in JP-A No. 2004-21068, paragraph [0015]. It is assumed, as the reason for the use of a thermal solvent activating development that the thermal solvent melts at a temperature near a developing temperature and solubilizes a material participating in development, rendering a reaction feasible at a temperature lower than the case containing no thermal solvent. Thermal development is a reduction reaction in which a carboxylic acid having a relatively high polarity or a silver ion carrier is involved. It is therefore preferred that a reaction field exhibiting an appropriate polarity is formed by a thermal solvent having a polar group.

The melting point of a thermal solvent is preferably 50 to 200° C., and more preferably 60 to 150° C. The melting point is preferably 100 to 150° C. specifically in a photothermographic material which places primary importance on stability to external environments, such as image fastness.

Specific examples of a thermal solvent include compounds described in JP-A No. 2004-21068, paragraph [0017] and compounds MF-1 through MF-3, MF-6, MF-7, MF-9 through MF-12 and MF-15 through MF-22.

A thermal solvent is contained preferably at 0.01 to 5.0 g/m$^2$, more preferably 0.05 to 2.5 g/m$^2$, and still more preferably 0.1 to 1.5 g/m$^2$. Thermal solvents may be contained singly or in combination thereof. A thermal solvent may be added to a coating solution in any form, such as a solution, emulsion or solid particle dispersion.

There is known a method in which a thermal solvent is dissolved using oil such as dibutyl phthalate, tricresyl phosphate, glyceryl triacetate or diethyl phthalate, and optionally an auxiliary solvent such as diethyl acetate or cyclohexanone, and is mechanically dispersed to obtain an emulsified dispersion.

Solid particle dispersion is prepared by dispersing powdery thermal solvent in an appropriate solvent such as water using a ball mill, a colloid mill, a vibration ball mill, a jet mill, a roller mill or a ultrasonic homogenizer. A protective colloid (e.g., polyvinyl alcohol), a surfactant (e.g., anionic surfactants such as sodium triisopropylnaphthalenesulfonate) may be used therein. In the foregoing mills, beads such as zirconia are usually used. Zr or the like is sometime dissolved out and mixed in the dispersion within a range of 1 to 1,000 ppm, depending dispersing conditions. A Zr content of 0.5 g or less per g of silver is acceptable to practical use. Aqueous dispersion preferably contains an antiseptic (e.g., benzoisothiazolinone sodium salt)

Antifoggant and Image Stabilizer

Any component layer of the photothermographic material of the invention preferably contains an antifoggant to inhibit fogging caused before being thermally developed and an image stabilizer to prevent deterioration of images after being thermally developed.

Next, there will be described an antifoggant and an image stabilizer usable in the photothermographic material of the invention.

Since bisphenols and sulfonamidophenols which contain a proton are mainly employed as a reducing agent, incorporation of a compound which generates reactive species capable of abstracting hydrogen is preferred to deactivate the reducing agent. It is also preferred to include a compound capable of oxidizing silver atoms or metallic silver (silver cluster) generated during storage of raw film or images. Specific examples of a compound exhibiting such a function include biimidazolyl compounds and iodonium compounds. The foregoing biimidazolyl compounds or iodonium compound is incorporated preferably in an amount of 0.001 to 0.1 mol/m$^2$ and more preferably 0.005 to 0.05 mol/m$^2$.

In cases when a reducing agent used in the invention is a compound containing an aromatic hydroxyl group, specifically bisphenols, it is preferred to use a non-reducible compound capable of forming a hydrogen bond with such a group, for example, compounds (II-1) to (II-40) described in JP-A No. 2002-90937, paragraph [0061]-[0064].

A number of compounds capable of generating a halogen atom as reactive species are knows as an antifoggant or an image stabilizer. Specific examples of a compound generating an active halogen atom include compounds of formula (9) described in JP-A No. 2002-287299, paragraph [0264]-[0271]. These compounds are incorporated preferably at an amount within the range of an increase of printed-out silver formed of silver halide being ignorable. Thus, the ratio to a compound forming no active halogen radical is preferably at most 150%, more preferably at most 100%. Specific examples of a compound generating active halogen atom include compounds (III-1) to (III-23) described in paragraph [0086]-[0087] of JP-A NO. 2002-169249; compounds 1-1a to 1-1o, and 1-2a to 1-2o described in paragraph [0031] to [0034] and compounds 2a to 2z, 2aa to 211 and 2-1a to 2-1f described in paragraph [0050]-[0056] of JP-A No. 2003-50441; and compound 4-1 to 4-32 described in paragraph [0055] to [0058] and compounds 5-1 to 5-10 described in paragraph [0069] to [0072] of JP-A No. 2003-91054.

Examples of preferred antifoggants usable in the invention include compounds a to j described in [0012] of JP-A No. 8-314059, thiosufonate esters A to K described in [0028] of JP-A No. 7-209797, compounds (1) to (44) described on page 14 of JP-A No.55-140833, compounds (I-1) to (I-6) described in [0063] and compounds (C-1) to (C-3) described in [0066] of JP-A No.2001-13627, compounds (III-1) to )III-108) described in [0027] of JP-A No. 2002-90937, vinylsulfone and/or β-halosulfone compounds VS-1 to VS-7 and HS-1 to HS-5 described in [0013] of JP-A No. 6-208192, sulfonylbenzotriazole compounds KS-1 to KS-8 described in JP-A No. 200-330235, substituted propenenitrile compounds PR-01 to PR-08 described in JP-A No. 2000-515995 (published Japanese translation of PCT international publication for patent application) and compounds (1)-1 to (1)-132 described in [0042] to [0051] of JP-A No. 2002-207273. The foregoing antifoggant is used usually in an amount of at least 0.001 mol per mol of silver, preferably from 0.01 to 5 mol, and more preferably from 0.02 to 0.6 mol.

Compounds commonly known as other than the foregoing compounds may be contained in the photothermographic material of the invention, which may be a compound capable of forming a reactive species or a compound exhibiting a different mechanism of antifogging. Examples of such compounds include those described in U.S. Pat. Nos. 3,589,903, 4,546,075 and 4,452,885; JP-A No. 59-57234; U.S. Pat. Nos. 3,874,946 and 4,756,999; JP-A No. 59-57234, 9-188328 and 9-90550. Further, other antifoggants include, for example, compounds described in U.S. Pat. No. 5,028,523 and European Patent No. 600,587, 605,981 and 631,176.

Toning Agent

The photothermographic material of the invention forms a photographic image upon thermal development and preferably contains an image toning agent to control image color in the form of dispersion in (organic binder matrix.

Examples of suitable image toning agents are described in RD 17029, U.S. Pat. Nos. 4,123,282, 3,994,732 and 4,021,249. Specific examples include imides (e.g. succinimide, phthalimide, naphthalimide, N-hydroxy-1,8-naphthalimide), mercaptans (e.g., 3-mercapto-1,24-triazole), phthalazinone derivatives and their metal salts (e.g., phthalazinone, 4-(1-naphthyl)phthalazinone, 6-chlorophthalazinone, 5,7-dimethyloxyphthalazinone, 2,3-dihydroxy1,4-phthalazine-dione), combination of phthalazine and phthalic acids (e.g., phthalic acid, 4-methylphthalic acid, 4-nitrophthalic acid, tetrachlorophthalic acid); combination of phthalazine and a compound selected from maleic acid anhydride, phthalic acid, 2,3-naphthalenedicarboxylic acid and o-phenylene acid derivatives and their anhydrides (e.g., phthalic acid, 4-methylpthalic acid, 4-nitrophthalic acid, tetrachlorophthalic acid anhydride). Of these, a specifically preferred image toning agent is a combination of phthalazinone or phthalazine, and phthalic acids or phthalic acid anhydrides.

Radiation Absorption Compound

Various kinds of dyes and pigments known in the art are usable as radiation-absorbing compounds used in the layer provided on the light-sensitive layer side or the layer provided on the side opposite the light-sensitive layer. Such dyes and pigments include those described in Color Index, for example, pyrazoloazole dyes, anthraquinone dyes, azo dyes, azomethine dyes, oxonol dyes, carbocyanine dyes, styryl dyes, triphenylmethane dyes, indoaniline dyes, indophenol dyes, organic pigments such as phthalocyanine and inorganic pigments.

Examples of preferred dyes used in the invention include anthraquinone dyes (e.g., compounds 1-9 described in JP-A No. 5-341441, compounds 3-6 to 3-18 and 3-23 to 3-38 described in JP-A No. 5-165147), azomethine dyes (e.g., compounds 17-47, described in JP-A No. 5-289227), indoaniline dyes (e.g., compounds 11-19, described in JP-A No.5-289227, compound 47 described in JP-A No. 5-341441, compounds 2-10 to 2-11, described in JP-A No. 5-165147), and azo dyes (e.g., compounds 10-16, described in JP-A No. 5-341441).

When the photothermographic material of the invention is applied as an image recording material using infrared light, for instance, squarilium dyes containing a thiopyrylium nucleus and squarilium dyes containing a pyrylium nucleus, thiopyrylium chroconium similar to squarilium dyes, and pyrylium chroconium dyes are preferable. A compound containing a squarilium nucleus refers to a compound containing 1-cyclobutene-hydroxy-4-one in the molecular structure, and a compound containing a chroconium nucleus refers to 1-cyclopentene-2-hydroxy-4,5-dione in the molecular structure, in which the hydroxy group may be dissociated. Preferred examples of such dyes include compounds described in JP-A No. 8-201959, compound described in Japanese translation of PCT International Patent Application Publication No. 9-509503, and compounds AD-1 to AD-55 described in JP-A No. 2003-195450.

When the photothermographic material of the invention is employed as an image recording material using blue light, there are preferably used compounds Nos. 1-93 described in JP-A No. 2003-215751 and Dye-1 to Dye-51 described in JP-A No. 2005-157245.

These dyes or compounds described above can be incorporated by any means, for instance, in the form of a solution, emulsion or solid particle dispersion, or in a state mordanted by mordants. These dyes or compounds are used in amounts depending on the objective absorption amount, but preferably in the range from 1 μg to 1 g per $m^2$ of the photothermographic material.

In the photothermographic material of the invention, it is preferred that radiation-absorbing compounds (dyes or pigments) are contained in a layer provided on the light-sensitive layer side of the support, for example, a sublayer, light-sensitive layer, interlayer or protective layer (preferably, light-sensitive layer) and are set so as to have an absorbance of 0.40 to 0.90 (preferably, 0.50 to 0.80) at absorption wavelengths of the whole layers described above, and radiation-absorbing compounds (dyes or pigments) are contained in a layer provided on the opposite side of the support to the light-sensitive layer, for example, an antistatic sublayer, antihalation layer, or protective layer and are set so as to have an absorbance of 0.30 to 1.20, and preferably 0.40 to 1.00 at absorption wavelengths of the whole layers described above. An absorbance falling within the range described above can improve density variation caused along with image quality or humidity change, even when using resin lenses in an exposure system.

Support

Suitable supports used in the photothermographic imaging materials of the invention include various polymeric materials, glass, wool cloth, cotton cloth, paper, and metals (such as aluminum). Flexible sheets or roll-convertible one are preferred. Examples of preferred support used in the invention include plastic resin films such as cellulose acetate film, polyester film, polyethylene terephthalate film, polyethylene naphthalate film, polyamide film, polyimide film, cellulose triacetate film and polycarbonate film, and biaxially stretched polyethylene terephthalate (PET) film is specifically preferred. The support thickness is 50 to 300 μm, and preferably 70 to 180 μm.

To improve electrification properties of photothermographic imaging materials, metal oxides and/or conductive compounds such as conductive polymers may be incorporated into the constituent layer. These compounds may be incorporated into any layer and preferably into a sublayer, a backing layer, interlayer between the light sensitive layer and the sublayer. Conductive compounds described in U.S. Pat. No. 5,244,773, col. 14-20. Specifically, the surface protective layer of the backing layer side preferably contains conductive metal oxides.

The conductive metal oxide is crystalline metal oxide particles, and one which contains oxygen defects or one which contains a small amount of a heteroatom capable of forming a donor for the metal oxide, both exhibit enhanced conductivity and are preferred. The latter, which results in no fogging to a silver halide emulsion is preferred. Examples of metal oxide include ZnO, $TiO_2$, $SnO_2$, $Al_2O_3$, $In_2O_3$, $SiO_2$, MgO, BaO, $MoO_3$ and $V_2O_5$ and their combined oxides. Of these, ZnO, $TiO_2$ and $SnO_2$ are preferred. As an example of containing a heteroatom, addition of Al or In to ZnO, addition of Sb, Nb, P or a halogen element to $SnO_2$, and addition of Nb or Ta to $TiO_2$ are effective. The heteroatom is added preferably in an amount of 0.01 to 30 mol %, and more preferably 0.1 10 mol %. To improve particle dispersibility and transparency, a silicon compound may be added in the course of particle preparation.

The metal oxide particles have electric conductivity, exhibiting a volume resistance of $10^7$ Q·cm or less and preferably $10^5$ Q·cm or less. The foregoing metal oxide may be adhered to other crystalline metal oxide particles or fibrous material (such as titanium oxide), as described in JP-A Nos. 56-143431, 56-120519 and 58-62647 and JP-B No. 50-6235.

The particle size usable in the invention is preferably not more than 1 μm, and a particle size of not more than 0.5 μm results in enhanced stability after dispersion, rendering it easy to make use thereof. Employment of conductive particles of 0.3 μm or less enables to form a transparent photothermographic material. Needle-form or fibrous conductive metal oxide is preferably 30 μm or less in length and 1 μm or less in diameter, and more preferably 10 μm or less in length and 0.3 μm or less in diameter, in which the ratio of length to diameter is preferably 3 or more. $SnO_2$ is also commercially available from Ishihara Sangyo Co., Ltd., including SNS10M, SN-100P, SN-100D and FSS10M.

Constitution Layer

The photothermographic material of the invention is provided with at least one light-sensitive layer as a light-sensitive layer on the support. There may be provided an light-sensitive layer alone on the support but it is preferred to form at least one light-insensitive layer on the light-sensitive layer. For instance, a protective layer may be provided on the light-sensitive layer to protect the light-sensitive layer. Further, to prevent blocking between photothermographic materials or adhesion of the photothermographic material to a roll, a back-coat layer may be provided on the opposite side of the support.

A binder used in the protective layer or the back coat layer can be chosen preferably from polymers having a higher glass transition point (Tg) than a binder used in the light-sensitive layer and exhibiting resistance to abrasion or deformation, for example, cellulose acetate, cellulose butyrate or cellulose propionate.

To control gradation, at least two light-sensitive layers may be provided on one side of the support or at least one light-sensitive layer may be provided on both sides of the support.

Coating of Constitution Layer

It is preferable to prepare the silver salt photothermographic dry imaging material of the present invention as follows. Materials of each constitution layer as above are dissolved or dispersed in solvents to prepare coating compositions. Resultant coating compositions are subjected to simultaneous multilayer coating and subsequently, the resultant coating is subjected to a thermal treatment. "Simultaneous multilayer coating", as described herein, refers to the following. The coating composition of each constitution layer (for example, a photosensitive layer and a protective layer) is prepared. When the resultant coating compositions are applied onto a support, the coating compositions are not applied onto a support in such a manner that they are individually applied and subsequently dried, and the operation is repeated, but are simultaneously applied onto a support and subsequently dried. Namely, before the residual amount of the total solvents of the lower layer reaches 70 percent by weight, the upper layer is applied.

Simultaneous multilayer coating methods, which are applied to each constitution layer, are not particularly limited. For example, are employed methods, known in the art, such as a bar coater method, a curtain coating method, a dipping method, an air knife method, a hopper coating method, and an extrusion method. Of these, more preferred is the pre-weighing type coating system called an extrusion coating method. The extrusion coating method is suitable for accurate coating as well as organic solvent coating because volatilization on a slide surface, which occurs in a slide coating system, does not occur. Coating methods have been described for coating layers on the photosensitive layer side. However, the backing layer and the subbing layer are applied onto a support in the same manner as above.

In the invention, silver coverage is preferably from 0.3 to 1.5 g/m$^2$, and is more preferably from 0.5 to 1.5 g/m$^2$ for use in medical imaging. The ratio of the silver coverage which is resulted from silver halide is preferably from 2% to 18% with respect to the total silver, and is more preferably from 5% to 15%. Further, in the present invention, the number of coated silver halide grains, having a grain diameter (being a sphere equivalent grain diameter) of at least 0.01 μm, is preferably from $1\times10^{14}$ to $1\times10^{18}$ grains/m$^2$, and is more preferably from $1\times10^{15}$ to $1\times10^{17}$. Further, the coated weight of aliphatic carboxylic acid silver salts of the present invention is from $10^{-17}$ to $10^{-14}$ g per silver halide grain having a diameter (being a sphere equivalent grain diameter) of at least 0.01 μm, and is more preferably from $10^{-16}$ to $10^{-15}$ g. When coating is carried out under conditions within the aforesaid range, from the viewpoint of maximum optical silver image density per definite silver coverage, namely covering power as well as silver image tone, desired results are obtained.

The photothermographic material of the invention contains solvent preferably at 5 to 1,000 mg/m$^2$ when subjected to thermal development, and more preferably 100 to 500 mg/m$^2$, thereby leading to enhanced sensitivity, reduced fogging and enhanced maximum density. Examples of such a solvents are described, for instance, in JP-A No. 2001-264936, paragraph [0030] but are not limited to thereto. The solvent may be used singly or in combination.

The solvent content in the photothermographic material can be controlled by adjusting conditions in the drying stage after coating, for example, temperature conditions. The solvent content can be determined by gas chromatography under the condition suitable for detection of contained solvents.

Packaging Material

There will be described packaging methods of sheet-form recording materials and a package of a sheet-form recording material, used in the invention.

In the invention, the process of cutting and packaging is conducted preferably under an environment at an air cleanliness degree of 10,000 or less of U.S. Standard 209d class, whereby internal staining in a thermal processor during thermal processing is markedly improved. The reason therefor is not clear but it is assumed as below. Chips or dust particles carried-in from the cutting and packaging process and adhered to photothermographic material are subsequently adhered to transporting members such as rollers in the thermal processor and accumulated therein, causing internal staining.

The U.S. Standard 209d class indicates to a standard of a clean room and the environment at an air cleanliness degree of 10,000 or less of U.S. Standard 209d class refers to an environment in which the cumulative number of particles having a size of 0.5 μm or more is not more than 10,000/ft$^3$ (=28,317 cm$^3$) and the cumulative number of particles having a size of more than 0.5 μm is not more than 65 particles/ft$^3$.

An environment meeting the above conditions may be formed in a clean room but the method of the invention is not limited to embodiments in such a clean room. It is not necessarily required to place the overall apparatus for cutting and packaging of sheet-form recording material in a clean room to perform working. For instance, a mechanism to blow air flow onto the sheet-form recording material is provided in an apparatus cutting to packaging and work is performed with maintaining the environment at an air cleanliness degree of 10,000 or less of U.S. Standard 209d class.

It is necessary to maintain an environment at an air cleanliness degree of 10,000 or less of U.S. Standard 209d class during at least one of the cutting step and the packaging step. Preferably, the cutting step is conducted in an environment at an air cleanliness degree of 10,000 or less of U.S. Standard 209d class, and more preferably, both the cutting step and the packaging step are each conducted in an environment at an air cleanliness degree of 10,000 or less of U.S. Standard 209d class.

The cutting step in the invention refers to a step of cutting sheet-form recording material to a prescribed size or to a commonly used size (e.g., A4 size or a size of 34.5×43.0 cm). The number of times for cutting is not limited, which may be a single operation or plural ones. Cutting may be done all together in the longitudinal direction to form a stripe-form recording material and then cutting it in the cross direction is conducted to the prescribed size. There are not specifically limited cutting means or cutting devices used for cutting.

In cases when a sheet form recording material is mounted in an image recording apparatus, the packaging step in the invention means a process including a step of packaging the sheet form recording material. In cases when a load of sheet form recording material is mounted in an image recording apparatus, the packaging step is a process including the step of packaging the sheet form recording material. Thus, it refers to a step of packaging sheet form recording material or a load of sheet form recording material. There are not specifically limited packaging means or the packaging device.

The air cleanliness degree in the course from the cutting step to the packaging step is not necessarily 10,000 or less of U.S. Standard 209d class but it is preferred to maintain an environment at an air cleanliness degree of 10,000 or less of U.S. Standard 209d class. Similar conditions are preferred during the course until cutting manufactured sheet form recording material.

The air cleanliness degree in the cutting step is preferably in class of 7,000 or less in the measurement method in accordance with the U.S. Standard 209*d,* more preferably 4,000 or less, still more preferably 1,000 or less, and 500 or less is specifically preferred. The air cleanliness degree in the packaging step is preferably a class of 7,000 or less in the measurement method in accordance with the U.S. Standard 209*d,* more preferably 4,000 or less, still more preferably 1,000 or less, and 500 or less is specifically preferred.

In the invention, a packaging material used for packaging sheets of recording material is chosen from materials barely generating dust. In the case when dust due to packaging material renders it difficult to maintain the cleanliness degree at a level of 10,000 or less of U.S. Standard 209d class, it is preferred not to choose such packaging material.

To prevent density change or fogging with time during storage or to reduce curl or roll-set curl, it is preferred to pack the photothermographic material of the invention with a packaging material exhibiting a low oxygen permeability and/or moisture permeability.

The oxygen permeability is preferably not more than 50 ml/atm·m$^2$·day, more preferably not more than 10 ml/atm·m$^2$·day, and still more preferably not more than 1.0 ml/atm·m$^2$·day.

The moisture permeability is preferably not more than 0.01 g/m$^2$·40° C.·90% RH·day (in accordance with JIS Z0208, Cap Method), more preferably not more than 0.005 g/m$^2$·40° C.·90% RH·day, and still more preferably not more than 0.001 g/m$^2$·40° C.·90% RH·day.

Specific examples of packaging material include those described in JP-A Nos. 8-254793, 2000-206653, 2000-235241, 2002-062625, 2003-015261, 2003-057790, 2003-084397, 2003-098648, 2003-098635, 2003-107635, 2003-131337, 2003-146330, 2003-226439 and 2003-228152. The free volume within a package is preferably 0.01 to 10%, and preferably 0.02 to 5%, and it is also preferred to fill nitrogen within the package at a nitrogen partial pressure of at least 80%, preferably at least 90%. The relative humidity within the package is preferably 10% to 60%, and more preferably 40% to 55%.

EXAMPLES

The present invention will be further described based on examples but is by no means limited to these. Unless specifically noted, "%" designates percent by weight.

Example 1

Preparation of Subbed Photographic Support

A photographic support comprised of a 175 μm thick biaxially oriented polyethylene terephthalate film with blue tinted at an optical density of 0.170 (determined by Densitometer PDA-65, manufactured by Konica Corp.), which had been subjected to corona discharge treatment of 8 W·minute/m$^2$ on both sides, was subjected to subbing. Namely, subbing liquid coating composition a-1 was applied onto one side of the above photographic support at 22° C. and 100 m/minute to result in a dried layer thickness of 0.2 μm and dried at 140° C., whereby a subbing layer on the light-sensitive layer side (designated as Subbing Layer A-1) was formed. Further, subbing liquid coating composition b-1 described below was applied, as a backing layer subbing layer, onto the opposite side at 22° C. and 100 m/minute to result in a dry layer thickness of 0.12 μm and dried at 140° C. An electrically conductive subbing layer (designated as subbing lower layer B-1), which exhibited an antistatic function, was applied onto the backing layer side. The surface of subbing lower layer A-1 and subbing lower layer B-1 was subjected to corona discharge treatment of 8 W·minute/m$^2$. Subsequently, subbing liquid coating composition a-2 was applied onto subbing lower layer A-1 was applied at 33° C. and 100 m/minute to result in a dried layer thickness of 0.03 μm and dried at 140° C. The resulting layer was designated as subbing upper layer A-2. Subbing liquid coating composition b-2 described below was applied onto subbing lower layer B-1 at 33° C. and 100 m/minute to results in a dried layer thickness of 0.2 μm and dried at 140° C. The resulting layer was designated as subbing upper layer B-2. Thereafter, the resulting support was subjected to heat treatment at 123° C. for two minutes and wound up under the conditions of 25° C. and 50 percent relative humidity, whereby a subbed sample was prepared.

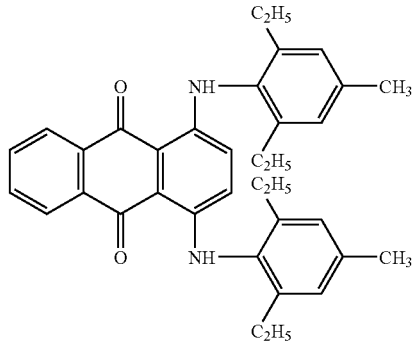

Blue dye

Preparation of Hydrophilic Polyester A-1

A mixture consisting of 35.4 parts by weight of dimethyl terephthalate, 33.63 parts by weight of dimethyl isophthalate, 17.92 parts by weight of sodium salt of dimethyl 5-sulfoisophthalate, 62 parts by weight of ethylene glycol, 0.065 part by weight of calcium acetate monohydrate, and 0.022 part by weight of manganese acetate tetrahydrate underwent trans-esterification at 170 to 220° C. under a flow of nitrogen while distilling out methanol. Thereafter, 0.04 parts by weight of trimethyl phosphate, 0.04 part by weight of antimony trioxide, and 6.8 parts by weight of 4-cyclohexanedicarboxylic acid were added. The resulting mixture underwent esterification at a reaction temperature of 220 to 235° C. while a nearly theoretical amount of water being distilled away. Thereafter, the reaction system was subjected to pressure reduction and heating over a period of one hour and was subjected to polycondensation at a final temperature of 280° C. and a maximum pressure of 133 Pa for one hour, whereby water-soluble polyester A-1 was synthesized. The intrinsic viscosity of the resulting water-soluble polyester A-1 was 0.33, the average particle size was 40 nm, and Mw was 80,000 to 100,000.

Subsequently, 850 ml of pure water was placed in a 2-liter three-necked flask fitted with stirring blades, a refluxing cooling pipe, and a thermometer, and while rotating the stirring blades, 150 g of water-soluble polyester A-1 was gradually added. The resulting mixture was stirred at room temperature for 30 minutes without any modification. Thereafter, the interior temperature was raised to 98° C. over a period of 1.5 hours and at that resulting temperature, dissolution was performed. Thereafter, the temperature was lowered to room temperature over a period of one hour and the resulting product was allowed to stand overnight, whereby hydrophilic polyester A-1 solution was prepared.

Preparation of Modified Hydrophilic Polyester Solution

Into a 3-liter four-necked flask fitted with stirring blades, a reflux cooling pipe, a thermometer, and a dropping funnel was put 1,900 ml of the aforesaid 15 percent by weight water-based polyester A-1 solution, and the interior temperature was raised to 80° C., while rotating the stirring blades. Into this was added 6.52 ml of a 24 percent aqueous ammonium peroxide solution, and a monomer mixed liquid composition (consisting of 28.5 g of glycidyl methacrylate, 21.4 g of ethyl acrylate, and 21.4 g of methyl methacrylate) was dripped over a period of 30 minutes, and reaction was allowed for an additional 3 hours. Thereafter, the resulting product was cooled to at most 30° C., and filtrated, whereby modified water-based polyesters solution B-1 (vinyl based component modification ratio of 20 percent by weight) of 18 wt % solid was obtained.

Subsequently, modified polyester B-2 at a solid concentration of 18 percent by weight (a vinyl based component modification ratio of 20 percent by weight) was prepared in the same manner as above except that the vinyl modification ratio was changed to 36 percent by weight and the modified component was changed to styrene:glycidyl methacrylate:acetacetoxyethyl methacrylate:n-butyl acrylate=39.5:40:20:0.5.

Preparation of Acryl Polymer Latexes C-1 to C-3

Acryl polymer latexes C-1 to C-3 having the monomer compositions shown in Table 1 were synthesized employing emulsion polymerization. All the solid concentrations were adjusted to 30 percent by weight.

TABLE 1

| Latex No. | Monomer Composition (weight ratio) | Tg (° C.) |
|---|---|---|
| C-1 | styrene:glycidyl methacrylate:n-butyl acrylate = 20:40:40 | 20 |
| C-2 | styrene:n-butyl acrylate:t-butyl acrylate:hydroxyethyl methacrylate = 27:10:35:28 | 55 |
| C-3 | styrene:glycidyl methacrylate:acetoacetoxyethyl methacrylate = 40:40:20 | 50 |

| Coating Composition (a-1) of Subbing Lower Layer A-1 on Light-sensitive layer Side | |
|---|---|
| Acryl Polymer Latex C-3 (30% solids) | 70.0 g |
| Aqueous dispersion of ethoxylated alcohol and ethylene homopolymer (10% solids) | 5.0 g |
| Surfactant (A) | 0.1 g |
| Distilled water to make | 1000 ml |

| Coating composition (a-2) of Light-sensitive layer Side Subbing Upper Layer | |
|---|---|
| Modified Water-based Polyester B-2 (18 wt %) | 30.0 g |
| Surfactant (A) | 0.1 g |
| Spherical silica matting agent (Sea Hoster KE-P50, manufactured by Nippon Shokubai Co., Ltd.) | 0.04 g |
| Distilled water to make | 1000 ml |

| Coating Composition (b-1) of Backing Layer Side Subbing Lower Layer | |
|---|---|
| Acryl Based Polymer Latex C-1 (30% solids) | 30.0 g |
| Acryl Based Polymer Latex C-2 (30% solids) | 7.6 g |
| $SnO_2$ sol* | 180 g |
| Surfactant (A) | 0.5 g |
| Aqueous 5 wt. % PVA-613 (PVA, manufactured by Kuraray Co., Ltd.) | 0.4 g |
| Distilled water to make | 1000 ml |

*The solid concentration of $SnO_2$ sol synthesized employing the method described in Example 1 of JP-B No. 35-6616 was heated and concentrated to reach a solid concentration of 10 percent by weight, and subsequently, the pH was adjusted to 10 by the addition of ammonia water.

| Coatings Composition (b-2) of Backing Layer Side Subbing Upper Layer | |
|---|---|
| Modified Water-based Polyester B-1 (18% by weight) | 145.0 g |
| Spherical silica matting agent (Sea Hoster KE-P50, manufactured by Nippon Shokubai Co., Ltd.) | 0.2 g |
| Surface Active Agent (A) | 0.1 g |
| Distilled water to make | 1000 ml |

On the subbing layer A-2 on the subbed support, a back coat layer and a protective layer of the back coat layer having the following composition were coated.

Surfactant (A)

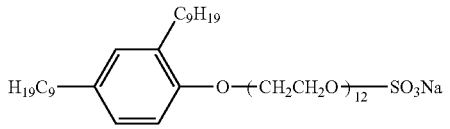

Preparation of Coating Solution of Back Coat Layer

Into 830 g of methyl ethyl ketone (also denoted simply as MEK), 84.2 g of cellulose acetate propionate (CAP482-20, available form Eastman Chemical Co.) and 4.5 g of polyester resin (Vitel PE2200B, available from Bostic Co.) were added and dissolved with stirring. Subsequently, to this solution, 0.30 g of the following infrared dye 1 was added and further thereto, 4.5 g of a fluorinated surfactant (Surflon KH40, available from Asahi Glass Co., Ltd.) and 2.3 g of a fluorinated surfactant Megafac F120K, available from Dainippon Ink Co., Ltd.) which were dissolved in 43.2 g of methanol, were added and sufficiently stirred until dissolved. Then, 2.5 g of oleyl oleate was added with stirring to prepare a coating solution of the back coat layer.

Infrared dye 1

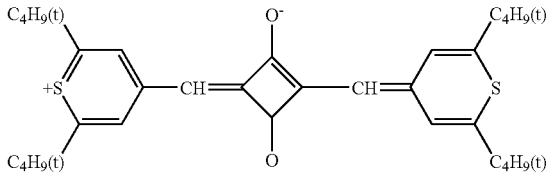

Preparation of Coating Solution of Back Coat Protective Layer

Similarly to the foregoing coating solution of the back coat layer, a coating solution of the protective layer for the back coat layer was prepared according to the following composition, in which silica was dispersed in MEK at a concentration of 1% using a dissolver type homogenizer and finally added.

| | |
|---|---|
| Cellulose acetate propionate (10% MEK solution CAP482-20 | 15 g |
| Matting agent (compound, average particle size and amount, as shown in Table 2) | 0.03 g |
| $C_8F_{17}(CH_2CH_2O)_{12}C_8F_{17}$ | 0.075 g |
| Fluorinated surfactant (Table 2) | 0.01 g |
| Fluoropolymer (FM-1) | 0.05 g |
| Lubricant (Table 2) | 0.1 g |
| α-alumina (Mobs hardness 9) | 0.1 g |

FM-1

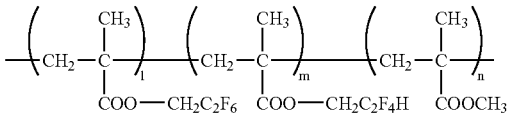

l:m:n = 48:17:35 (molar ratio)
Tg: 87-97° C.

| Preparation of Silver Halide Emulsion A1 | |
|---|---|
| **Solution A1** | |
| Phenylcarbamoyl-modified gelatin | 88.3 g |
| Compound (AO-1) (10% aqueous methanol solution) | 10 ml |
| Potassium bromide | 0.32 g |
| Water to make | 5429 ml |
| **Solution B1** | |
| 0.67 mol/L aqueous silver nitrate solution | 2635 ml |
| **Solution C1** | |
| Potassium bromide | 50.69 g |
| Potassium iodide | 2.66 g |
| Water to make | 660 ml |
| **Solution D1** | |
| Potassium bromide | 151.6 g |
| Potassium iodide | 7.67 g |
| Potassium hexachloroiridate (IV) (1% aqueous solution) | 0.93 ml |

-continued

| Preparation of Silver Halide Emulsion A1 | |
|---|---|
| Potassium hexacyanoiron (II) | 0.004 g |
| Potassium hexachloroosmium (IV) | 0.004 g |
| Water to make | 1982 ml |
| **Solution E1** | |
| Aqueous 0.4 mol/L potassium bromide solution in an amount to control silver potential | |
| **Solution F1** | |
| Potassium hydroxide | 0.71 g |
| Water to make | 20 ml |
| **Solution G1** | |
| 56% aqueous acetic acid solution | 18.0 ml |
| **Solution H1** | |
| Sodium carbonate anhydride | 1.72 g |
| Water to make | 151 ml |

AO-1: Compound (AO-1): $HO(CH_2CH_2O)_n(CH(CH_3)CH_2O)_{17}(CH_2CH_2O)_mH$
(m + n = 5 to 7)

Upon employing a mixing stirrer shown in JP-B No. 58-58288, 1/4 portion of solution B1 and whole solution C1 were added to solution A1 over 4 minutes 45 seconds, employing a double-jet precipitation method while adjusting the temperature to 20° C. and the pAg to 8.09, whereby nuclei were formed. After one minute, whole solution F1 was added. During the addition, the pAg was appropriately adjusted employing Solution E1. After 6 minutes, 3/4 portions of solution B1 and whole solution D1 were added over 14 minutes 15 seconds, employing a double-jet addition method while adjusting the temperature to 20° C. and the pAg to 8.09. After stirring for 5 minutes, the mixture was heated to 40° C., and whole solution G1 was added, whereby a silver halide emulsion was flocculated. Subsequently, while leaving 2000 ml of the flocculated portion, the supernatant was removed, and 10 L of water was added. After stirring, the silver halide emulsion was again flocculated. While leaving 1,500 ml of the flocculated portion, the supernatant was removed. Further, 10 L of water was added. After stirring, the silver halide emulsion was flocculated. While leaving 1,500 ml of the flocculated portion, the supernatant was removed. Subsequently, solution H1 was added and the resultant mixture was heated to 60° C., and then stirred for an additional 120 minutes. Finally, the pH was adjusted to 5.8 and water was added so that the weight was adjusted to 1,161 g per mol of silver, whereby a light-sensitive silver halide emulsion A1 (hereinafter, also denoted as AgX A1) was prepared.

The prepared emulsion was comprised of monodisperse cubic silver iodobromide grains (iodide content 3.5 mol %) having an average grain size of 25 nm, 12% of a coefficient of variation of grain size (hereinafter, also denoted as a grain size variation coefficient) and a (100) crystal face ratio of 92%.

Preparation of Silver Halide Emulsion A2

Similarly to the foregoing silver halide emulsion A1, light-sensitive silver halide emulsion A2 (also denoted as AgX A2) was prepared, except that after adding the total amount of solution F1 after nucleation, 40 ml of an 4% aqueous solution of 4-hydroxy-6-methyl-1,3,3a,7-tetrazaindene was added.

The prepared emulsion was comprised of monodisperse cubic silver iodobromide grains (iodide content 3.5 mol %) having an average grain size of 25 nm, a grain size variation coefficient of 12% and a (100) crystal face ratio of 92%.

Preparation of Silver Halide Emulsion A3

Similarly to the foregoing silver halide emulsion A1, light-sensitive silver halide emulsion A3 (also denoted as AgX A3) was prepared, except that after nucleation, the total amount of solution F1 was added and then, 4 ml of a 1% ethanol solution of the following compound (TPPS) was added thereto. The prepared emulsion was comprised of monodisperse cubic silver iodobromide grains (iodide content 3.5 mol %) having an average grain size of 25 nm, a grain size variation coefficient of 12% and a (100) crystal face ratio of 92%.

TPPS

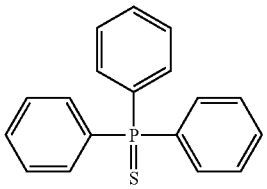

Preparation of Silver Halide Emulsion B1

Similarly to the foregoing silver halide emulsion A1, light-sensitive silver halide emulsion B1 was prepared, except that the double jet addition was conducted at 40° C. The prepared emulsion (also denoted as AgX B1) was comprised of monodisperse cubic silver iodobromide grains (iodide content 3.5 mol %) having an average grain size of 55 nm, a grain size variation coefficient of 12% and a (100) crystal face ratio of 92%.

Preparation of Silver Halide Emulsion B2

Similarly to the foregoing silver halide emulsion B1, light-sensitive silver halide emulsion B2 was prepared, except that after nucleation, the whole amount of solution F1 was added and then, 4 ml of a 0.1% ethanol solution of the foregoing compound (TPPS) was added thereto. The prepared emulsion (also denoted as AgX B2) was comprised of monodisperse cubic silver iodobromide grains (iodide content 3.5 mol %) having an average grain size of 55 nm, a grain size variation coefficient of 12% and a (100) crystal face ratio of 92%.

Preparation of Powdery Organic Silver Salt

In 4,720 ml of pure water were dissolved 130.8 g of behenic acid, 67.7 g of arachidic acid, 43.6 g of stearic acid, and 2.3 g of palmitic acid at 80° C. Subsequently, 540.2 ml of a 1.5 M aqueous sodium hydroxide solution was added, and further, 6.9 ml of concentrated nitric acid was added. Thereafter, the resultant mixture was cooled to 55° C., whereby an aliphatic acid sodium salt solution was prepared. While maintaining the aliphatic acid sodium salt solution at 55° C., each of light-sensitive silver halide emulsions A1, A2, A3, B1 and B2 (in an amount shown in Table 2) and 450 ml of pure water were added and stirred for 5 min.

Subsequently, 468.4 ml of 1 mol/L silver nitrate solution was added over 2 min. and stirred for 10 min., whereby an organic silver salt dispersion was prepared. Thereafter, the organic silver salt dispersion was transferred to a water washing machine, and deionized water was added. After stirring, the resultant dispersion was allowed to stand, whereby a flocculated organic silver salt was allowed to float and was separated, and the lower portion, containing water-soluble salts, were removed. Thereafter, washing was repeated employing deionized water until electric conductivity of the resultant effluent reached 2 μS/cm. After centrifugal dehydration, the resultant cake-shaped aliphatic carboxylic acid silver salt was dried employing an gas flow type dryer Flush Jet Dryer (manufactured by Seishin Kigyo Co., Ltd.), while setting the drying conditions such as nitrogen gas as well as heating flow temperature at the inlet of the dryer (65° C. at the inlet and 40° C. at the outlet), until its moisture content reached 0.1 percent, whereby powdery organic silver salt was prepared. The moisture content of the organic silver salt compositions was determined employing an infrared moisture meter.

Preparation of Preliminary Dispersion

In 1457 g of methyl ethyl ketone (hereinafter referred to as MEK) was dissolved 14.57 g of poly(vinyl butyral) exhibiting a Tg of 75° C. and containing a $SO_3K$ group at 0.2 mmol/g, as a binder of the light-sensitive layer (Light-sensitive layer). While stirring by dissolver DISPERMAT Type CA-40M (manufactured by VMA-Getzmann Co.), 500 g of the foregoing powdery organic silver salt was gradually added and sufficiently mixed, and preliminary dispersion was thus prepared.

Preparation of Light-Sensitive Dispersion

Preliminary dispersion A, prepared as above, was charged into a media type homogenizer DISPERMAT Type SL-C12EX (manufactured by VMA-Getzmann Co.), filled with 0.5 mm diameter zirconia beads (Toreselam, produced by Toray Co.) so as to occupy 80 percent of the interior volume so that the retention time in the mill reached 1.5 minutes and was dispersed at a peripheral rate of the mill of 8 m/second, whereby light-sensitive emulsion dispersed solution was prepared.

Preparation of Stabilizer Solution

Stabilizer solution was prepared by dissolving 1.0 g of stabilizer 1 and 0.31 g of potassium acetate in 4.97 g of methanol.

Preparation of Infrared Sensitizing Dye a Solution

Infrared sensitizing dye A solution was prepared by dissolving 9.6 mg of infrared sensitizing dye 1, 9.6 mg of infrared sensitizing dye 2, 1.488 g of 2-chloro-benzoic acid, 2.779 g of stabilizer 2, and 365 mg of 5-methyl-2-mercaptobenzimidazole in 31.3 ml of MEK in a dark room.

Preparation of Additive Solution (a)

Additive solution (a) was prepared by dissolving a reducing agent (as shown in Table 2), 0.159 g of yellow dye forming leuco dye (YA-1) of the foregoing formula (YB), 0.159 g of cyan dye forming leuco dye (CLA-4), 1.54 g of 4-methylphthalic acid, and 0.48 g of aforesaid infrared dye 1 in 100.0 g of MEK.

Preparation of Additive Solution (b)

Additive Solution (b) was prepared by dissolving 1.56 g of Antifoggant 2, 0.5 g of antifoggant 3, 0.5 g of antifoggant 4, 0.5 g of antifoggant 5 and 3.43 g of phthalazine in 40.9 g of MEK.

Preparation of Additive Solution (c)

Additive Solution (c) was prepared by dissolving 0.05 g of silver saving agent (SE1-3) in 39.95 g of MEK.

Preparation of Additive Solution (d)

Additive Solution (d) was prepared by dissolving 0.1 g of supersensitizer 1 in 9.9 g of MEK.

Preparation of Additive Solution (e)

Additive Solution (e) was prepared by dissolving 0.5 g of potassium p-toluenesulfonate and 0.5 g of antifoggant 6 in 9.0 g of MEK.

Preparation of Additive Solution (f)

Additive solution (f) was prepared by dissolving an antifoggant containing vinylsulfone $[(CH_2{=}CH{-}SO_2CH_2)_2CHOH]$ in 9.0 g of MEK.

Preparation of Light-Sensitive Layer Coating Solution

While stirring, 50 g of the foregoing light-sensitive dispersion (shown in Table 2) and 15.11 g of MEK were mixed and the resultant mixture was maintained at 21° C., then, 1000 μl of chemical sensitizer S-5 (0.5% methanol solution) and after 2 min., 390 μl of antifoggant 1 (10% methanol solution) was added thereto and stirred for 1 hr. Further, 494 μl of calcium bromide (10% methanol solution) was added and after stirred for 10 minutes, gold sensitizer Au-5 corresponding to 1/20 mol of the foregoing chemical sensitizer was added. Subsequently, 167 μl of the foregoing stabilizer solution was added and stirred for 10 minutes. Thereafter, 1.32 g of the foregoing infrared sensitizing dye A was added and the resulting mixture was stirred for one hour. Subsequently, the resulting mixture was cooled to 13° C. and stirred for 30 min. While maintaining at 13° C., 0.5 g of additive solution d, 0.5 g of additive solution e, 0.5 g of additive solution f and 13.31 g of the binder used in the preliminary dispersion A were added and stirred for 30 min. Thereafter, 1.084 g of tetrachlorophthalic acid (9.4% MEK solution) was added and stirred for 15 minutes. Further, while stirring, 12.43 g of additive solution a, 1.6 ml of Desmodur N3300 (aliphatic isocyanate, manufactures by Mobay Chemical Corp. 10% MEK solution), 4.27 g of additive solution b and 4.0 g of additive solution c were successively added, whereby a light-sensitive layer coating solution was prepared.

Additives used in the respective coating solutions and the coating solution of the light-sensitive layer are shown with respect to their chemical structures, as below.

| Preparation of Lower Protective Layer | |
|---|---|
| Acetone | 5 g |
| MEK | 21 g |
| Cellulose acetate Propionate (CAP-141-20, Tg of 190° C., Eastman Chemical Co.) | 2.3 g |
| Methanol | 7 g |
| Phthalazine | 0.25 g |
| $CH_2{=}CHSO_2CH_2CH_2OCH_2CH_2SO_2CH{=}CH_2$ | 0.035 g |

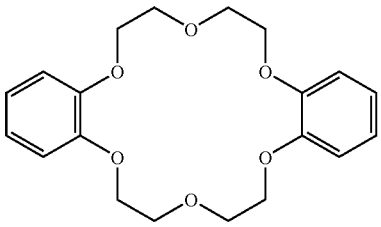

Stabilizer 1

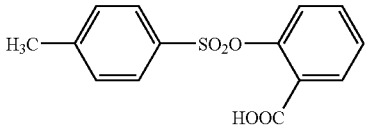

Stabilizer 2

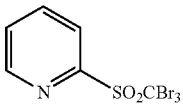

Antifoggant 2

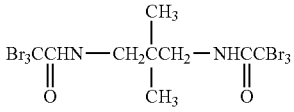

Antifoggant 3

-continued
Preparation of Lower Protective Layer
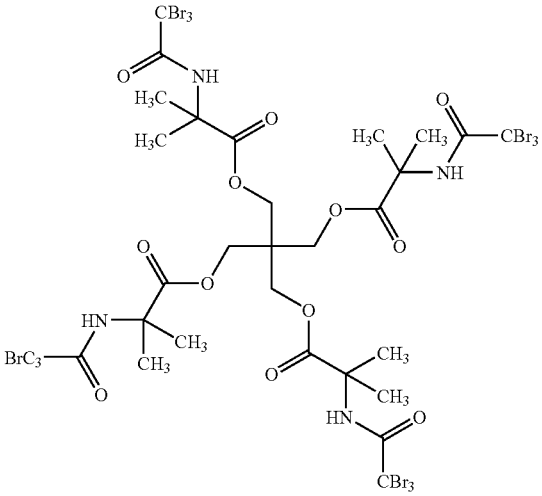
Antifoggant 4
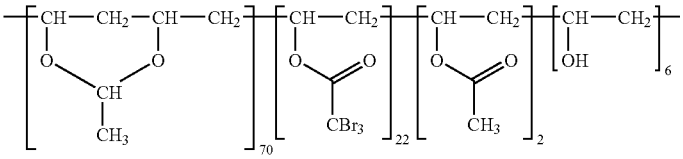
Antifoggant 5
number average molecular weight 20,000
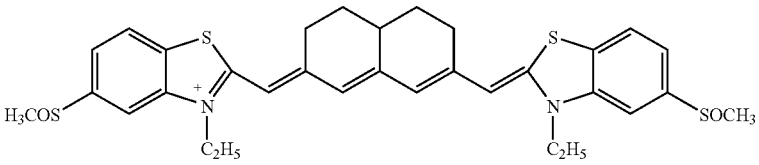
$BF_4^-$
Infrared sensitizing dye 1
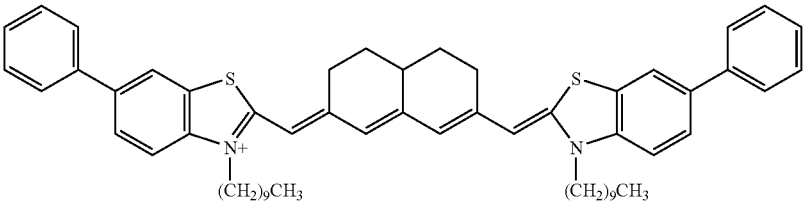
p-$TsO^-$
Infrared sensitizing dye 2
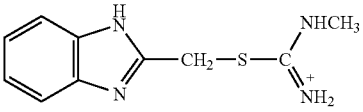
Supersensitizer 1
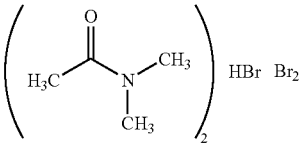
Antifoggant 1

-continued

| Preparation of Lower Protective Layer |
|---|

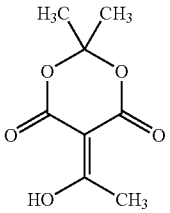

Antifoggant 6

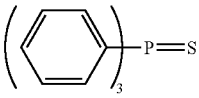

Chemical sensitizer S-5

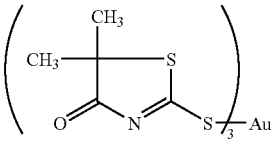

Au-5

| Preparation of Upper Protective Layer | |
|---|---|
| Acetone | 5 g |
| MEK | 21 g |
| Cellulose acetate Propionate (CAP-141-20, Tg of 190° C.) | 2.3 g |
| Paraloid A-21(Rohm & Haas Co.) | 0.08 g |
| Benzotriazole | 0.03 g |
| Methanol | 7 g |
| Phthalazine | 0.25 g |
| Monodisperse spherical three dimension-cured PMMA (average particle size 1.0 μm) | 0.40 g |
| Monodisperse spherical three dimension-cured PMMA (average particle size 4.5 μm) | 0.10 g |
| $CH_2{=}CHSO_2CH_2CH_2OCH_2CH_2SO_2CH{=}CH_2$ | 0.035 g |
| $C_{12}F_{25}(CH_2CH_2O)_{10}C_{12}F_{25}$ | 0.01 g |
| Fluorinated surfactant (Table 2) | 0.005 g |
| Fluoropolymer (FM-1) | 0.01 g |
| Lubricant (Table 2) | 0.1 g |
| α-alumina (Mohs hardness 9) | 0.1 g |

Coating solutions of the lower and upper protective layers were prepared based on the foregoing composition similarly to the coating solution of the back coat layer described earlier, in which silica was dispersed in MEK at a concentration of 1% using a dissolver type homogenizer and finally added.

Preparation of Slipping Layer Solution

The above-described coating solution of the light-sensitive layer was diluted with MEK to 10.5% solids by using a dissolver type homogenizer. Then, PMMA was dissolved in the coating solution at a binder concentration of 30% and diluted with MEK to 10.5% solids by using a dissolver type homogenizer to obtain a coating solution of a slipping layer.

Preparation of Photothermographic Material

The coating solution of the back coat layer and the coating solution of the protective layer for the back coat layer were coated on the upper subbing layer B-2, using a extrusion coater at a coating speed of 50 m/min so that the respective layers had a dry thickness of 1.5 μm. Drying was conducted at a dry bulb temperature of 100° C. and a dew point of 10° C. over a period of 5 min.

The coating solution of the light-sensitive layer and the coating solution of the protective layer (surface protective layer) for the light-sensitive layer were coated on the upper subbing layer A-2, using a slide coater at a coating speed of 50 m/min to prepare photothermographic material samples 101 to 124, as shown in Table 2. Coating was conducted so that the slipping layer had a dry thickness of 0.3 μm, the light-sensitive layer had a dry thickness of 10.5 μm, and the protective layer for the light-sensitive layer (surface protective layer) had a dry thickness of 3.0 μm (i.e., 1.5 μm of the upper surface protective layer and 1.5 μm of the lower surface protective layer). Thereafter, drying was conducted at a dry bulb temperature of 75° C. and a dew point of 10° C. over a period of 10 min.

Samples 101 to 117 and 119 to 128 were each measured with respect to surface roughness and it was proved that each sample exhibited Rz(E)/Rz(B)=0.40, Rz(B)=6.5 μm and Rz(E)=2.6 μm. Ra(E) and Ra(B) were 120 nm and 107 nm, respectively.

Sample 118 was also measured with respect to surface roughness and it was proved that each sample exhibited Rz(E)/Rz(B)=0.32, Rz(B)=3.7 μm and Rz(E)=1.2 μm. Ra(E) and Ra(B) were 81 nm and 76 nm, respectively.

In samples 101 to 128 an absorption peak due to a yellow dye forming leuco dye and an absorption peak due to a cyan dye forming leuco dye were noticed at 420 nm and 620 nm, respectively.

Sample 117 was prepared similarly to Sample 102, provided that 130.8 g of behenic acid, 67.7 g of arachidic acid, 43.6 g of stearic acid and 2.3 g of palmitic acid were replaced by 259.4 g of behenic acid, 0.5 g of arachidic acid.

Sample 118 was prepared similarly to Sample 102, provided that 0.03 g of monodisperse spherical three dimension-cured PMMA (monodispersibility of 15%, average particle size of 10 μm) was replaced by 0.02 g of spherical PMMA (average particle size of 6 μm) in the preparation of a coating solution of the back coat protective layer and the monodisperse spherical three dimension-cured PMMA (average particle size of 1.0 μm) was not incorporated and 0.10 g of monodisperse spherical three dimension-cured PMMA (average particle size of 4.5 μm) was replaced by 0.10 g of monodisperse spherical three dimension-cured PMMA (monodispersibility of 15%, average particle size of 2.8 μm) in the preparation of the protective layer (upper surface protective layer) of the light-sensitive layer.

Sample 119 was prepared similarly to Sample 102, provided that the dry thickness of the light-sensitive layer was changed from 10.5 μm to 13.0 μm(total thickness of light-sensitive layer and its protective layer of 16.0 μm).

Sample 120 was prepared similarly to Sample 102, provided that the dry thickness of the light-sensitive layer was changed from 10.5 μm to 18 μm (total thickness of light-sensitive layer and its protective layer of 21.0 μm).

Sample 121 was prepared similarly to Sample 102, provided that the amount of $SO_3K$ group-containing polyvinyl butyral (Tg of 62° C., $SO_3K$ content of 0.2 mmol/g) was changed from 9.31 g to 13.31 g and $SO_3K$ group-containing polyurethane (UR 8300, produced by TOYOBO Co., Tg of 23° C.) was not used.

Exposure and Processing

The thus prepared samples 101 to 128 were each cut to a size of 34.5 cm×43.0 cm, packed with packaging material in an atmosphere 25° C. and 50% R.H. and allowed to stand at ordinary temperature for 2 weeks. Thereafter, the samples were evaluated as below.

Packaging Material

There were used a paper tray and a barrier bag comprising 10 μm thick polyethylene/9 μm thick aluminum foil/15 μm thick nylon/50 μm thick polyethylene containing 3% carbon and exhibiting an oxygen permeability of 0.02 ml/atm·$m^2$·25° C.·day and a moisture permeability of 0.001 g/$m^2$·40° C.·90% RH·day.

Evaluation of Sample

Exposure and Processing

The thus prepared samples 101 to 128 were each cut to a size of 34.5 cm×43.0 cm and were simultaneously exposed and developed in a thermal processor (an image forming apparatus), as shown in FIG. 1 (installed with a 810 nm semiconductor laser exhibiting a maximum output of 50 mW), as shown in FIG. 1 (in which designations 51, 52 and 53 were respectively set to a temperature of 100° C., 123° C. and 123° C. and the respective times were 2 sec., 2 sec. and 6 sec. and the total time was 10 sec.). The expression, simultaneously exposed and developed means that in a sheet of photothermographic material, one part of the sheet is exposed, while another exposed part is being developed. The distance between the exposure section and the development section was 12 cm, in which the linear transport speed was 35 mm/sec. The transport speed from a photothermographic

TABLE 2

| | Light-sensitive Layer | Upper Protective Layer (B) *1 | | Upper Protective Layer (E) *2 | | |
|---|---|---|---|---|---|---|
| Sample No. | Silver Halide Emulsion (g) | Fluorinated Surfactant | Lubricant (MW *3) | Fluorinated Surfactant | Lubricant (MW *3) | Reducing Agent (g) |
| 101 (Inv.) | A2/B2 (36.2/9.1) | SF-8 | LB-1 (1270) | SF-8 | LB-1 (1270) | 1-1 (27.98) |
| 102 (Inv.) | A3/B2 (36.2/9.1) | SF-8 | LB-1 (1270) | SF-8 | LB-1 (1270) | 1-1 (27.98) |
| 103 (Inv.) | A3/B2 (36.2/9.1) | SF-8 | LB-2 (1186) | SF-8 | LB-2 (1186) | 1-1 (27.98) |
| 104 (Inv.) | A3/B2 (36.2/9.1) | SF-8 | LB-3 (885) | SF-8 | LB-3 (885) | 1-1 (27.98) |
| 105 (Inv.) | A3/B2 (36.2/9.1) | SF-10 | LB-1 (1270) | SF-10 | LB-1 (1270) | 1-1 (27.98) |
| 106 (Inv.) | A3/B2 (36.2/9.1) | SF-13 | LB-2 (1186) | SF-13 | LB-2 (1186) | 1-1 (27.98) |
| 107 (Inv.) | A3/B2 (36.2/9.1) | SF-14 | LB-3 (885) | SF-14 | LB-3 (885) | 1-1 (27.98) |
| 108 (Inv.) | A3/B2 (36.2/9.1) | SF-8 | LB-4 (723) | SF-8 | LB-4 (723) | 1-1 (27.98) |
| 109 (Inv.) | A3/B2 (36.2/9.1) | SF-8 | LB-5 (639) | SF-8 | LB-5 (639) | 1-1 (27.98) |
| 110 (Inv.) | A3/B2 (36.2/9.1) | SF-10 | LB-6 (934) | SF-10 | LB-6 (934) | 1-1 (27.98) |
| 111 (Inv.) | A3/B2 (36.2/9.1) | SF-14 | LB-6 (934) | SF-14 | LB-6 (934) | 1-1 (27.98) |
| 112 (Inv.) | A3/B2 (36.2/9.1) | SF-8 | LB-1 (1270) | SF-8 | LB-1 (1270) | 1-1 (27.98) |
| 113 (Inv.) | A3/B2 (36.2/9.1) | SF-8 | LB-1 (1270) | SF-8 | LB-1 (1270) | 1-10 (27.98) |
| 114 (Inv.) | A3/B2 (36.2/9.1) | SF-8 | LB-1 (1270) | SF-8 | LB-1 (1270) | *4 |
| 115 (Inv.) | A3/B2 (36.2/9.1) | SF-8 | LB-1 (1270) | SF-8 | LB-1 (1270) | 1-40 (27.98) |
| 116 (Inv.) | A3/B2 (36.2/9.1) | SF-8 | LB-1 (1270) | SF-8 | LB-1 (1270) | 1-47 (27.98) |
| 117 (Inv.) | A3/B2 (36.2/9.1) | SF-8 | LB-1 (1270) | SF-8 | LB-1 (1270) | 1-1 (27.98) |
| 118 (Inv.) | A3/B2 (36.2/9.1) | SF-8 | LB-1 (1270) | SF-8 | LB-1 (1270) | 1-1 (27.98) |
| 119 (Inv.) | A3/B2 (36.2/9.1) | SF-8 | LB-1 (1270) | SF-8 | LB-1 (1270) | 1-1 (27.98) |
| 120 (Inv.) | A3/B2 (36.2/9.1) | SF-8 | LB-1 (1270) | SF-8 | LB-1 (1270) | 1-1 (27.98) |
| 121 (Inv.) | A3/B2 (36.2/9.1) | SF-8 | LB-1 (1270) | SF-8 | LB-1 (1270) | 1-1 (27.98) |
| 122 (Inv.) | A3/B2 (36.2/9.1) | SF-8 | LB-1 (12701 | A | B (341) | 1-1 (27.98) |
| 123 (Inv.) | A3/B2 (36.2/9.1) | A | B (341) | SF-8 | LB-1 (1270) | 1-1 (27.98) |
| 124 (Inv.) | A1/B1 (36.2/9.1) | SF-8 | LB-1 (1270) | SF-8 | LB-1 (1270) | 1-1 (27.98) |
| 125 (Inv.) | A1/B1 (36.2/9.1) | SF-8 | LB-1 (1270) | SF-8 | LB-1 (1270) | 2-6 (27.98) |
| 126 (Comp.) | A1/B1 (36.2/9.1) | A | B (341) | A | B (341) | 1-1 (27.98) |
| 127 (Comp.) | A1/B1 (36.2/9.1) | A | C (519) | A | C (519) | 1-1 (27.98) |
| 128 (Comp.) | A1/B1 (36.2/9.1) | A | D (547) | A | D (547) | 1-1 (27.98) |

*1 Upper protective layer of the backing layer side,
*2 Upper protective layer of the light-sensitive layer side,
*3 Molecular weight,
*4 1-47/2-6 = (4.20/23.78)

Designations in Table 2 are as follows:

LB-1: i-tridecyl stearate
LB-2: i-tridecyl palmitate
LB-3: glycerin trioleate
LB-4: glycerin trimyristate
LB-5: glycerin trilaurate
LB-6: trimethylolpropane tri-i-stearate
A: $C_8F_{17}SO_3Li$
B: butyl stearate
C: oleyl oleate
D: arachic acid linol ($C_{19}H_{39}COOC_{17}HH_{31}$)
*4: (1−47)/(2−6)=4.20/23.78 material supplying device section to an exposure section, the transport speed at the exposure section and the transport speed at the development section were each 35 mm/sec. The bottom of a photothermographic material stock tray was positioned at a height of 45 cm from the floor. The time required for thermal processing (time from pickup in the tray section to discharge) was 45 sec., in which the interval of thermal development was 4 sec when being continuously processed. Exposure was stepwise conducted with decreasing exposure energy by 0.05 (in LogE) for each step from the maximum output.

Average Gradation (Ga):

The thus processed samples were each subjected to densitometry using PDM65 transmission densitometer (produced by Konica Corp.) to obtain a characteristic curve. An average gradation between optical densities of 0.25 and 2.5 was determined from the characteristic curve.

Internal Staining:

After 5,000 sheets of the individual sample were thermally processed in a thermal processor shown in FIG. 1 under the environment of 25° C. and 65% RH, each sample was visually evaluated with respect to stains adhered to the transport roller of the processor, based on the criteria in which the best level of no stain on the roller surface was ranked as 5 and the worst level (staining on the overall surface of the roller) was ranked as 1, and evaluated in five grades, provided that evaluation was made at 0.5 intervals. Abrasion mark:

Film conveyance was conducted using a thermal processor, as shown in FIG. 1 and occurrence of abrasion marks on the uppermost surface of the light-sensitive layer side was visually observed and evaluated based on the criteria in which the best level was ranked as 5 and the worst level was ranked as 1, and evaluated in five grades, provided that evaluation was made at 0.5 intervals. A level of 2.5 or less was unacceptable in practice.

Film conveyance:

Using a thermal processor, as shown in FIG. 1, 100 sheets of each sample were processed and film conveyance was performed under an environment of 10° C. and 15% RH to count the number of occurred film conveyance troubles (times per 100 sheets).

Density Variation with Change of Humidity:

The difference (ΔDmax) of the maximum density (Dmax 1) obtained by developing, under an environment of 25° C. and 40% RH, a sample aged for 24 hrs. at 25° C. and 40% RH and that (Dmax 2) obtained by developing, under an environment of 45° C. and 90% RH, a sample aged for 24 hrs. at 40° C. and 90% RH, that is, ΔDmax=(Dmax 1−Dmax 2) was determined using a PDM65 densitometer (produced by Konica Corp.) to evaluate density variation with change of humidity.

Surface Roughness:

Using a noncontact three-dimension surface analyzer (RST/PLUS, produced by WYKO Co.), raw samples which were not subjected to thermal development were each measured with respect to surface roughness (Ra), according to the following conditions:

1) objective lens:×10.0, intermediate lens:×1.0
2) measurement range: 463.4 μm×623.9 μm
3) pixel size: 368×238
4) filter: cylinder correction and correction for inclination
5) smoothing: medium smoothing
6) scanning speed: Low The surface roughness (Ra) was defined based on Surface Roughness of JIS B 061 (corresponding ISO 468-1982). A sample of 10 cm×10cm was divided to 100 squares at intervals of 1 cm, the center of the respective square regions was measured and an average value was calculated from 100 measurements.

Results are shown in Table 3.

TABLE 3

| Sample No. | Ga | Internal Staining | Film Abrasion | Film Conveyance | Density Variation |
|---|---|---|---|---|---|
| 101 (Inv.) | 4.0 | 5.0 | 5.0 | 0 | 0.1 |
| 102 (Inv.) | 4.0 | 5.0 | 5.0 | 0 | 0.1 |
| 103 (Inv.) | 4.0 | 5.0 | 5.0 | 0 | 0.1 |
| 104 (Inv.) | 4.0 | 5.0 | 5.0 | 0 | 0.1 |
| 105 (Inv.) | 4.0 | 5.0 | 5.0 | 0 | 0.1 |
| 106 (Inv.) | 4.0 | 5.0 | 5.0 | 0 | 0.1 |
| 107 (Inv.) | 4.0 | 5.0 | 5.0 | 0 | 0.1 |
| 108 (Inv.) | 4.0 | 4.5 | 4.5 | 1 | 0.2 |
| 109 (Inv.) | 4.0 | 4.0 | 4.0 | 2 | 0.2 |
| 110 (Inv.) | 4.0 | 5.0 | 5.0 | 0 | 0.1 |
| 111 (Inv.) | 4.0 | 5.0 | 5.0 | 0 | 0.1 |
| 112 (Inv.) | 4.0 | 5.0 | 5.0 | 0 | 0.1 |
| 113 (Inv.) | 4.1 | 5.0 | 5.0 | 0 | 0.1 |
| 114 (Inv.) | 3.8 | 4.5 | 4.5 | 1 | 0.2 |
| 115 (Inv.) | 6.7 | 5.0 | 5.0 | 0 | 0.1 |
| 116 (Inv.) | 3.9 | 5.0 | 5.0 | 1 | 0.2 |
| 117 (Inv.) | 4.0 | 5.0 | 5.0 | 0 | 0.0 |
| 118 (Inv.) | 4.0 | 4.0 | 4.0 | 2 | 0.2 |
| 119 (Inv.) | 4.0 | 4.5 | 4.5 | 1 | 0.1 |
| 120 (Inv.) | 4.0 | 4.0 | 4.0 | 2 | 0.2 |
| 121 (Inv.) | 4.0 | 4.0 | 4.0 | 2 | 0.3 |
| 122 (Inv.) | 4.0 | 4.0 | 4.0 | 3 | 0.3 |
| 123 (Inv.) | 4.0 | 4.0 | 4.0 | 3 | 0.3 |
| 124 (Inv.) | 3.9 | 4.5 | 4.5 | 1 | 0.1 |
| 125 (Inv.) | 3.5 | 4.5 | 4.5 | 1 | 0.3 |
| 126 (Comp.) | 4.0 | 1.5 | 2.0 | 12 | 1.0 |
| 127 (Comp.) | 4.0 | 2.0 | 2.0 | 11 | 0.9 |
| 128 (Comp.) | 3.9 | 2.0 | 2.0 | 10 | 0.9 |

As apparent from Table 3, even when subjecting photothermographic materials according to the invention to rapid thermal development by using a low-cost laser imager employing a thermal developing device provided with a pickup by a roller, there were obtained images with reduced internal staining, minimized abrasion, superior film conveyance under low humidity and reduced variation in density even when environmental humidity was varied.

The use of the highly active reducing agent represented by general formula (RD1) resulted in remarkable improvements.

It was proved that a total dry layer thickness of the light-sensitive layer and the protective layer for the light-sensitive layer of 10 to 20 μm resulted in tangible improvements.

It was also proved that in sample 102, when using a paper tray with a raised bottom structure in which silica gel was enclosed into the space of the lower portion, the density variation with change of humidity was reduced to 0.0, leading to an improvement.

While the invention has been described in detail and with reference to specific embodiments thereof, it will be apparent to one skilled in the art that various changes and modifications can be made therein without departing from the spirit and the scope thereof. For instance, the image forming apparatus 40 shown in FIG. 1 can constitute a laser imager for medical use which can form a medical image on film and output it through input of medical image data.

The image forming apparatus 40 of FIG. 1 is a relatively compact constitution of a desktop type as a whole. Further, the sheet film conveyance device of the invention is applicable not only to such a desktop type image forming apparatus but also to a relatively large image forming apparatus of a thermal development system, such as a stand-alone type.

What is claimed is:

1. An image forming method of a photothermographic material comprising on one side of a support a light-sensitive layer containing an organic silver salt, silver halide grains, a binder and a reducing agent and a light-insensitive layer and on the other side of the support a back coating layer by using a thermal processor, the method comprising the steps of:

subjecting the photothermographic material to imagewise exposure and subjecting the exposed photothermographic material to thermal development to form an image, wherein the thermal processor includes a transport system in which a feed roller is disposed with being in contact with a bundle of stacked film sheets of the photothermographic material so as to feed an uppermost film sheet of the bundle of film sheets by rotation of the feed roller to subject the fed film sheet to the exposure and the thermal development; the light-insensitive layer or the back coating layer contains a lubricant having a mass average molecular weight of 550 or more.

2. The image forming method of claim 1, wherein the lubricant is a fatty acid ester of a polyhydric alcohol.

3. The image forming method of claim 1, wherein an uppermost surface of the back coating layer side exhibits a ten-point mean roughness [Rz(B)] of 4.0 to 7.0 μm and an uppermost surface of the light-sensitive layer side exhibits a ten-point mean roughness [Rz(E)] of 1.5 to 4.0 μm.

4. The image forming method of claim 1, wherein the light-insensitive layer or the back coating layer comprises a fluorine-containing compound containing at least one substituent having 2 to 16 carbon atoms and 13 or less fluorine atoms and at least one of an anionic hydrophilic group and a nonionic hydrophilic group.

5. The image forming method of claim 1, wherein the light-insensitive layer or the back coating layer comprises a fluorine-containing compound represented by the following formula (SF):

$$[R_f\text{-}(L^1)_{m1}\text{-}]_p\text{-}(L^2)_{n1}\text{-}(A)_q \qquad \text{formula (SF)}$$

wherein $R_f$ is a fluorine-containing substituent group having 2 to 16 carbon atoms and 13 or less fluorine atoms, $L^1$ represents a bivalent linkage group not containing a fluorine atom, $L^2$ is a (p+q)-valent linkage group not containing a fluorine atom, A is an anion or its salt, m1 and n1 are each an integer of 0 or 1, p and q are each an integer of 1 to 3, provided that when q is 1, m1 and n1 are not zero at the same time.

6. The image forming method of claim 1, wherein the light-insensitive layer or the back coating layer comprises a compound represented by formula (F):

formula (F)

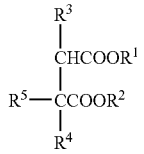

wherein $R^1$ and $R^2$ are each an alkyl group, provided that at least one of $R^1$ and $R^2$ is a fluoroalkyl group having 2 to 16 carbon atoms and 13 or less fluorine atoms; $R^3$ and $R^4$ are each a hydrogen atom or an alkyl group; $R^5$ is $-L-SO_3M^1$ in which $M^1$ is a hydrogen atom or a cation and L is a single bond or a substituted or unsubstituted alkylene group.

7. The image forming method of claim 1, wherein the light-sensitive layer contains at least two binders which differ as much as 5 to 60° C. in glass transition temperature between the binders.

8. The image forming method of claim 1, wherein the light-sensitive layer contains a polyurethane resin.

9. The image forming method of claim 1, wherein a total thickness of the light-sensitive layer and the light-insensitive layer is from 10 to 20 μm.

10. The image forming method of claim 1, wherein the light-sensitive layer has a thickness of 4 to 16 μm.

11. The image forming method of claim 1, wherein the reducing agent is a compound represented by formula (RD1):

formula (RD1)

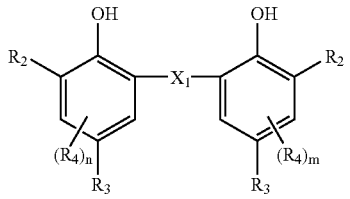

wherein $X_1$ is a chalcogen atom or $CHR_1$ in which $R_1$ is a hydrogen atom, a halogen atom, an alkyl group, an alkenyl group, an aryl group or a heterocyclic group; $R_2$ is an alkyl group, provided that at least one of two $R_2$s is a secondary or tertiary alkyl group; $R_3$ is a hydrogen atom or a group capable of being substituted on a benzene ring; $R_4$ is a group capable of being substituted on a benzene ring; m and n are each an integer of 3 to 2.

12. The image forming method of claim 11, wherein in formula (RD1), at least one of two $R_3$s is an alkyl group having 1 to 23 carbon atoms and substituted by a hydroxyl group, or an alkyl group having 1 to 20 carbon atoms and substituted by a group capable of forming a hydroxyl group upon deprotection.

13. The image forming method of claim 1, wherein the photothermographic material which was subjected to imagewise exposure and thermal development at a temperature of 123° C. for 10 sec. exhibits an average gradation of 1.8 to 6.0 between diffuse densities of 0.25 and 2.5 on a characteristic curve represented on rectangular coordinates of a diffuse density (Y-axis) and a common-logarithmic exposure (X-axis), each having an equivalent unit length.

14. The image forming method of claim 1, wherein the film sheet is transported at a transport speed of 30 to 200 mm/sec, while being heated.

15. The image forming method of claim 1, wherein a portion of the film sheet is subjected to exposure, while a portion of the film sheet that was subjected to exposure is being subjected to development simultaneously.

16. The image forming method of claim 1, wherein the thermal processor comprises an exposure section and a development section, and a distance between the exposure section and the development section is from 0 to 50 cm.

17. The image forming method of claim 1, wherein the exposed photothermographic material is subjected to thermal development over a period of 3 to 10 sec.

* * * * *